US006258000B1

(12) United States Patent
Liechty, II

(10) Patent No.: US 6,258,000 B1
(45) Date of Patent: Jul. 10, 2001

(54) PENETRATION ENHANCING AERODYNAMICALLY FAVORABLE ARROWHEAD

(76) Inventor: Victor Jay Liechty, II, 1250 N. 1750 W., Provo, UT (US) 84604

( * ) Notice: Subject to any disclaimer, the term of this patent is extended or adjusted under 35 U.S.C. 154(b) by 0 days.

(21) Appl. No.: 09/322,278

(22) Filed: May 28, 1999

Related U.S. Application Data

(63) Continuation-in-part of application No. 09/082,636, filed on May 21, 1998.

(51) Int. Cl.[7] ..... F42B 6/08
(52) U.S. Cl. ..... 473/583
(58) Field of Search ..... 473/578, 582, 473/583, 584

(56) References Cited

U.S. PATENT DOCUMENTS

| | | | |
|---|---|---|---|
| 2,568,417 | 9/1951 | Steinbacher | 473/583 |
| 3,000,635 | 9/1961 | Nieman | 473/583 |
| 3,036,395 | 5/1962 | Nelson | 43/6 |
| 3,759,519 | 9/1973 | Palma | 473/578 |
| 4,166,619 | 9/1979 | Bergmann et al. | 473/581 |
| 4,210,330 | 7/1980 | Kosbab | 473/584 |
| 4,381,866 | 5/1983 | Simo | 473/584 |
| 4,452,460 | 6/1984 | Adams | 473/584 |
| 4,529,208 | 7/1985 | Simo | 473/584 |
| 4,558,868 | 12/1985 | Musacchia | 473/584 |
| 4,565,377 | 1/1986 | Troncoso | 473/584 |
| 4,576,589 | 3/1986 | Kraus et al. | 604/8 |
| 4,601,710 | 7/1986 | Moll | 604/164.12 |
| 4,615,529 | 10/1986 | Vocal | 473/583 |
| 4,616,835 | 10/1986 | Trotter | 473/583 |
| 4,643,435 | 2/1987 | Musacchia | 473/584 |
| 4,676,512 | 6/1987 | Simo | 473/584 |
| 4,742,637 | 5/1988 | Musacchia | 43/6 |
| 4,932,671 | 6/1990 | Anderson, Jr. | 473/583 |
| 4,940,246 | 7/1990 | Stagg | 473/583 |
| 4,973,060 | 11/1990 | Herzing | 473/583 |

(List continued on next page.)

OTHER PUBLICATIONS

Wasp Diamond—Point Chisel Tip—WASP Archery Products Bowhunter Aug./Sep. 1990 p. 48.
Rocky Mnt. Gator—Barrie Archery—as per ABCC ad book 4th Edition Apr. 1995 p. R–10.
Dragontail—Bangtail MFG.—as per ABCC ad book 4th Edition Apr. 1995 p. Misc 10.
Mohawk Broadhead—Mohawk Archery Products as per ABCC Ad Book 4th Edition Apr. 1995 p. M–8.
Ben Pearson fishing point—As per ABCC Ad Book 4th Edition Apr. 1995 p. B–22.
Little Shaver Broadhead—As per ABCC Ad Book 4th Edition Apr. 1995 p. L–2.
The Fang—Arrow Enterprise Inc As per ABCC Ad Book 4th Edition Apr. 1995 p. F–2.

*Primary Examiner*—John A. Ricci

(57) ABSTRACT

Aerodynamically favorable arrowheads such as pivotal blade arrowheads and/or blade-opening arrowheads that have a sharp cutting edge located upon their arrowhead bodies at a location forward of a corresponding main cutting blade cutting edge when in a penetrating configuration such that the arrowheads maintain favorable aerodynamic flight characteristics and cut target material in front of the main cutting blades when penetrating a target so as to eliminate the frictional drag that the otherwise dull arrowhead bodies would generate with the target before the main cutting blades began cutting target material thereinfront.

66 Claims, 29 Drawing Sheets

U.S. PATENT DOCUMENTS

| | | | |
|---|---|---|---|
| 5,044,640 | 9/1991 | Del Monte et al. | 473/584 |
| 5,046,744 | 9/1991 | Eddy | 473/583 |
| 5,057,082 | 10/1991 | Burchette, Jr. | 604/164.06 |
| 5,078,407 | 1/1992 | Carlston et al. | 473/583 |
| 5,082,292 | 1/1992 | Puckett et al. | 473/583 |
| 5,090,709 | 2/1992 | Johnson | 473/584 |
| 5,100,143 | 3/1992 | Puckett | 473/583 |
| 5,102,147 | 4/1992 | Szeluga | 473/584 |
| 5,112,063 | 5/1992 | Puckett | 473/583 |
| 5,137,282 | 8/1992 | Segar et al. | 473/583 |
| 5,160,148 | 11/1992 | Musacchia, Sr. | 473/584 |
| 5,172,916 | 12/1992 | Puckett | 473/583 |
| 5,178,398 | 1/1993 | Eddy | 473/583 |
| 5,178,399 | 1/1993 | Garoutte | 473/584 |
| 5,286,035 | 2/1994 | Ward | 473/584 |
| 5,342,382 | 8/1994 | Brinkerhoff et al. | 606/184 |
| 5,385,572 | 1/1995 | Nobles et al. | 606/185 |
| 5,458,341 | 10/1995 | Forrest et al. | 473/583 |
| 5,482,293 | 1/1996 | Lekavich | 473/584 |
| 5,482,294 | 1/1996 | Sullivan et al. | 473/584 |
| 5,496,042 | 3/1996 | Craft et al. | 473/583 |
| 5,496,043 | 3/1996 | Ester | 473/584 |
| 5,564,713 | 10/1996 | Mizek et al. | 473/583 |
| 5,624,459 | 4/1997 | Kortenbach et al. | 606/185 |
| 5,803,844 | 9/1998 | Anderson | 473/583 |
| 5,803,845 | 9/1998 | Anderson | 473/583 |
| 5,820,498 | 10/1998 | Maleski | 473/584 |
| 5,857,930 | 1/1999 | Troncoso | 473/583 |
| 5,871,410 | 2/1999 | Simo et al. | 473/583 |
| 5,879,252 | 3/1999 | Johnson | 473/583 |

802
820

868

870
850
800
843
842
830

300
408
402
400
406
404

302
400
406
404
410

1200
1090
870
800
200
400
842
408
843
300
700
1072
2
2
700
686
674
600
757
753
750
1076
1000
680
1020
670
1080
1030
950
952
952
950
900
952
970

750
753
700
404
753
830
686
1200
600
757

202
802
704
400
13
13
676
750

1090
870
800

404
830
686
750
706
201
706
304
400
11
11
706
686
201
750
676

950

FIG. 22
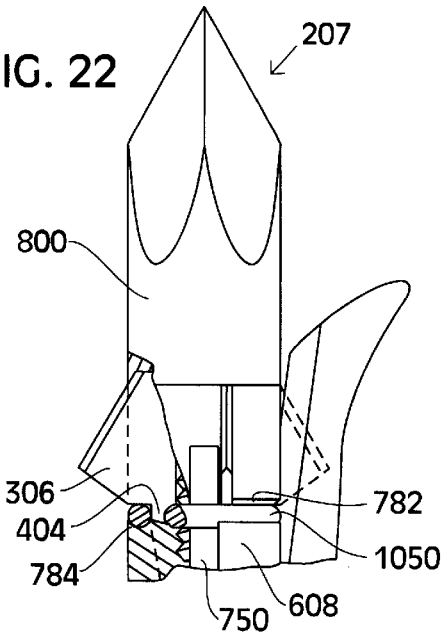
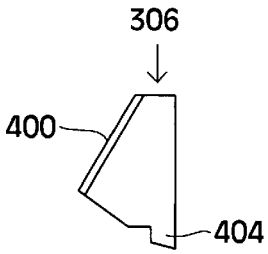
FIG. 24
FIG. 25
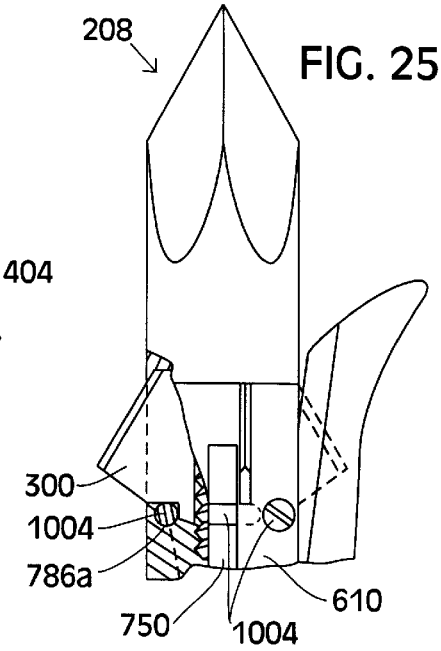
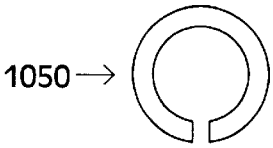
FIG. 23
FIG. 27
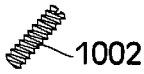
FIG. 26
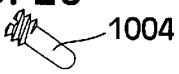
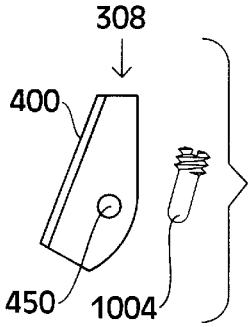
FIG. 30
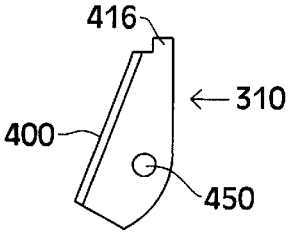
FIG. 31
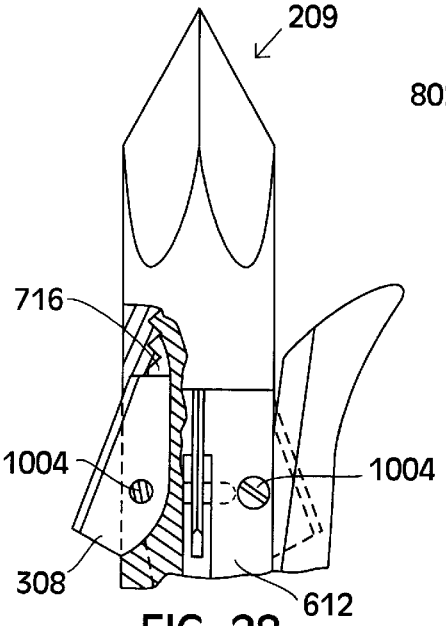
FIG. 28
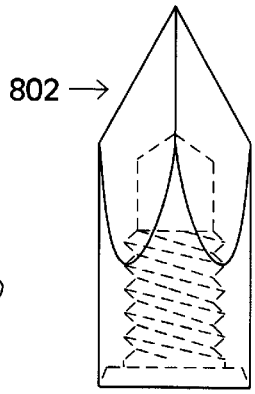
FIG. 29

316
418
452

312

452
1006
318
210
400
720
804
312
1006
786b
318
418
314

300
400
1072
1074
211
1040

1010
902
950
1010
682

1082
614
1010
682
616

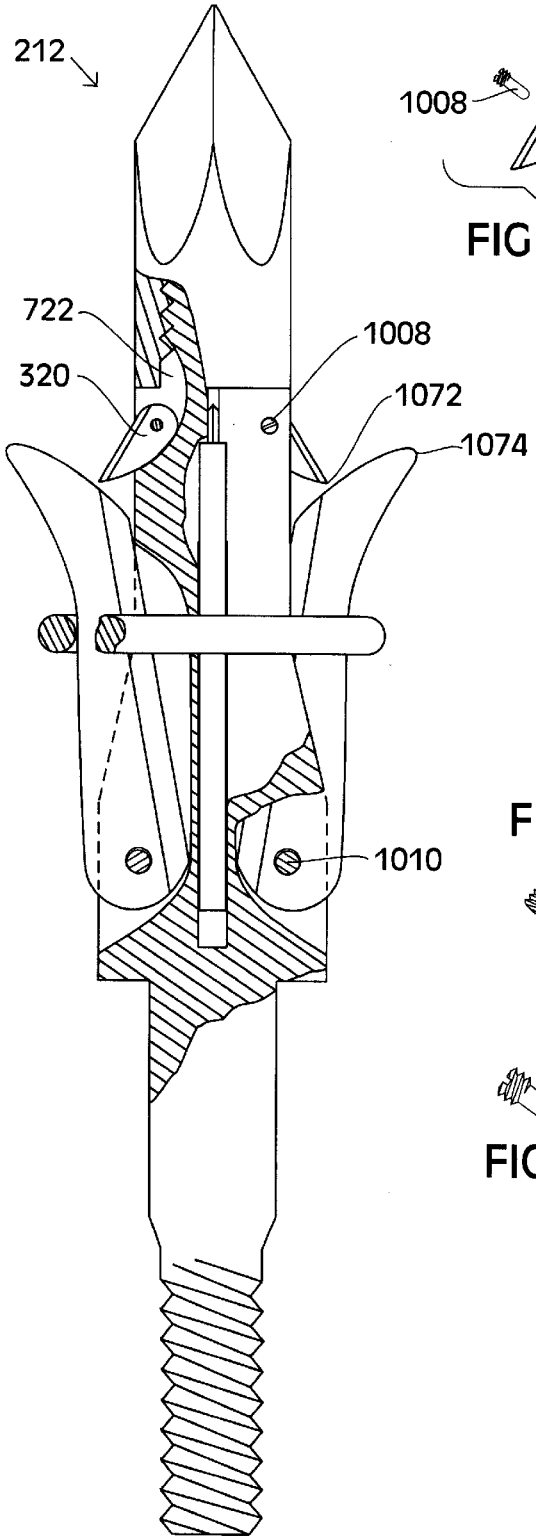
FIG. 40
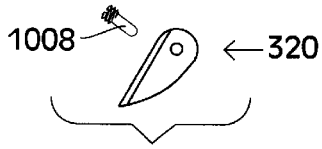
FIG. 43
FIG. 41
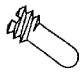
FIG. 42
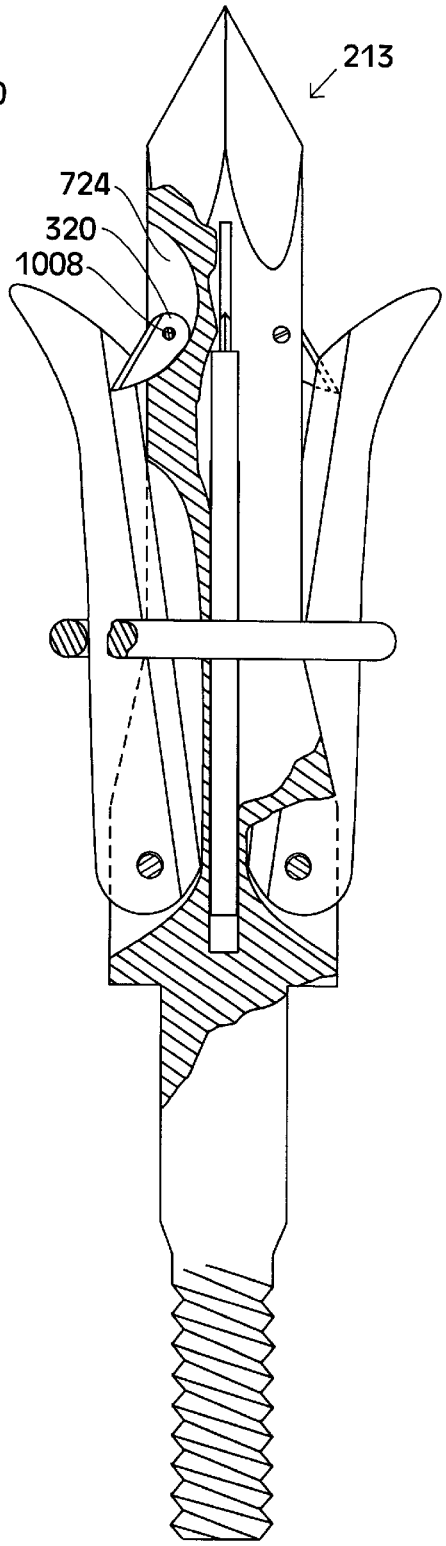
FIG. 44

1090
215
810
726
324
49
49
624

726
624
324
470
215

726
624

420
490
401
400
324
402
470
401
401
480

845
844
810

400
402
480
490
324
470
420
400
470
52
52
490
480
324

326
216

328
217
328

330
218
330
326

812
728
332
67
67
219
626

788b
678
678
728

332
480
490
470
332
490
480

728
678
1060
1070
626
678
332
219
626

728
684
334
224
334

220

221
814

222
685

223

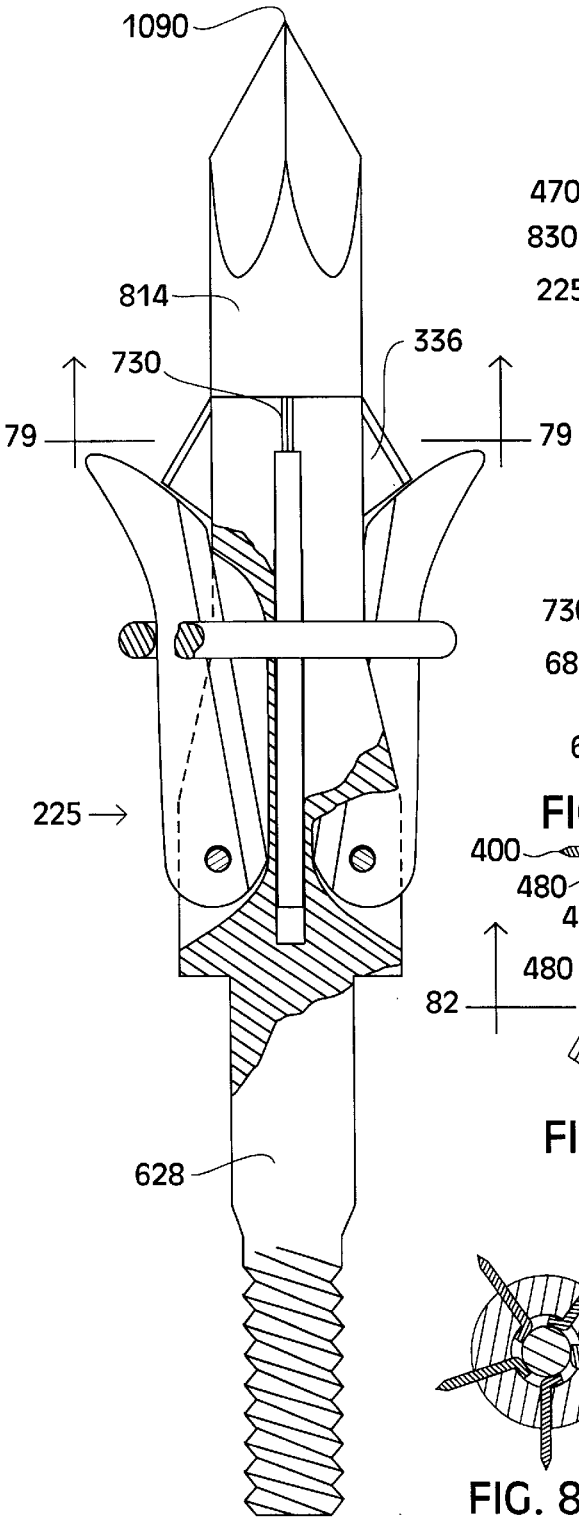
FIG. 76
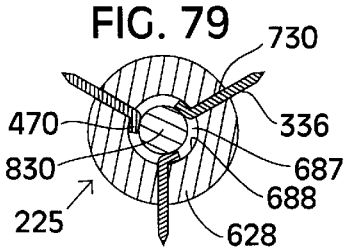
FIG. 79
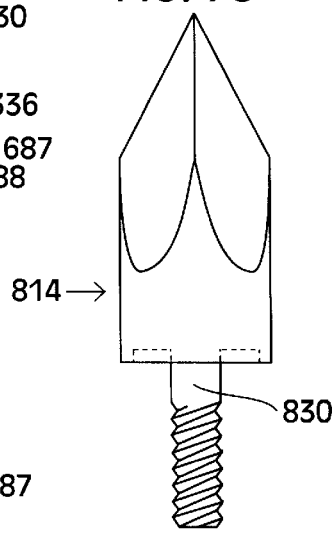
FIG. 78
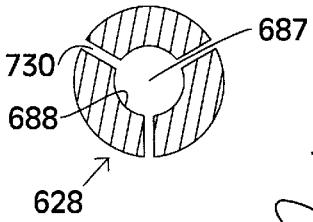
FIG. 80
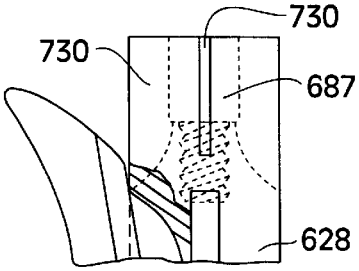
FIG. 77
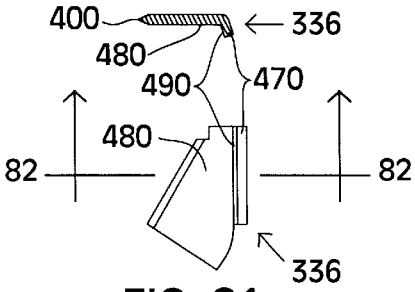
FIG. 82
FIG. 81
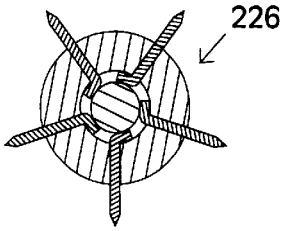
FIG. 84
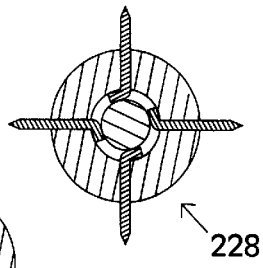
FIG. 85
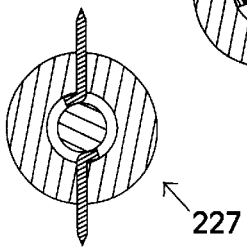
FIG. 83

FIG. 93
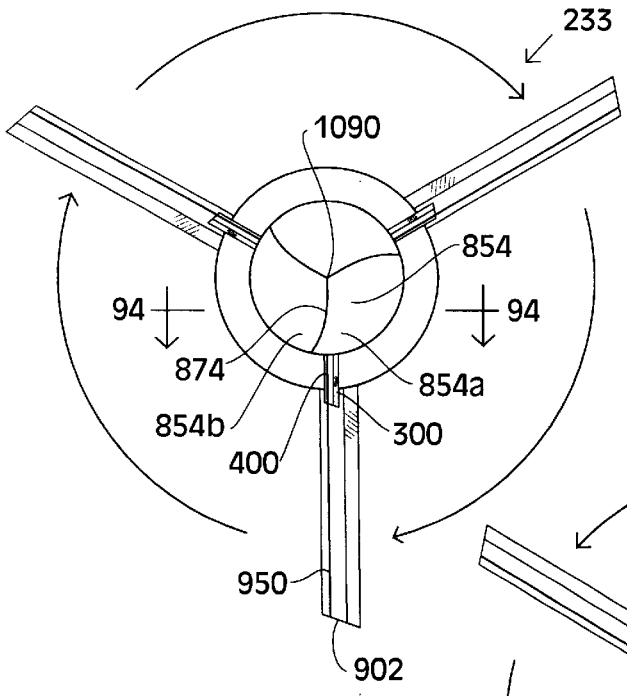
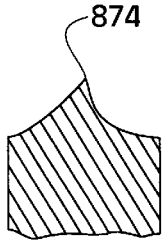
FIG. 95
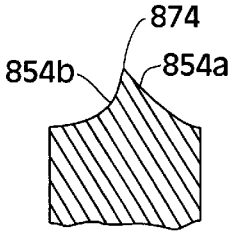
FIG. 94
FIG. 96
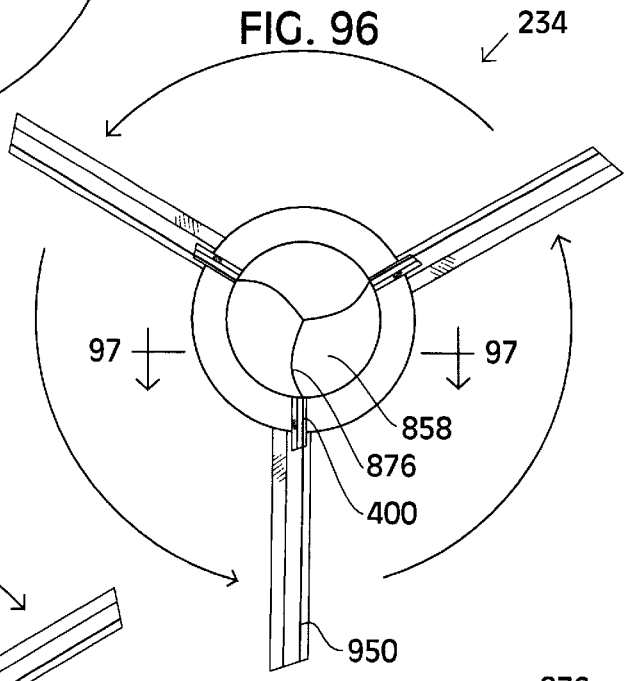
FIG. 98
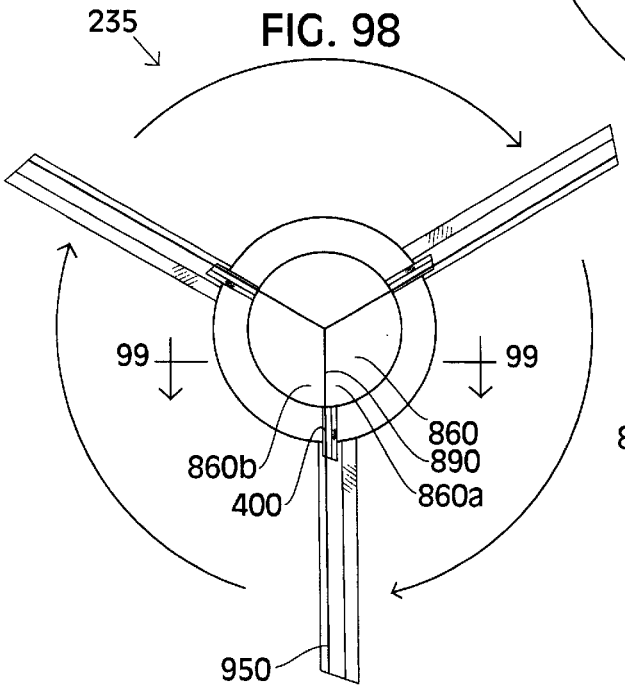
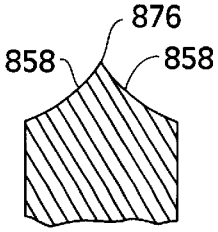
FIG. 97
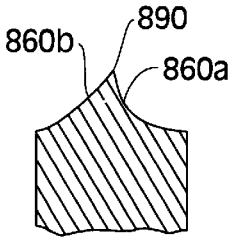
FIG. 99

FIG. 100
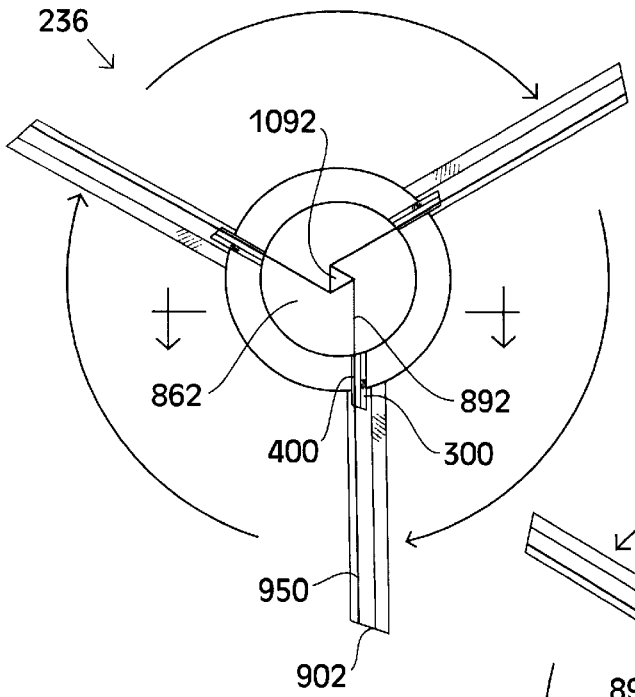
FIG. 101
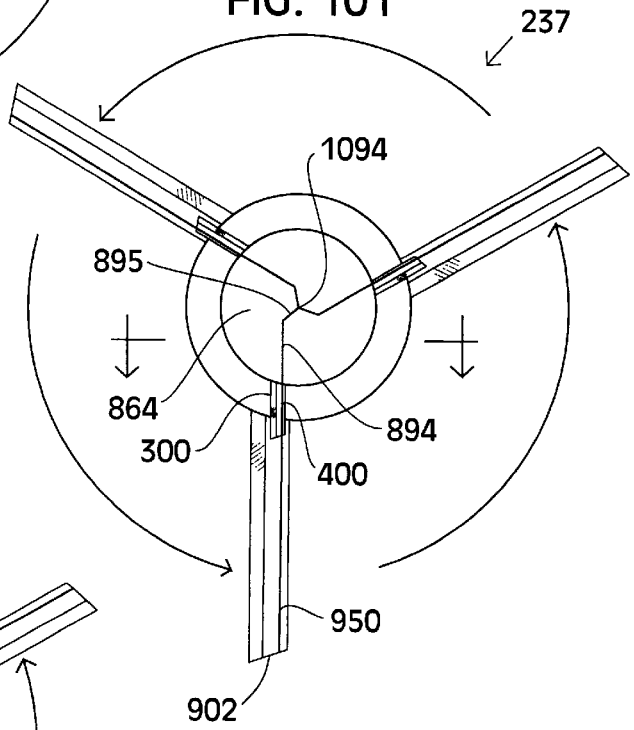
FIG. 102
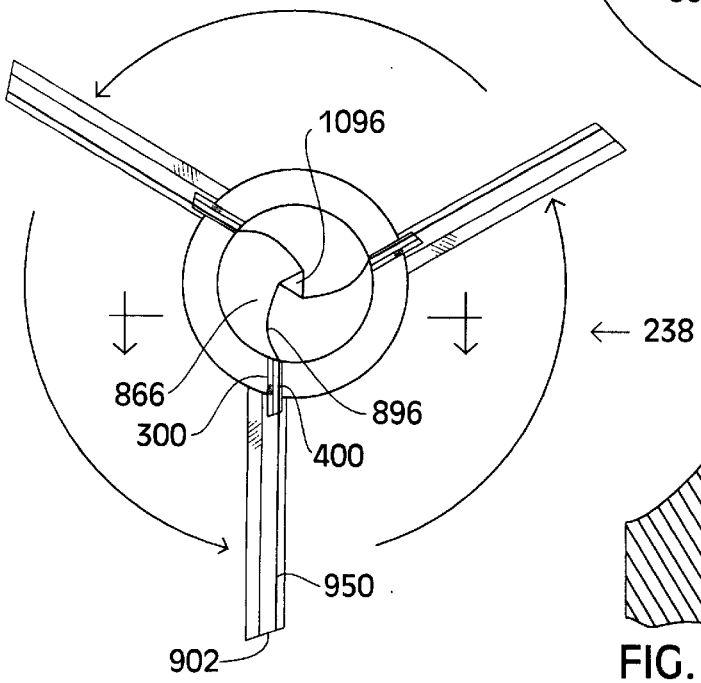
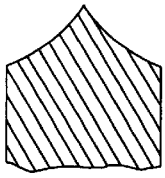
FIG. 103
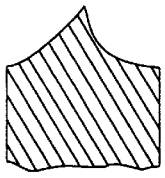
FIG. 104
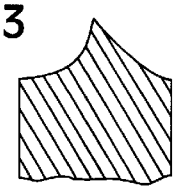
FIG. 105

870
810
810
239
344
400
738
344
404

950

678

346

816
832

240
470
832
348
348
470

350
241

470
350

870
242
740
400
352
640
760a
760b
950
902

352
404
354

404

358
360

364
470
470

243
362

470
470
366
368

244
400a
356
400b
404

416
460
372
372
870
746
400
247
764
1010
460
906
902
950
646

374
458
460

462
376
460

1014

470
378
460

832
248
380
470
460
249

550
257

552
510
500
510
258

520
510
530
500
530
510
520
554
259

520
510
500
510
520
550
256
652
550

500
510
510
520
520
556
260

262
550

510
500
510
261
558

556
263

564
265
264

560
267
562

554

266

268
560

1090
870
256
500
652
500
150
150
550
510
520
770
950
652

870
288
500a
186
186
500b
576
950
295
776b
294
293

289

290
776a
291

576
520
510
500
510
520
288

292

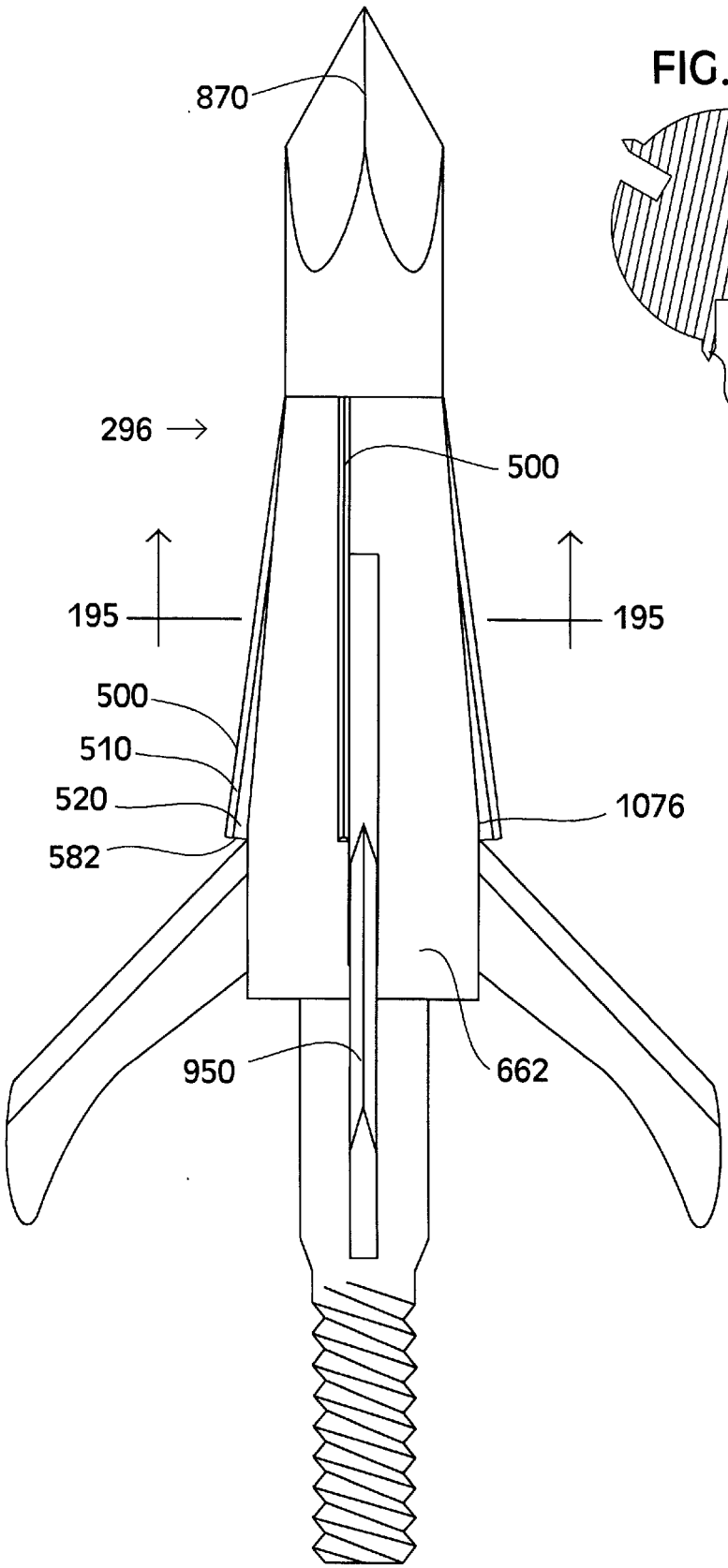
FIG. 194
FIG. 195
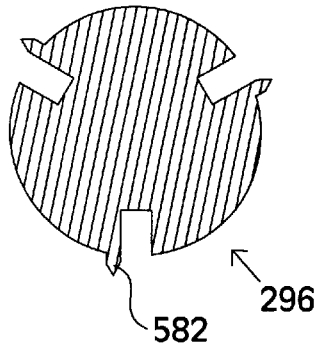

PENETRATION ENHANCING AERODYNAMICALLY FAVORABLE ARROWHEAD

This application is a Continuation-in-Part of my U.S. patent application Ser. No. 09/082,636, filed May 21, 1998, which is incorporated herein by specific reference.

BACKGROUND—FIELD OF THE INVENTION

This invention relates generally to arrowheads, and more particularly to aerodynamically favorable arrowheads such as pivotal blade arrowheads and blade-opening arrowheads that have a sharp cutting edge located upon their arrowhead bodies at a location forward of a corresponding main cutting blade cutting edge when in a penetrating configuration such that each arrowhead cuts target material in front of a corresponding main cutting blade when penetrating a target so as to eliminate the frictional drag that the otherwise dull arrowhead bodies would generate with the target before the main cutting blades began cutting target material thereinfront.

BACKGROUND—DESCRIPTION OF PRIOR ART

Arrows have long been used for war, hunting and competitive sports. A conventional arrow has a shaft, a nock at one end that receives the bow string, an arrowhead or point that attaches to the opposite end, and fletchings. The fletchings are glued to the shaft near the nock end, and help to stabilize the arrow in flight by causing it to rotate. Arrowheads generally have a pointed forward end, and an opposite threaded shaft end that attaches the arrowhead to the arrow shaft. Arrowheads are also attached to the forward end of arrow shafts by glueing and other methods.

Arrowheads come in a variety of different sizes and configurations depending on their intended use. For example, there are specifically designed arrowheads for competitive target shooting, shooting fish, hunting birds or small game animals, and for hunting big game animals.

Arrowheads used for hunting kill the game animal by cutting vital organs such as the lungs and vascular vessels such as arteries, which causes rapid hemorrhaging and/or suffocation. Quick and humane kills are dependent on accurate shot placement, and upon the amount or volume of the animal tissue that is cut. Hunting arrowheads that cut more tissue are more lethal, and therefore are better. The volume of tissue that is cut is determined by the cutting diameter of the arrowhead, the number of blades it contains, and by the distance the arrowhead penetrates into the animal. The cutting diameter of an arrowhead is determined by how far each cutting blade extends outward from the arrowhead body. The further the blades extend outward the larger the cutting diameter is, and therefore the more cutting potential the arrowhead has.

A common type of arrowhead used in hunting is the fixed-blade arrowhead, which has a pointed tip end used for penetrating, and generally triangular shaped fixed-blades or non-pivotal blades that each have a razor sharp edge for cutting. Conventional fixed-blade arrowheads blades are held in a fixed position on the arrowhead, and most such blades are replaceable. The replaceable blades attach to the arrowhead body in longitudinal grooves called blade slots. The tip of the arrowhead may be separably attachable to the arrowhead body or may be integral with it. Arrowheads for hunting are generally known as broadheads.

Another popular type of arrowhead for hunting is the blade-opening arrowhead. Blade-opening arrowheads are generally known as mechanical broadheads. Blade-opening arrowheads, like conventional fixed-blade arrowheads generally have an elongate arrowhead body, a tip end, and a threaded opposite end. The blades of blade-opening arrowheads have an attachment end which attaches the blades to the arrowhead body by a pivot pin, so that the blades can pivot or rotate in a plane between a closed position and an open position. Blade-opening arrowhead blades are generally an elongate substantially rectangular shape and also have a free non-attached end situated opposite the attachment end. The blades of blade-opening arrowheads are also received in blade slots, which are machined or formed into the side of the arrowhead body. When the pivotal blades of blade-opening arrowheads are retracted or folded into the closed position, a substantial majority of each blade is generally housed within its corresponding blade slot. This feature gives blade-opening arrowheads the ability to attain significantly increased aerodynamic performance over fixed-blade arrowheads, due to the significantly decreased exposure the retracted blades have with the air when the arrow is rotating while in flight. Such increased aerodynamic performance results in the desirable features of: faster shooting arrows, flatter arrow trajectories, increased penetration energy and enhanced repeatability of accuracy, while also providing a wide diameter cut in the game animal when the razor sharp blades open at impact with the animal.

Yet another type of arrowhead used for hunting has pivotal blades that are exposed at a full cutting diameter position while the arrowhead is in-flight. Such arrowheads also generally achieve better aerodynamic performance than fixed-blade arrowheads because by design each pivotal blade only attaches to a corresponding arrowhead body at a single location which therefore with the substantially elongate rectangular shaped blades provides arrowheads having significantly decreased blade surface area exposure with the air while the arrow is in-flight.

It is desirable for an arrowhead to penetrate as deep in the game animal as possible for maximum lethality. The less friction or drag the arrowhead generates or experiences while penetrating a target the further it will penetrate therethrough. The razor sharp cutting edges of arrowheads blades greatly reduce arrowhead penetration friction by slicing with their keen edges. A major problem associated with conventional pivotal blade arrowheads such as blade-opening arrowheads is that when in a penetrating or open position such arrowheads do not have a sharp cutting edge exposed from their arrowhead bodies for a considerable amount of their length rearward of the forward leading tip end thereof This creates a significantly dull forward section of an arrowhead body, which therefore must be pushed or wedged into the target the distance from the leading tip end of the respective arrowhead to the cutting blade before the arrowhead does any cutting. Such a design generates an enormous amount of friction between the dull arrowhead body and target material which unnecessarily and quickly depletes kinetic energy that could of otherwise aided in further target penetration and therefore enhanced lethality.

It is apparent that there is a need for a pivotal blade arrowhead such as a blade-opening arrowhead that when in an penetrating position has a sharp cutting edge exposed at a location forward of the pivotal blade cutting edge so as to slice or cut target material ahead of the pivotal blade and to therefore reduce the friction and drag of the arrowhead while penetrating a target such that both penetration and lethality are maximized.

SUMMARY OF THE INVENTION

It is an object of the present invention to provide an aerodynamically favorable arrowhead such as a pivotal blade arrowhead that when in a penetrating configuration has at least a section of a sharp cutting edge exposed at a location forward of a main blade cutting edge so as to slice or cut target material ahead of the main cutting blade and to therefore reduce the friction and drag of the arrowhead while penetrating a target such that both penetration and lethality are maximized.

It is another object of the present invention to provide an aerodynamically favorable blade-opening arrowhead that when in a penetrating configuration has at least a section of a sharp cutting edge exposed at a location forward of the pivotal blade cutting edge so as to slice or cut target material ahead of the pivotal blade and to therefore reduce the friction and drag of the arrowhead while penetrating a target such that both penetration and lethality are maximized.

It is still another object of the present invention to provide an aerodynamically favorable arrowhead having a pivotal blade and a fixed-blade such that when in a penetrating configuration at least a section of the sharp cutting edge of the fixed-blade is exposed at a location forward of the pivotal blade cutting edge so as to slice or cut target material ahead of the pivotal blade and to therefore reduce the friction and drag of the arrowhead while penetrating a target such that both penetration and lethality are maximized.

It is yet still another object of the present invention to provide an arrowhead having a pivotal blade and an integral cutting protrusion with a sharp cutting edge exposed thereon such that when in a penetrating configuration at least a section of the sharp cutting edge of the integral cutting protrusion is situated forward of the pivotal blade cutting edge so as to slice or cut target material ahead of the pivotal blade and to therefore reduce the friction and drag of the arrowhead while penetrating a target such that both penetration and lethality are maximized. It is yet still further another object of the present invention to provide an aerodynamically favorable arrowhead such as a pivotal blade arrowhead that when in a penetrating configuration has an arrowhead body with at least a section of a sharp cutting edge exposed therefrom so as to be located forward of a main blade cutting edge and to slice or cut target material ahead of the main cutting blade and to therefore reduce the friction and drag of the arrowhead while penetrating a target such that both penetration and lethality are maximized.

The foregoing objects and advantages and other objects and advantages of the present invention are accomplished as according to some of the preferred embodiments of this invention with hunting arrowheads that attach to the forward end of an arrow shaft, where a plurality of blades are pivotally connected to an arrowhead body. When the blades are in a penetrating configuration a plurality of razor sharp cutting edges are exposed at a location upon corresponding arrowhead bodies forward of the pivotal blade cutting edges so as to slice or cut target material ahead of the pivotal blades and to therefore reduce the friction and drag of the arrowhead while penetrating a target such that both penetration and lethality are maximized.

Such an arrowhead as according to one preferred embodiment of this invention is a blade-opening arrowhead that has a fixed-blade removably attachable with its arrowhead body, such that when attached thereto at least a section of the cutting edge of the fixed-blade is situated forward of the cutting edge of a corresponding pivotal blade when the arrowhead is in a penetrating configuration. When the arrowhead is in an in-flight configuration the furthest perpendicular distance from the central longitudinal axis of the arrowhead body to the cutting edge of the fixed-blade is less than the perpendicular distance from the central longitudinal axis of the arrowhead body to the furthest section of the pivotal blade from the central longitudinal axis. Such an arrowhead provides the excellent favorable aerodynamics inherent with blade-opening arrowheads while providing greatly enhanced penetration over conventional blade-opening arrowheads by cutting target material ahead of the pivotal cutting blades and thereby reducing the friction and drag that otherwise would of been generated between the arrowhead body and the target material.

Some arrowhead preferred embodiments as according to this invention having fixed-blades exposed from corresponding arrowhead bodies have substantially flat or planar fixed-blades while other such preferred arrowhead embodiments as according to this invention have fixed-blades with bent portions which aid in their attachment or securement to corresponding arrowhead bodies. Some arrowhead preferred embodiments as according to this invention having fixed-blades exposed from corresponding arrowhead bodies have substantially removably attachable fixed-blades whereas other such preferred arrowhead embodiments as according to this invention have fixed-blades integral with corresponding arrowhead bodies that are substantially non-removably attached by welding or other similar techniques to their corresponding arrowhead bodies.

Other arrowhead preferred embodiments as according to this invention having at least a section of a cutting edge exposed from corresponding arrowhead bodies at a location forward of the cutting edge of a corresponding main cutting blade when the arrowhead is in a penetrating configuration have at least a linear section of each such cutting edge substantially in coplanar alignment with each other when the arrowhead is in a penetrating configuration whereas other preferred arrowhead embodiments as according to this invention do not.

Yet other arrowhead preferred embodiments as according to this invention have arrowhead bodies that each have at least one integral cutting protrusion formed therewith. Each integral cutting protrusion has a sharp cutting edge exposed thereon such that when the arrowhead is in a penetrating configuration at least a section of the integral cutting protrusion sharp cutting edge is situated forward of the main blade cutting edge. Such designs also provide arrowheads that slice or cut target material ahead of the pivotal blade and therefore reduce the friction and drag of the arrowhead while penetrating a target so as to be an improvement over the prior art.

Still other arrowhead preferred embodiments as according to this invention have pivotal blades that are exposed at a maximum cutting diameter when the arrowheads are in an in-flight configuration. Some such arrowheads are non-blade opening arrowheads whereas some such others are blade-opening arrowheads.

The arrowheads as according to the desired results and scope of this invention are more lethal than prior art conventional arrowheads in that they cut target material ahead of or in front of the arrowhead main cutting blades and therefore reduce the friction and drag of the arrowhead that otherwise would of been generated between the arrowhead body and the target material while penetrating a target such that both penetration and lethality are maximized.

As has been shown in the above discussion, the arrowheads according to this invention overcome deficiencies inherent in prior art arrowheads.

With the above objects and advantages in view, other objects and advantages of the invention will more readily appear as the nature of the invention is better understood, the invention is comprised in the novel construction, combination and assembly of parts hereinafter more fully described, illustrated, and claimed.

BRIEF DESCRIPTION OF THE DRAWINGS

FIG. 22 is a partial length partial sectioned side view of another arrowhead of this invention;

FIG. 23 is a top view of an annular ring as according to this invention;

FIG. 24 is a side view of an arrowhead cutting blade as according to this invention;

FIG. 25 is a partial length partial sectioned side view of another arrowhead of this invention;

FIG. 26 is a side view of a set screw as according to this invention;

FIG. 27 is a side view of a set screw as according to this invention;

FIG. 28 is a partial length partial sectioned side view of another arrowhead of this invention;

FIG. 29 is a side view of an arrowhead tip as according to this invention;

FIG. 30 is a side view of an arrowhead cutting blade and a set screw as according to this invention;

FIG. 31 is a side view of an arrowhead cutting blade as according to this invention;

FIG. 40 is a partial sectioned side view of an arrowhead as according to this invention;

FIG. 41 is a side view of a set screw as according to this invention;

FIG. 42 is a side view of a set screw as according to this invention;

FIG. 43 is a side view of an arrowhead cutting blade and a set screw as according to this invention;

FIG. 44 is a partial sectioned side view of an arrowhead as according to this invention;

FIG. 76 is a partial sectioned side view of an arrowhead as according to this invention;

FIGS. 77 & 78 are exploded partial section partial length side views of an arrowhead as according to this invention;

FIG. 79 is a cross-sectional view of the arrowhead as illustrated in FIG. 76;

FIG. 80 is a cross-sectional view of the arrowhead body of the arrowhead as illustrated in FIG. 76;

FIGS. 81 & 82 are a cross-sectional view and a side view of a cutting blade as according to this invention;

FIGS. 82–85 are cross-sectional views of other arrowheads as according to this invention;

FIG. 93 is a top view of an arrowhead as according to this invention;

FIG. 94 is a cross-sectional view of the arrowhead tip of the arrowhead as illustrated in FIG. 93;

FIG. 95 is a cross-sectional view of an arrowhead tip as according to this invention;

FIG. 96 is a top view of an arrowhead as according to this invention;

FIG. 97 is a cross-sectional view of the arrowhead tip of the arrowhead as illustrated in FIG. 96;

FIG. 98 is a top view of an arrowhead as according to this invention;

FIG. 99 is a cross-sectional view of the arrowhead tip of the arrowhead as illustrated in FIG. 98;

FIGS. 100–102 are top views of arrowheads as according to this invention;

FIGS. 103–105 are cross-sectional views of arrowhead tips as according to this invention;

FIGS. 142–149 are partial sectioned side views of arrowheads as according to this invention;

FIG. 150 is a cross-sectional view of the arrowhead as illustrated in FIG. 149;

FIGS. 151–162 are cross-sectional views of arrowheads as according to this invention;

FIG. 163 is a partial sectioned side view of an arrowhead as according to this invention;

FIG. 164 is a cross-sectional view of the arrowhead as illustrated in FIG. 163;

FIGS. 165–180 are cross-sectional views of arrowheads as according to this invention;

FIG. 181 is a partial sectioned side view of an arrowhead as according to this invention;

FIG. 182 is a cross-sectional view of the arrowhead as illustrated in FIG. 181;

FIG. 183 is a partial sectioned side view of an arrowhead as according to this invention;

FIG. 184 is a cross-sectional view of the arrowhead as illustrated in FIG. 183;

FIG. 185 is a partial sectioned side view of an arrowhead as according to this invention;

FIG. 186 is a cross-sectional view of the arrowhead as illustrated in FIG. 185;

FIGS. 187–193 are cross-sectional views of arrowheads as according to this invention;

FIG. 194 is a partial sectioned side view of an arrowhead as according to this invention; and FIG. 195 is a cross-sectional view of the arrowhead as illustrated in FIG. 194.

DETAILED DESCRIPTION OF THE PREFERRED EMBODIMENTS

Figures 1, 2, 3, 4, 5, 6, 7:
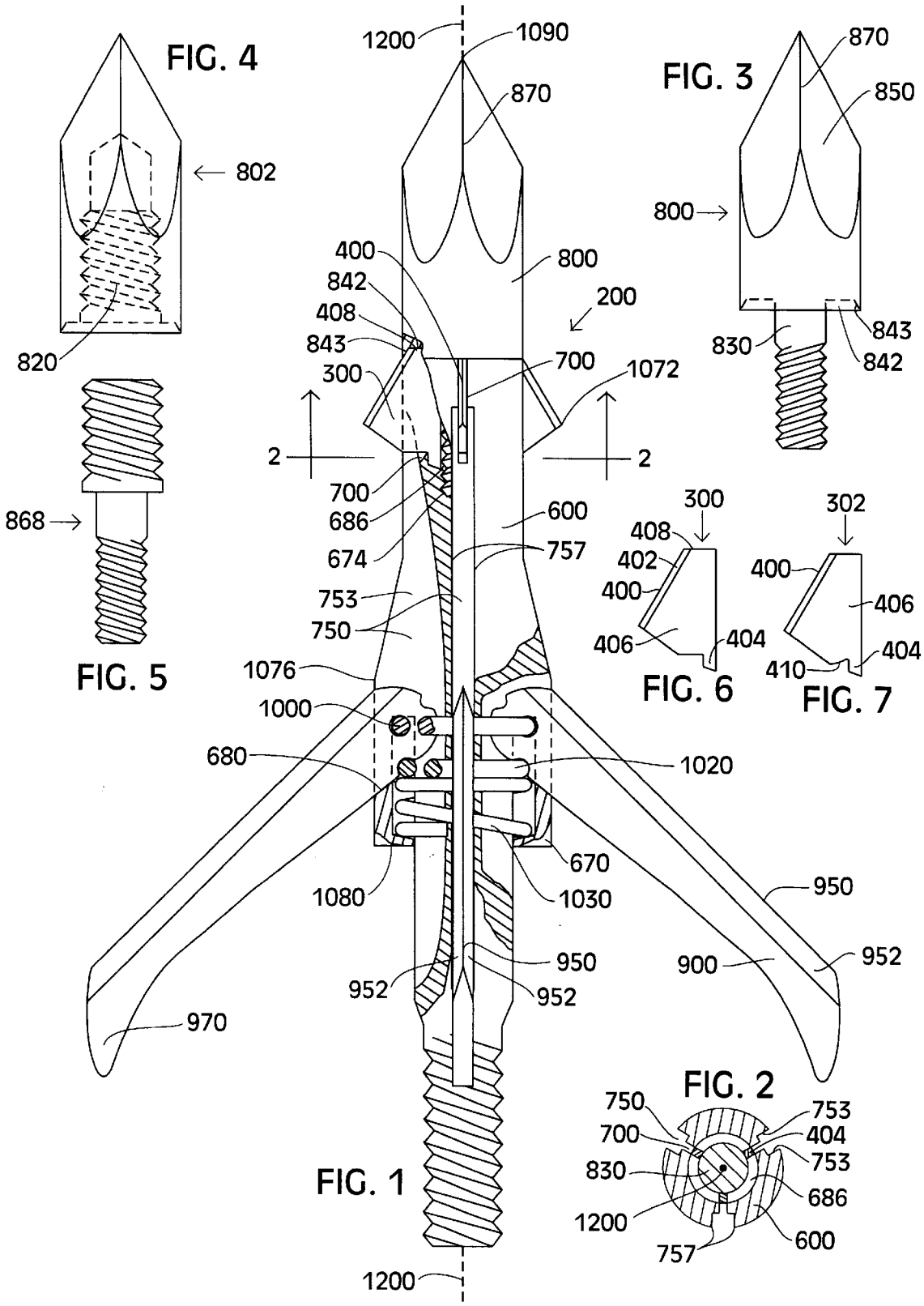
FIG. 1 is a partial sectioned side view of an arrowhead as according to this invention.
FIG. 2 is a cross-sectional view of the arrowhead as illustrated in FIG. 1.
FIG. 3 is a side view of an arrowhead tip as according to this invention.
FIG. 4 is a side view of another arrowhead tip as according to this invention.
FIG. 5 is a side view of an arrowhead tip coupler as according to this invention.
FIG. 6 is a side view of an arrowhead cutting blade as according to this invention.
FIG. 7 is a side view of an arrowhead cutting blade as according to this invention.

FIGS. 1–8 illustrate a blade-opening arrowhead 200 as according to one preferred embodiment of this invention. Arrowhead 200 has a forward leading end 1090, a plurality of three pivotal cutting blades 900 and a plurality of three fixed cutting blades 300. Each fixed cutting blade 300 has a cutting edge 400 that is substantially in coplanar alignment with a cutting edge 950 of a corresponding pivotal blade 900 when arrowhead 200 is in a penetrating configuration, as is illustrated in FIG. 1. As is also illustrated in FIG. 1 each cutting edge 400 is not in collinear orientation or alignment with a corresponding cutting edge 950 that it is coplanar with. Each cutting edge 950 has a pair of grind bevels 952 such as is first ground on cutting blades in a strip grinding process as is well known to those skilled in the art. It is apparent that grind bevels 952 may have hone bevels as well, such as substantially convex hone bevels as is attainable with frustuconical grinding wheels. As also illustrated in FIG. 1 cutting edges 400 of blades 300 are located rearward of leading forward end 1090 of arrowhead 200.

Arrowhead 200 has a removably attachable arrowhead tip 800 that has a plurality of three facets 850, and a plurality of three facet boundary cutting edges 870 each of which is also substantially in coplanar alignment with both a corresponding cutting edge 400 and a corresponding cutting edge 950 when arrowhead 200 is in a penetrating configuration. Arrowhead tip 800 is preferably a hollow ground trocar tip or chisel type bone-splitting tip as is well known in the industry. It is apparent that facets 850 may be substantially convex or flat. Although arrowhead tip 800 is depicted as having a greatest cross-sectional diameter that is not wider than the cross-sectional diameter of an arrowhead body 600 where the rear end of tip 800 abuts thereagainst when the arrowhead is assembled, it is apparent that the arrowhead tips as according to this invention may have greatest cross-sectional diameters that are wider than the cross-sectional diameter of an accompanying arrowhead body at which the rear end of such a tip abuts thereagainst or adjoins therewith. Such wider arrowhead tip greatest cross-sectional diameters may be found in a barrel section of the arrowhead tip and/or in a facet region thereof. It is apparent that such wider diameter or cross-sectional arrowhead tips may be integral with their corresponding arrowhead bodies.

Figure 8:
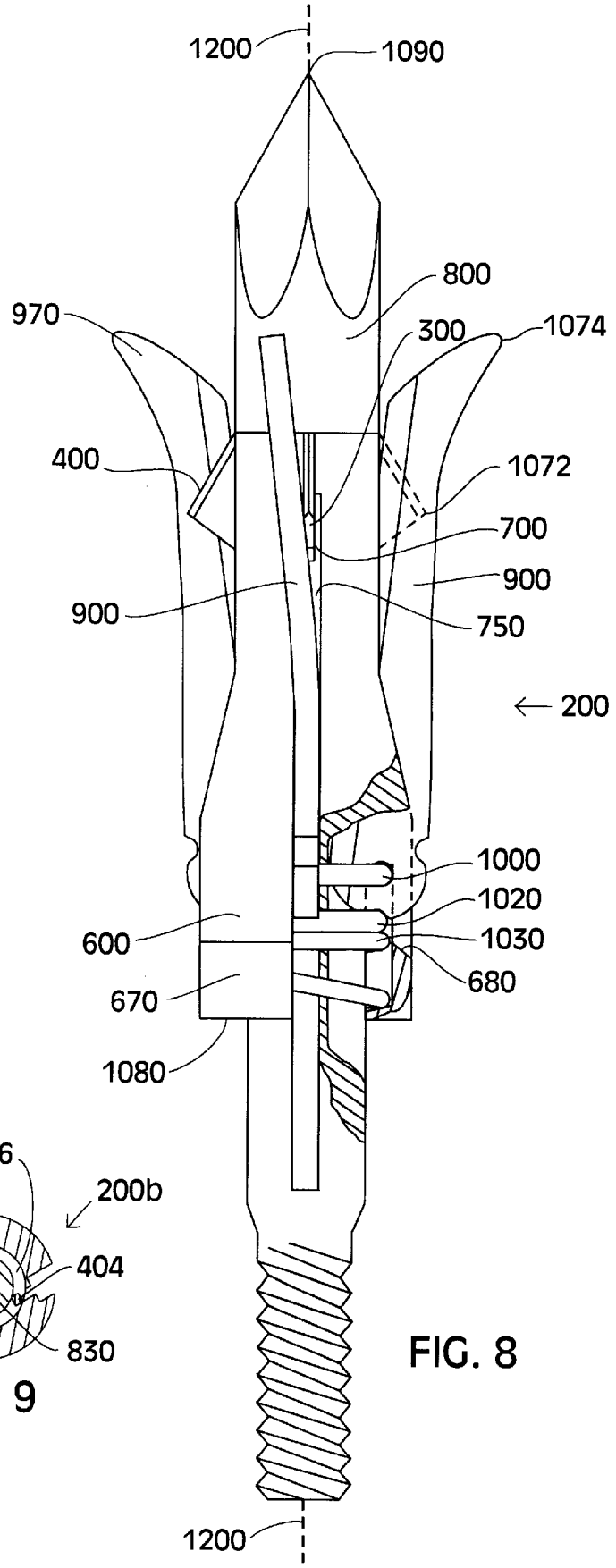
FIG. 8 is another partial sectioned side view of the arrowhead as according to this invention as illustrated in FIG. 1.

As is illustrated in FIG. 8 when arrowhead 200 is in an in-flight configuration a furthest section 1072 of each cutting edge 400 from a central longitudinal axis 1200 of arrowhead 200 is closer to central longitudinal axis 1200 than a furthest section 1074 of each pivotal blade 900. This provides for an aerodynamically favorable arrowhead as is according to the desired results of this invention. Furthermore, as is illustrated in FIG. 1 when pivotal blades 900 are in a fully open position such that arrowhead 200 is in a penetrating configuration, cutting edges 400 are located forward of cutting edges 950 such that cutting edges 400 will slice or cut target material in front of blades 900 which greatly reduces the frictional drag that otherwise would of been generated between arrowhead 200 and the target material or the object being penetrated, as is according to the desired results envisioned by this invention.

It is apparent that arrowheads as according to this invention of a necessity do not have to have furthest sections 1072 or equivalents of penetration enhancing forward leading cutting edges such as cutting edges 400 located at a distance closer to the central longitudinal axis of their corresponding arrowhead bodies than furthest sections 1074 or equivalents of each pivotal blade or main cutting blade when in an in-flight configuration to provide arrowheads having favorable flight aerodynamics and enhanced penetration characteristics as according to the desired results of this invention.

As is also illustrated in FIG. 1 section 1072 of each cutting edge 400 is further from central longitudinal axis 1200 of arrowhead 200 than a widest section 1076 of arrowhead body 600 that is located rearward of cutting edges 400. This provides an arrowhead that cuts target material in front of the main cutting blades at a cutting diameter that is wider than the arrowhead body's widest cross-sectional diameter, so as to immediately open a wide wound channel for the arrowhead body, main cutting blades and arrowshaft to effortlessly follow, as is within the scope of the desired results of this invention.

Arrowhead 200 has an arrowshaft contacting surface 1080 as is illustrated in FIG. 8 such that when arrowhead 200 or the other arrowheads as according to this invention are attached to an arrowshaft whether by screwing thereon or glueing or etc., arrowshaft contacting surface 1080 contacts the arrowshaft or equivalent such as an arrowshaft insert. As is clearly illustrated in FIGS. 1 & 8 the rearward most section 1072 of each cutting edge 400 is situated upon arrowhead 200 at a location closer to forward leading end 1090 than to arrowshaft contacting surface 1080. Each pivotal blade 900 has a wing 970 that extends therefrom in a direction outwardly from arrowhead body 600 when arrowhead 200 is in an in-flight or closed retracted configuration as is illustrated in FIG. 8. Wings 970 serve to increase the moment-arm for levering blades 900 from their folded-up closed position when beginning to rotate towards an open position.

It is apparent that arrowhead 200 or other arrowheads as according to this invention could be shot from an archery bow when in an open position such as is depicted in FIG. 1 so as to simultaneously achieve both the favorable aerodynamic and enhanced penetration desired results as according to this invention. Such performance objectives are achievable with an arrowhead similar to arrowhead 200 since pivotal blades 900 have a relatively minor exposed surface area when in an open configuration, as compared to that of conventional fixed-blade arrowhead blades. Thus when shot in an open position such pivotal blade arrowheads as according to this invention would have accurate and favorable flight characteristics like unto other non blade-opening pivotal blade arrowheads, as is known to those skilled in the art, while also achieving improved penetration over prior art conventional arrowheads.

Although not specifically illustrated in this specification, it is apparent that the various elements, designs and functional objective results of the arrowheads as according to this invention and of those arrowheads incorporated herein by specific reference are applicable to blade-opening arrowheads whose blades rotate in a forward direction—toward the forward leading end of the arrowhead—when rotating to an open position or a penetrating configuration upon impact of a target or application of an opening force. For example, such arrowheads as that which have plunger shafts, wedging cams and/or other components that have movement in an axial or elongate direction relative to an accompanying arrowshaft, or other arrowhead components whether attached directly to a cutting blade or not, are within the scope of the arrowheads as according to this invention. As a specific example, a wedge cam with a tip end exposed from an accompanying arrowhead body when such an arrowhead is in a penetrating configuration could have a cutting blade or cutting edge such as cutting edge 400 thereon so as to cut target material in front of a main arrowhead cutting blade and to therefore achieve the increased penetration and reduced frictional drag desired results of this invention.

FIGS. 1–3 & 6 illustrate in detail how fixed-blades 300 are removably attached to arrowhead 200. Arrowhead body 600 of arrowhead 200 has a blade slot 750 for each pivotal blade 900, a blade slot 700 for each fixed-blade 300, an internal leg cavity 686, an internal threaded cylinder or bore 674 and a washer 670. Each fixed-blade 300 has a pair of grind bevels 402—402 (which may also comprise hone bevels as is know to those skilled art), a pair of opposing substantially parallel side surfaces or faces 406, a leg 404 and a forward locking end 408. In addition to facets 850 arrowhead tip 800 has a shaft 830, an undercut locking surface 843 and an undercut locking cavity 842. Each fixed-blade 300 is placed in its corresponding slot 700 such that when arrowhead tip 800 is screwed into arrowhead body 600 locking ends 408 of blades 300 seat into undercut locking cavity 842 and abut against undercut locking surface 843 and against shaft 830 of arrowhead tip 800 which firmly attaches blades 300 to arrowhead 200.

It is apparent that the method and/or manners of attaching or providing a friction reducing forward leading cutting edge or a penetration enhancing cutting edge such as a cutting edge 400 to or with the arrowheads of this invention is of relatively minor importance to the scope of this invention. As will become apparent from this specification and its parent patent application incorporated herein by specific reference there are many and various suitable manners to provide a cutting edge that is configured such upon its corresponding arrowhead body so as to cut target material in front of a main arrowhead cutting blade such as a pivotal blade of a blade-opening arrowhead so as to achieve the increased penetration and reduced frictional drag desired results of this invention. Therefore, it is apparent that any method or the like for providing an arrowhead with a cutting edge that achieves the objectives and desired results of this invention is within the scope of this invention.

As illustrated in FIG. 1 arrowhead 200 has an annular blade ring 1000 which hingedly or pivotally connects each blade 900 to arrowhead body 600, an annular notch ring 1020 and an annular compression spring 1030. Annular compression spring 1030 urges annular ring 1020 into a second notch of each blade 900 when arrowhead 200 is in an open or penetrating configuration such as FIG. 1 depicts. Whereas, as illustrated in FIG. 8 annular compression spring 1030 urges annular ring 1020 into a first notch of each blade 900 when arrowhead 200 is in an in-flight or retracted configuration so as to retain each blade 900 in such position until acted upon by an opening force.

The arrowheads according to this invention having pivotal blades may be blade-opening arrowheads which are commonly known in the industry as mechanical broadheads, or may be non blade-opening arrowheads. It is apparent that the method of selectively retaining a pivotal blade of a blade-opening arrowhead in a closed or in-flight retracted position is of relatively minor significance to this invention. For example, as illustrated in FIG. 8 each blade 900 is biasedly flexed or camed against a corresponding fixed-blade 300 when arrowhead 200 is in a closed or in-flight configuration. This flexing could be used at least in part to selectively hold or retain pivotal blades 900 or other pivotal blades in a retracted or closed in-flight position or configuration.

As is particularly illustrated in FIGS. 1 & 8 washer 670 has a blade stop abutting surface 680 which serves to limit the rotation of blades 900 when expanded to the open position or penetrating configuration so as to define the cutting diameter of the arrowhead. It is apparent that the arrowheads as according this invention may have varying types of blade stop structures such as washer 670 which serve to provide the functions of limiting the rotation of corresponding pivotal blades by abutting thereagainst, lessening the impact forces delivered to the hinge pin(s) and preventing undesirable damage to accompanying arrowshafts and/or other arrowhead structures. For example, the pivotal blades as according to this invention may abut against integrally attached or formed sections of corresponding arrowhead bodies, substantially flat blade stop washers or recessed blade stop washers like unto washer 670. Preferably the blade stop washers or equivalents as according to this invention are hardened sufficiently such as by caborizing, case hardening or other heat treating or hardening techniques so as to not substantially be damaged by the impacting blades during target penetration, such as when the blades collide with heavy bone of a large game animal.

FIG. 7 illustrates a fixed-blade 302 which is similar to fixed-blade 300 except blade 302 has a curved section 410 that fits snugly with the curvature of slots 700. As is illustrated in FIG. 5 an arrowhead tip 802 with a threaded female cavity 820 could be used in place of tip 800 by the addition of an arrowhead tip coupler 868.

As is best illustrated in FIG. 2 slots 700 are narrower than slots 750 and a slot 700 and a corresponding adjacent slot 750 are both substantially radially aligned with central longitudinal axis 1200 of arrowhead 200, and are in parallel alignment with each other, such that an elongate line parallel to central longitudinal axis 1200 simultaneously intersects both a slot 700 and its corresponding paired or adjacent slot 750 as is according to the desired results of some of the preferred arrowhead embodiments of this invention. Each blade slot 750 of arrowhead 200 has a pair of partially bounding opposing sidewalls 753 that each extend to an exposed exterior corner 757 at the conjunction of sidewalls 753 with the exterior surface of arrowhead body 600 as is illustrated in FIGS. 1 & 2. As according to this invention a blade slot generally includes its bounding sidewalls.

Figure 9:
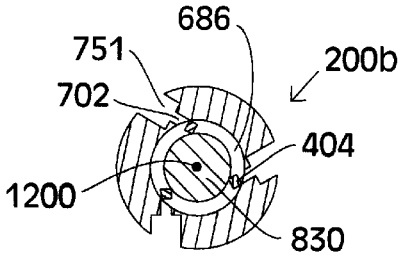
FIG. 9 is a cross-sectional view of another arrowhead as according to this invention.

FIG. 9 illustrates an arrowhead 200*b* which is similar to arrowhead 200 except that arrowhead 200*b* has a plurality of slots 751 for pivotal blades 900 to be received therein which are non-radially aligned with respect to central longitudinal axis 1200 and a plurality of similarly non-radially aligned slots 702 for fixed-blades 300 to be received therein. It is apparent that there are various manners for the blade slots as according to this invention to be configured upon their corresponding arrowhead bodies such as to provide arrowheads that perform within the scope of this invention.

Figures 10, 11, 12, 13:
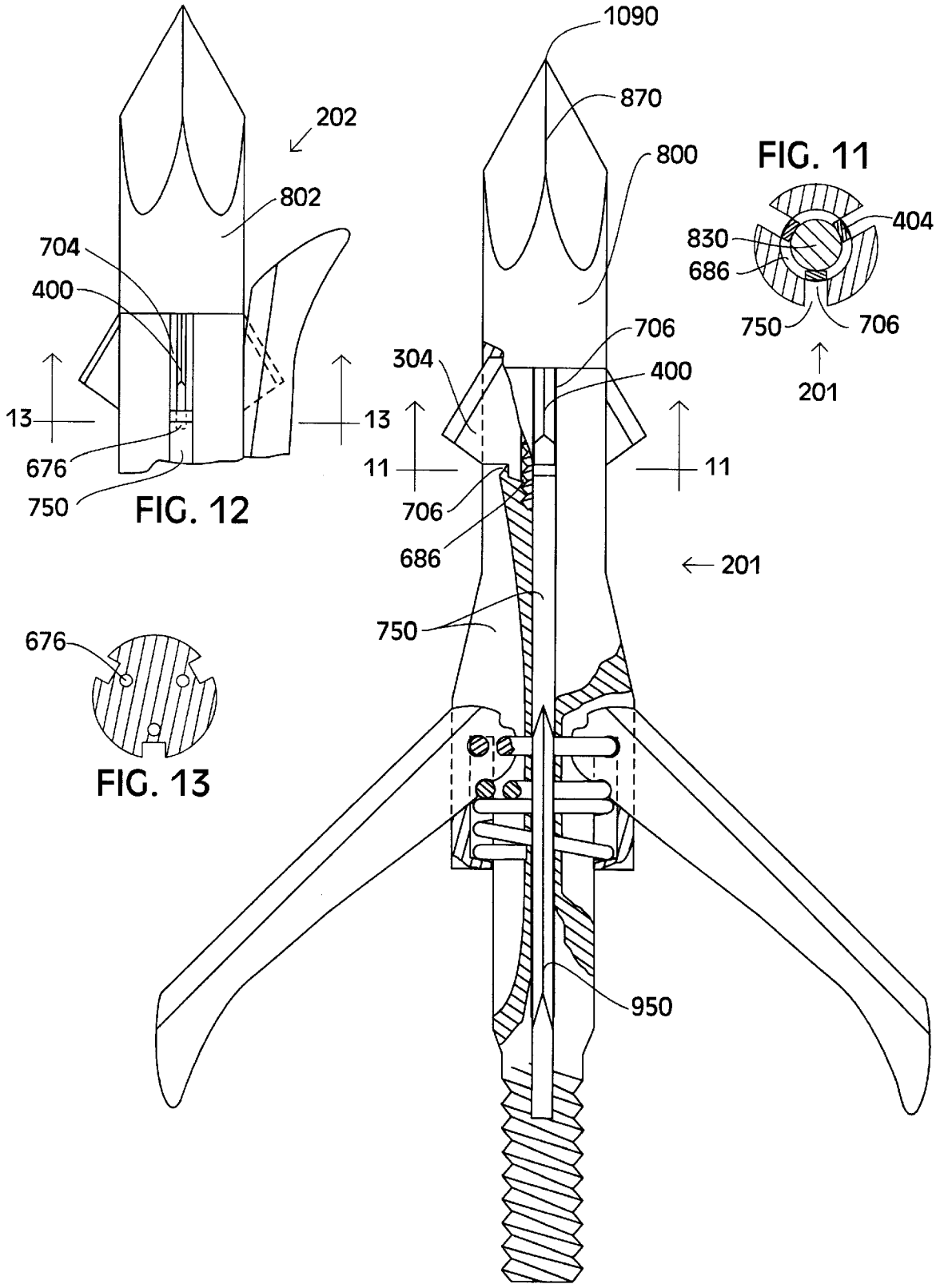
FIG. 10 is a partial sectioned side view of an arrowhead as according to this invention.
FIG. 11 is a cross-sectional view of the arrowhead as illustrated in FIG. 10.
FIG. 12 is a partial length side view of another arrowhead as according to this invention.
FIG. 13 is a cross-sectional view of the arrowhead body of the arrowhead as illustrated in FIG. 12.

For example, FIGS. 10 & 11 illustrate an arrowhead 201 that is similar to arrowhead 200 except arrowhead 201 has a plurality of blade slots 706 for removably receiving a plurality of fixed-blades 304 that are each substantially the same thickness of a pivotal blade 900. Each blade slot 706 is substantially a part of a corresponding slot 750 since slots 706 & 750 communicate with each other, wherein a slot 706 and a slot 750 could be fabricated from the same circular slitting saw by two-dimensional plunge slotting procedures.

FIGS. 12 & 13 illustrate an arrowhead 202 that is similar to arrowhead 200 except arrowhead 202 has a female cavity screw on arrowhead tip 802 as is clearly illustrated in FIG. 4, a plurality of fixed-blade slots 704 and a plurality of hollow cylinders 676 (as is best seen in the cross-sectional view of the arrowhead body thereof in FIG. 13) for receiving legs 404 of accompanying fixed-blades therein. It is apparent that the various structural variations that produce blades slots such as blade slots housing forward leading penetration enhancing fixed blades as according to this invention or their equivalents may be combined in various different manners one amongst another including in combinations that are not necessarily depicted in this specification so as to obtain the desired results of this invention.

Figure 14:
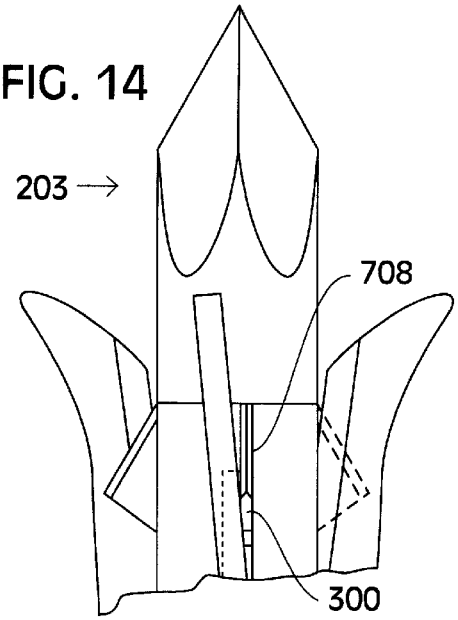
FIG. 14 is a partial length side view of another arrowhead as according to this invention.
Figure 15:
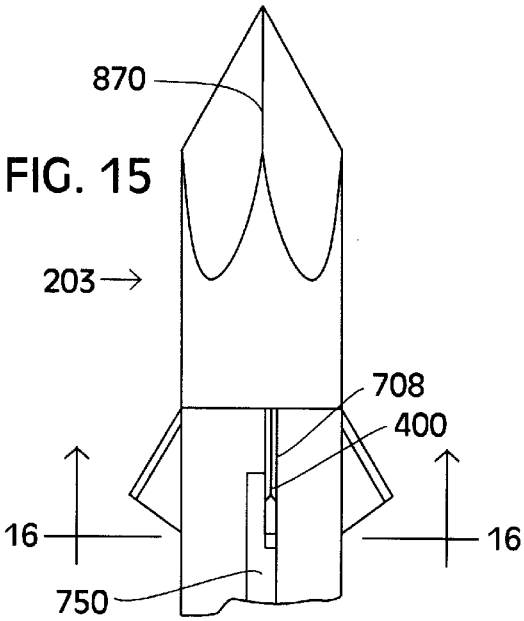
FIG. 15 is another partial length side view of the arrowhead as illustrated in FIG. 14.
Figure 16:
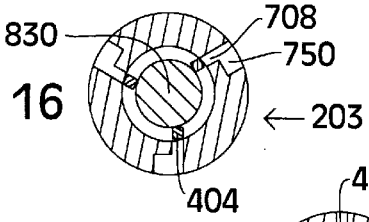
FIG. 16 is a cross-sectional view of the arrowhead as illustrated in FIG. 15.

FIGS. 14–16 illustrate an arrowhead 203 that is similar to arrowhead 200 except arrowhead 203 has a plurality of fixed-blade slots 708 that are contained or situated within corresponding adjoining slots 750 such that each slot 708 is substantially non-equidistantly displaced from opposing elongate sidewalls of its corresponding slot 750. As is illustrated in FIG. 16 each slot 708 and corresponding slot 750 are parallely aligned with each other such that slots 750 are radially aligned with the central longitudinal axis of arrowhead 203 but slots 708 are non-radially aligned therewith.

Radial alignment in contrast to non-radial alignment generally refers to the geometric orientation or positioning of an element with respect to a radial line extending outward from a central longitudinal axis of a reference object such as an arrowhead body or an arrowhead. With reference to blade slots, a plane parallel to opposing sidewalls of a corresponding blade slot that is equidistantly displaced between such sidewalls such that the plane is substantially in coplanar alignment with the central longitudinal axis of an accompanying arrowhead generally constitutes a radially aligned blade slot, whereas such a plane that is not substantially in coplanar alignment with the central longitudinal axis of an accompanying arrowhead generally constitutes a non-radially aligned blade slot. It is apparent that such definition is allowed to fluctuate within the realm of attainable manufacturing tolerances so that the intent of the arrowhead design should generally dictate radial versus non-radial orientations thereof.

Figure 17:
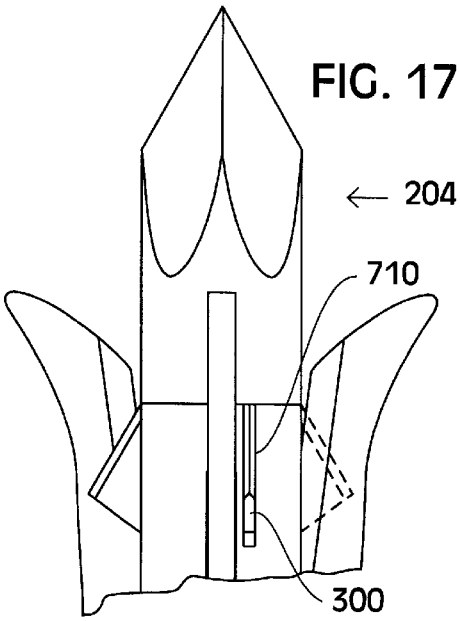
FIG. 17 is a partial length side view of another arrowhead as according to this invention.
Figure 18:
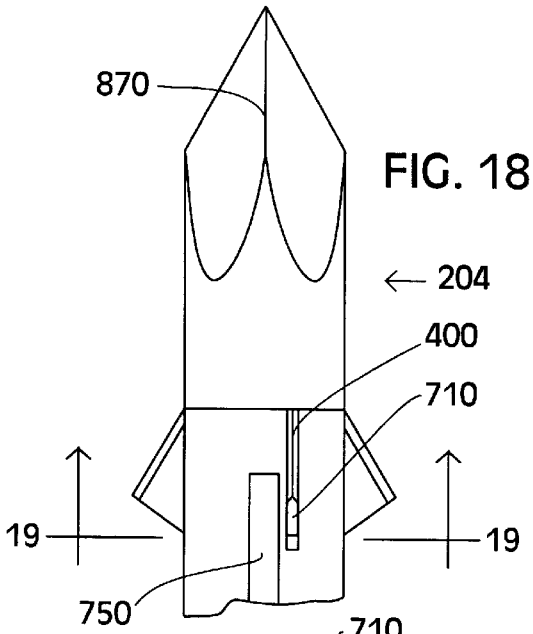
FIG. 18 is another partial length side view of the arrowhead as illustrated in FIG. 17.
Figure 19:
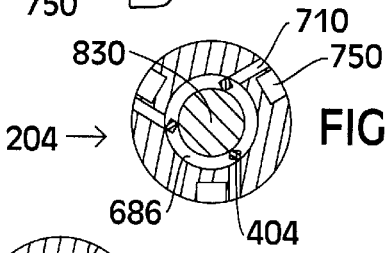
FIG. 19 is a cross-sectional view of the arrowhead as illustrated in FIG. 18.

FIGS. 17–19 illustrate an arrowhead 204 that is similar to arrowhead 200 except arrowhead 204 has a plurality of fixed-blade slots 710 such that each fixed-blade slot 710 is situated at a distance spaced apart from its corresponding adjacent slot 750. As is illustrated in FIG. 19 each slot 710 and corresponding adjacent slot 750 are parallely aligned with each other such that slots 750 are radially aligned with the central longitudinal axis of arrowhead 204 but slots 710 are non-radially aligned therewith.

Figure 21:
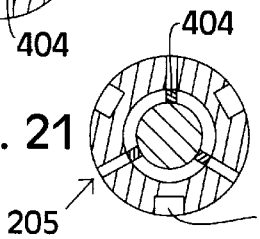
FIGS. 20 & 21 are cross-sectional views of other arrowheads as according to this invention.
Figure 20:
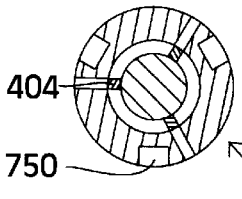

FIGS. 20 & 21 illustrate an arrowhead 205 and an arrowhead 206 which are similar to arrowhead 200 except that both arrowheads 205 and 206 have fixed-blade slots that are spaced apart from corresponding adjacent main cutting blade slots 750 such that their fixed-blade slots are radially aligned with corresponding arrowhead central longitudinal axises and their fixed-blade slots are not in parallel alignment with corresponding adjacent slots 750.

FIGS. 22–24 illustrate an arrowhead 207 which is similar to arrowhead 204 except that arrowhead 207 has a plurality of fixed-blades 306 attached to an arrowhead body 608 having an externally exposed annular recess 782 formed thereon for removably receiving an annular ring 1050 which aids in the securement of blades 306 to arrowhead body 608. Externally exposed annular recess 782 comprises a lip 784 which aids in maintaining annular ring 1050 attached to arrowhead body 608 so as to perform its function. It is apparent that annular ring 1050 could be either compressed to a narrower diameter or expanded to a wider diameter when seated in recess 782 as compared to its non-attached or free diameter.

FIGS. 25–27 illustrate an arrowhead 208 which is similar to arrowhead 207 except that arrowhead 208 utilizes a plurality of partially threaded set screws 1004 that each screw into a through hole 786*a* in an arrowhead body 610 which aids in the securement of blades 300 to arrowhead body 610. As is illustrated in FIG. 27 it is apparent that a fully threaded set screw 1002 could be used in place of set screw 1004.

FIGS. 28–30 illustrate an arrowhead 209 which has an arrowhead body 612, a female arrowhead tip 802 and a plurality of fixed-blades 308 each having an aperture 450 sized so as to removable receive a set screw such as set screw 1004 therein. Arrowhead body 612 has a threaded through hole for receiving each set screw 1004 which attaches blades 308 to arrowhead 209 each within a blade slot 716. As is illustrated in FIG. 31 from a fixed-blade 310 with a forward locking end 416 it is apparent that the forward locking ends of the fixed-blades as according to this invention may have any shape such that enables them to be secured to their corresponding arrowhead tips or arrowhead bodies or equivalents.

Figures 32, 33, 34, 35, 36, 37, 38, 39:
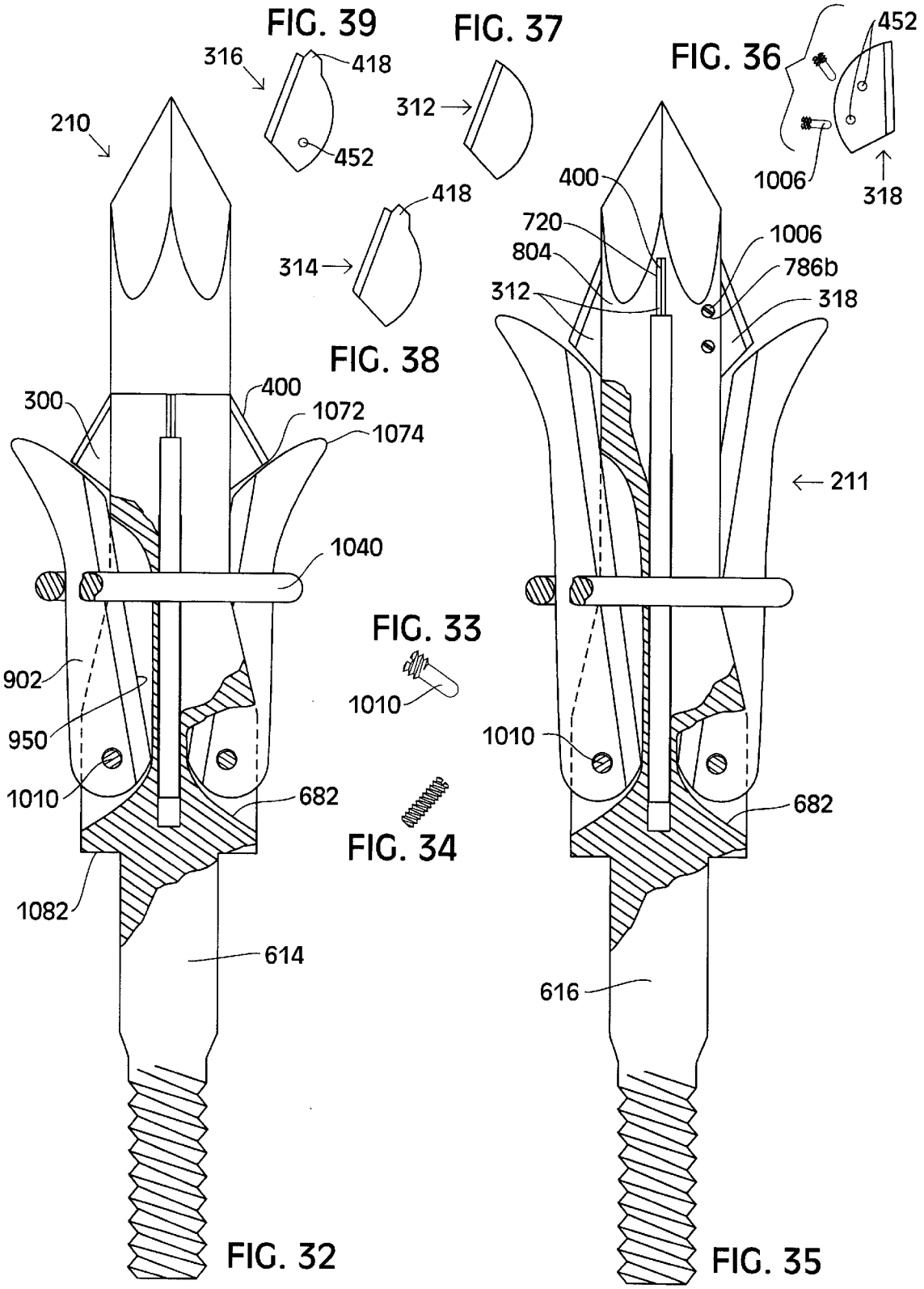
FIG. 32 is a partial sectioned side view of an arrowhead as according to this invention.
FIG. 33 is a side view of a set screw as according to this invention.
FIG. 34 is a side view of a set screw as according to this invention.
FIG. 35 is a partial sectioned side view of an arrowhead as according to this invention.
FIG. 36 is a side view of an arrowhead cutting blade and set screws as according to this invention.
FIG. 37 is a side view of an arrowhead cutting blade as according to this invention.
FIG. 38 is a side view of an arrowhead cutting blade as according to this invention.
FIG. 39 is a side view of an arrowhead cutting blade as according to this invention.

FIGS. 32–34 illustrate an arrowhead 210 which is similar to arrowhead 200 except that arrowhead 210 utilizes a plurality of partially threaded set screws 1010 for pivotally connecting a plurality of three pivotal blades 902 to an arrowhead body 614, and a conventional rubber O-ring 1040 for selectively retaining blades 902 in an in-flight configuration until acted upon by an opening force. Blades 902 are of a length such that each cutting edge 950 thereof is displaced rearward of its corresponding adjacent fixed-blade 300 such that blades 902 and blades 300 do not biasly flex against each other when the arrowhead is in an in-flight configuration as is illustrated in FIG. 32. Arrowhead body 614 has an arrowshaft contacting surface 1082 that is integral or substantially non-removably attached with arrowhead body 614 and a blade stop abutting surface 682 for each blade 902. Blade stop abutting surfaces 682 are also integral with arrowhead body 614.

It is apparent that the arrowhead tips of the arrowheads as according to this invention may be removable attachable from their corresponding arrowhead bodies such as having internal female threaded bores or externally protruding threaded male studs. It is apparent that the arrowhead tips of the arrowheads as according to this invention may be substantially non-removably attached to corresponding arrowhead bodies such as being frictionally press-fitted thereon, welded or glued on. It is also apparent that the arrowhead tips of the arrowheads as according to this invention may be substantially integrally formed with their corresponding arrowhead bodies, such as substantially being a machined or milled forward extending section of an accompanying arrowhead body that for example, is fabricated from a single piece of metal stock.

FIGS. 35–37 illustrate an arrowhead 211 which has an arrowhead tip 804 integrally formed with an arrowhead body 616. Arrowhead 211 has a plurality of three fixed-blade slots 720 formed thereon, a pair of fixed-blades 312 which are substantially non-removably attached thereto by welding or other similar result producing techniques, and a fixed-blade 318 attached thereto by a pair of set screws 1006 removably received through a pair of apertures 452 when threaded into a pair of through holes 786*b* formed in arrowhead 211. FIGS. 38 & 39 illustrate fixed-blades 314 & 316 which are at least in part similar to blades 312 & 318 and as is also their methods of attachment to corresponding arrowhead bodies, except that blades 314 & 316 have forward locking protrusions 418 projecting forwardly therefrom. It is apparent that a void such as a milled out hollow cylinder could be formed communicatingly with each slot 720 so as to matingly receive forward locking protrusions 418 when blades 314 & 316 or other similar blade designs having forward locking protrusions or equivalents as according to this invention are attached with accompanying arrowhead bodies or arrowhead tips, particularly with arrowheads having arrowhead tips substantially integrally formed with their corresponding arrowhead bodies or other arrowhead structure such as has arrowhead 211.

FIGS. 40–44 illustrate an arrowhead 212 and an arrowhead 213 both of which utilize a plurality of pivotal blades 320 to provide friction reducing forward leading cutting edges 400 as according to the penetration enhancement desired results of this invention. Each blade 320 is pivotally connected to corresponding arrowhead bodies by a hinge pin 1008 within corresponding slots (a plurality of slots 722 of arrowhead 212 and a plurality of slots 724 of arrowhead 213) as has been illustrated herein with forgoing preferred embodiments.

Figure 46:
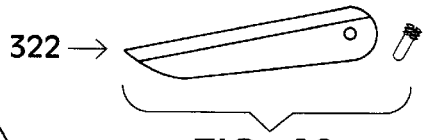
FIG. 46 is a side view of an arrowhead cutting blade and a set screw as according to this invention.
Figure 45:
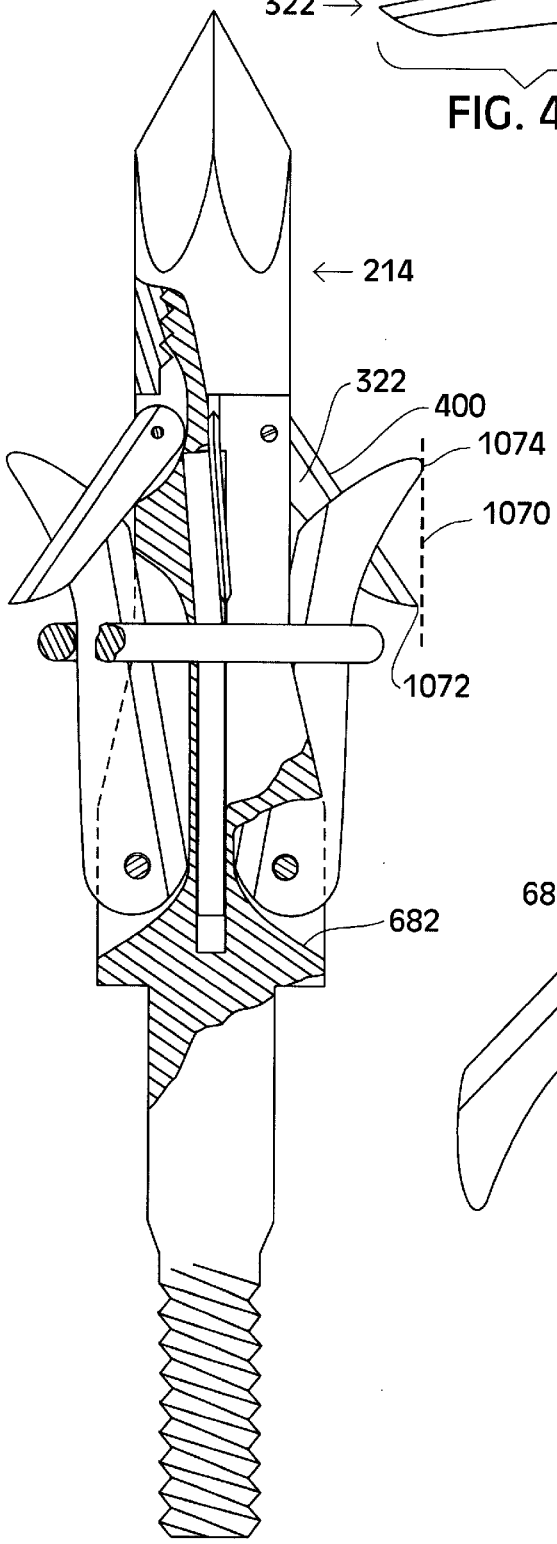
FIG. 45 is a partial sectioned side view of an arrowhead as according to this invention.
Figure 47:
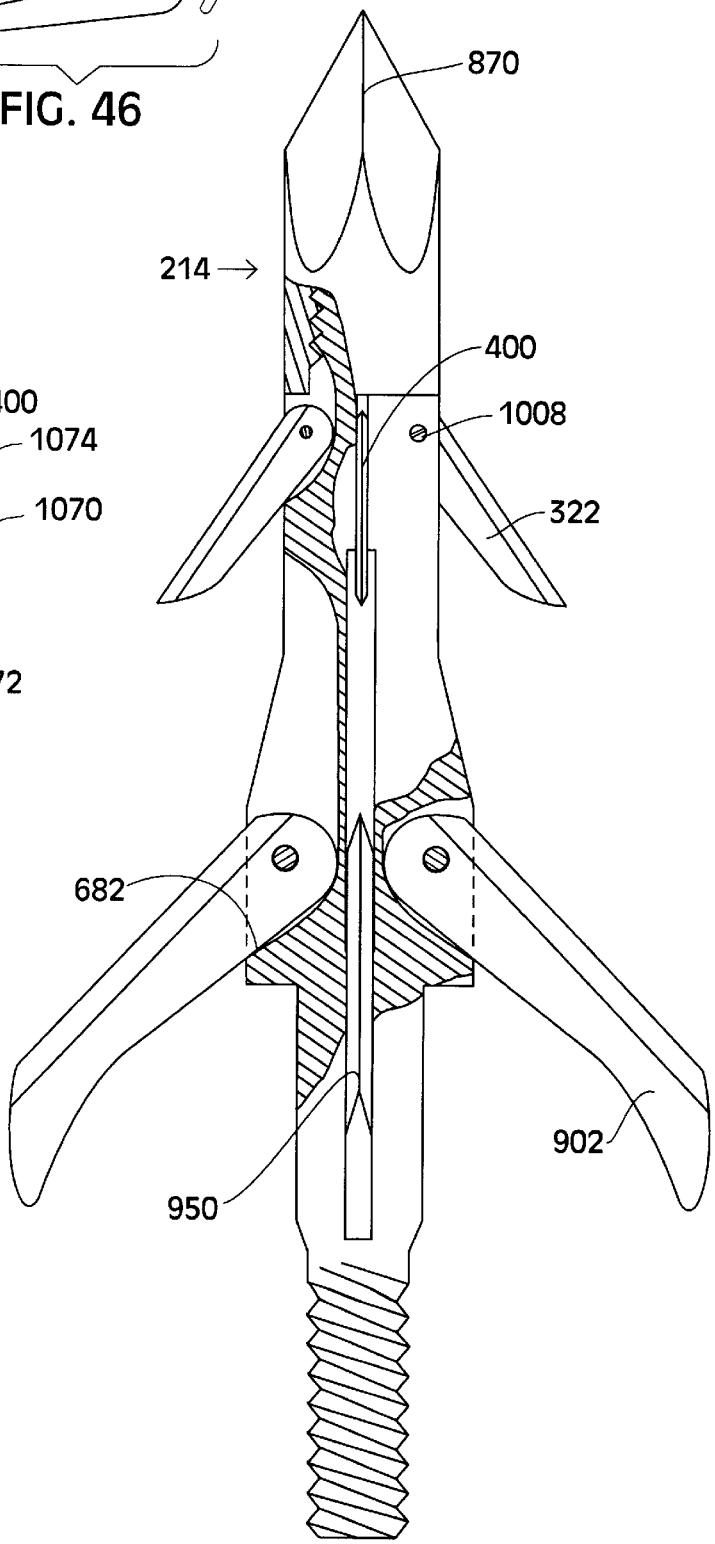
FIG. 47 is a partial sectioned side view of an arrowhead as according to this invention.

FIGS. 45–47 illustrate an arrowhead 214 which is similar to arrowhead 212 except that arrowhead 214 utilizes a plurality of pivotal blades 322 to provide friction reducing forward leading cutting edges 400 for penetration enhancement. As is illustrated in FIG. 45 by aid of a line 1070 which is parallel to the central longitudinal axis of arrowhead 214, when arrowhead 214 is in an in-flight configuration furthest section 1072 of each cutting edge 400 from the central longitudinal axis of arrowhead 214 is closer to the central longitudinal axis of arrowhead 214 than furthest section 1074 of each pivotal blade 902. This provides for an aerodynamically favorable and penetration enhancing arrowhead as is according to this invention. FIG. 47 illustrates blades 902 rotated to their fully open position and abutting against integral blade stop surfaces 682.

Figures 48, 49, 50, 51, 52, 53, 54, 55, 56, 57, 58, 59, 60, 61, 62, 63:
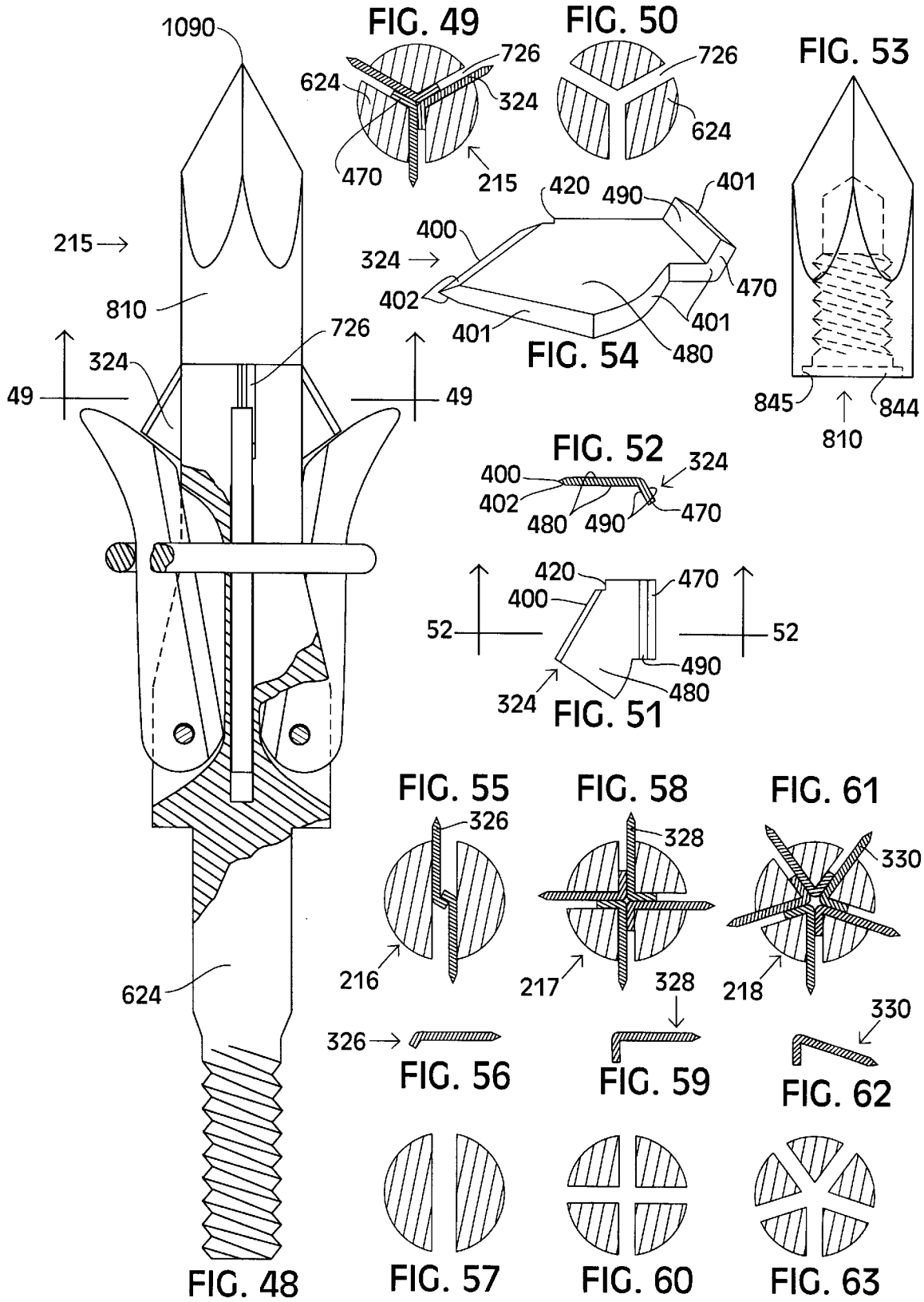
FIG. 48 is a partial sectioned side view of an arrowhead as according to this invention.
FIG. 49 is a cross-sectional view of the arrowhead as illustrated in FIG. 48.
FIG. 50 is a cross-sectional view of the arrowhead body as illustrated in FIG. 48.
FIG. 51 is a side view of an arrowhead cutting blade as according to this invention.
FIG. 52 is a cross-sectional view of the cutting blade as illustrated in FIG. 51.
FIG. 53 is a side view of an arrowhead tip as according to this invention.
FIG. 54 is an enlarged perspective view of the arrowhead cutting blade of FIGS. 51 & 52.
FIG. 55 is a cross-sectional view an arrowhead as according to this invention.
FIG. 56 is a cross-sectional view of a cutting blade of the arrowhead as illustrated in FIG. 55.
FIG. 57 is a cross-sectional view of the arrowhead body of the arrowhead as illustrated in FIG. 55.
FIG. 58 is a cross-sectional view an arrowhead as according to this invention.
FIG. 59 is a cross-sectional view of a cutting blade of the arrowhead as illustrated in FIG. 58.
FIG. 60 is a cross-sectional view of the arrowhead body of the arrowhead as illustrated in FIG. 58.
FIG. 61 is a cross-sectional view an arrowhead as according to this invention.
FIG. 62 is a cross-sectional view of a cutting blade of the arrowhead as illustrated in FIG. 61.
FIG. 63 is a cross-sectional view of the arrowhead body of the arrowhead as illustrated in FIG. 61.

FIGS. 48–54 illustrate an arrowhead 215 which is similar to arrowhead 210 except that arrowhead 215 utilizes a plurality of fixed-blades 324 that each have a bent portion or a flange 470, an arrowhead tip 810, and an arrowhead body 624 with a plurality of three fixed-blade slots 726 each having a thickness or a width of at least twice the thickness of a blade 324. Arrowhead tip 810 has an undercut locking cavity 844 and an undercut locking surface 845. Locking surface 845 engages or abuts against a square stepped forward locking end 420 of each blade 324 when the arrowhead is assembled so as to aid in the securement of blades 324 to arrowhead body 624. As is clearly illustrated in FIG. 49 bent portion 470 of each blade 324 is housed within a neighboring slot 726 that is spaced apart from the slot 726 the rest of the particular blade 324 is housed within. As is illustrated in FIGS. 51 & 54 each blade 324 has a pair of opposing exterior surfaces or side faces which are depicted as 480, 490 & 480, 490 for each blade 324 respectively, and which are distinct from a blade edge 401 extending peripherally thereabout. Peripheral blade edge 401 includes grind bevels 402—402 and cutting edge 400. Each exterior side face 480 is substantially flat or planar as is each exterior side face 490, however since flange 470 is bent, exterior side faces 490 are not in coplanar alignment with exterior sides faces 480 but are offset therefrom by substantially 120 degrees. Bent portions 470 by being housed in neighboring spaced apart slots 726 aid in the securement of blades 324 to arrowhead body 624 when the arrowhead is assembled.

FIGS. 55–61 illustrate arrowheads 216–218 which are similar to arrowhead 215 except that arrowheads 216–218 have fixed-blades with angular offsets between exterior side faces 480 & 490 that differ from the angular offset between exterior side faces 480 & 490 of blades 324. Arrowhead 217 has a plurality of four blades 328 each with an angular offset between exterior side faces 480 & 490 of substantially 90 degrees, and arrowhead 218 has a plurality of five blades 330 each with an angular offset between exterior side faces 480 & 490 of substantially 72 degrees. Arrowhead 216 has a plurality of two blades 326 each with an angular offset between exterior side faces 480 & 490 such that a face 490 of each blade 326 abuts against each other when aiding in the securement of blades 326 to the arrowhead.

Figures 64, 65, 66, 67, 68, 69, 70, 71, 72, 73, 74, 75:
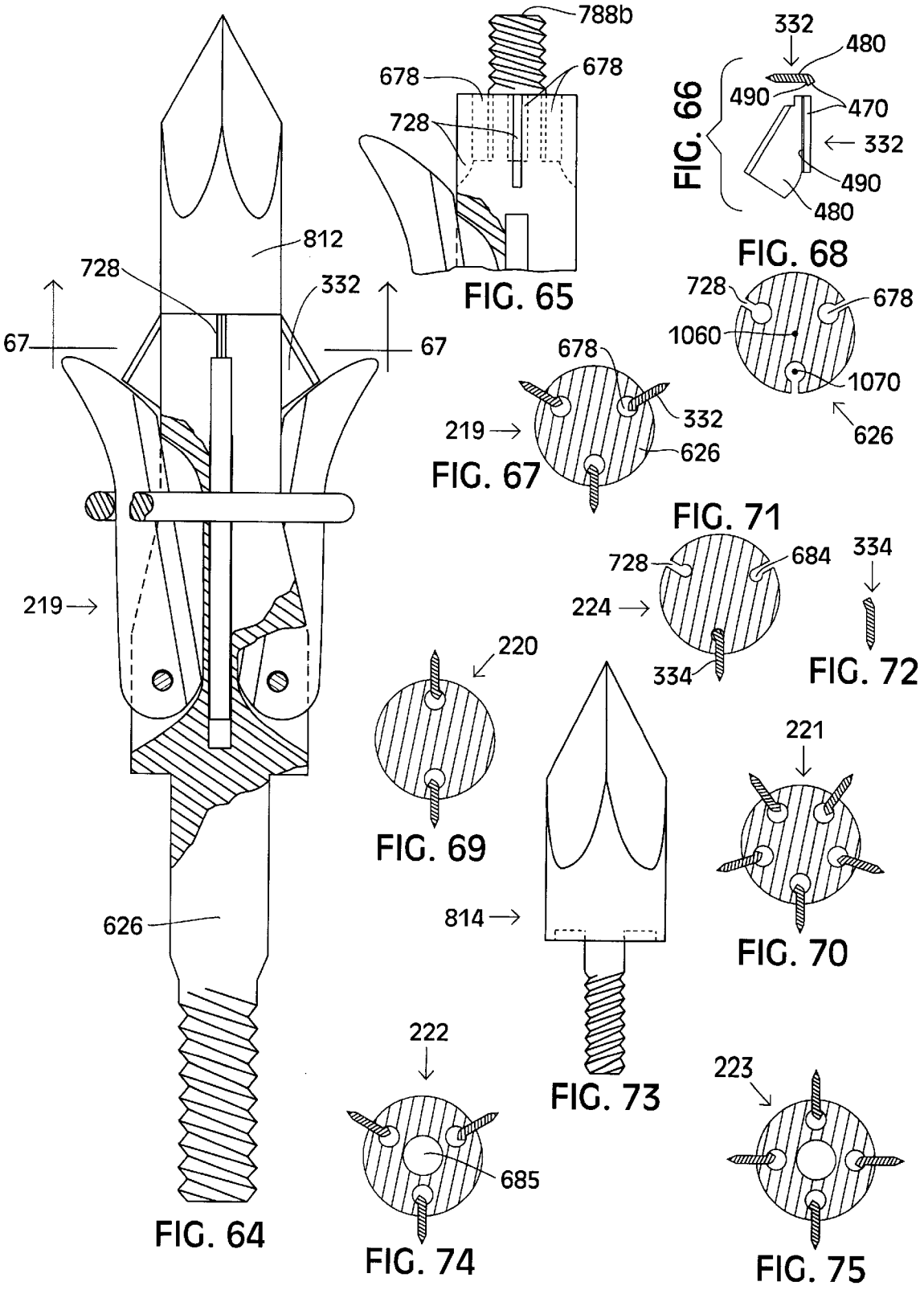
FIG. 64 is a partial sectioned side view of an arrowhead as according to this invention.
FIG. 65 is a side view of an arrowhead tip as according to this invention.
FIG. 66 is a cross-sectional view and a side view of a cutting blade as according to this invention.
FIG. 67 is a partial section partial length side view of an arrowhead as according to this invention.
FIG. 68 is a cross-sectional view the arrowhead as illustrated in FIG. 64.
FIG. 69 is a cross-sectional view of the arrowhead body of the arrowhead as illustrated in FIG. 64.
FIGS. 70–75 are cross-sectional views of other arrowheads as according to this invention.

FIGS. 64–68 illustrate an arrowhead 219 which is similar to arrowhead 215 except that arrowhead 219 has a plurality of hollow cylinders 678 each communicating with a blade slot 728 that together house or secure a plurality of fixed-blades 332 to an arrowhead body 626. Arrowhead body 626 has a male stud 788*b* that threadably receives a female tip 812 thereon. Bent flange 470 of each blade 332 is received in a corresponding hollow cylinder 678 as is illustrated in FIG. 67. As is illustrated in FIG. 68 a central elongate axis 1070 of each cylinder 678 is spaced apart from a central longitudinal axis 1060 of arrowhead body 626 so as to not be collinear therewith.

FIGS. 69 & 70 illustrate arrowheads 220 & 221 which are similar to arrowhead 219 except arrowheads 220 & 221 differ in number of blades 332 and corresponding hollow cylinders 678.

FIGS. 71 & 72 illustrate an arrowhead 224 which is similar to arrowhead 219 except that arrowhead 224 has a plurality of narrower diameter hollow cylinders 684 and a plurality of corresponding different shaped blades 334 to snugly fit therewith.

FIGS. 73–75 illustrate arrowheads 222 & 223 which are similar to arrowhead 219 except arrowheads 222 & 223 utilize a male threaded stud arrowhead tip 814.

FIGS. 76–82 illustrate an arrowhead 225 which is similar to arrowhead 215 except that arrowhead 225 has a centrally located hollow cylinder 687 that communicates with a plurality of blade slots 730 that together secure a plurality of fixed blades 336 to an arrowhead body 628. Hollow cylinder 687 is bound at least in part by an internal wall surface 688 as is illustrated in FIG. 80. As is illustrated in FIG. 79 shaft 830 of arrowhead tip 814 is disposed in cylinder 687 when the arrowhead is assembled so that bent portion 470 of each blade 336 is located between shaft 830 and internal wall 688 which aids in the attachment or securement of blades 336 to arrowhead body 628.

FIGS. 83–85 illustrate arrowheads 226–228 which are similar to arrowhead 225 except arrowheads 226–228 differ in the number of blades 336 contained therewith.

Figure 87:
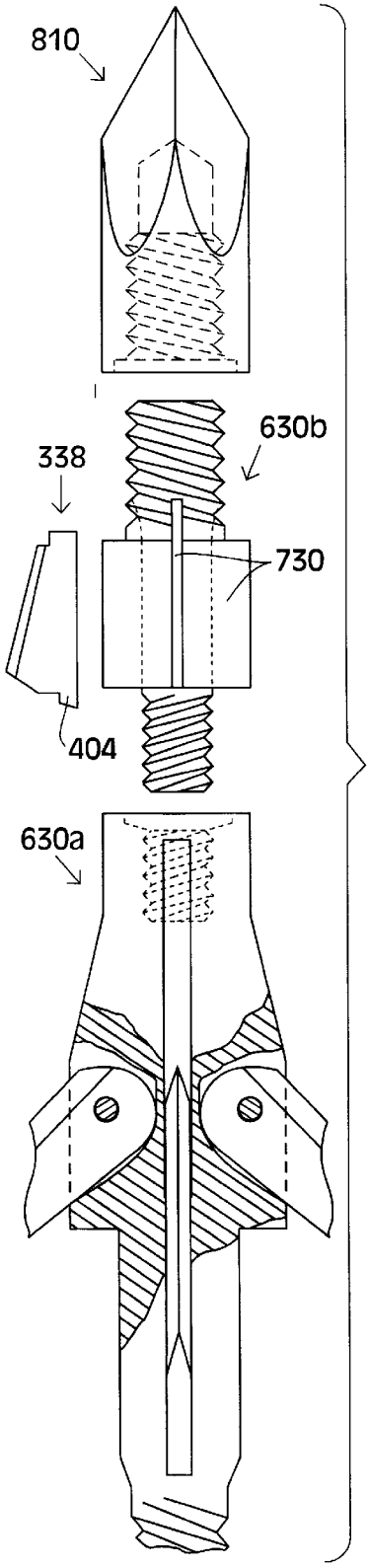
FIG. 87 is an exploded partial sectioned side view of the arrowhead as illustrated in FIG. 86.
Figure 86:
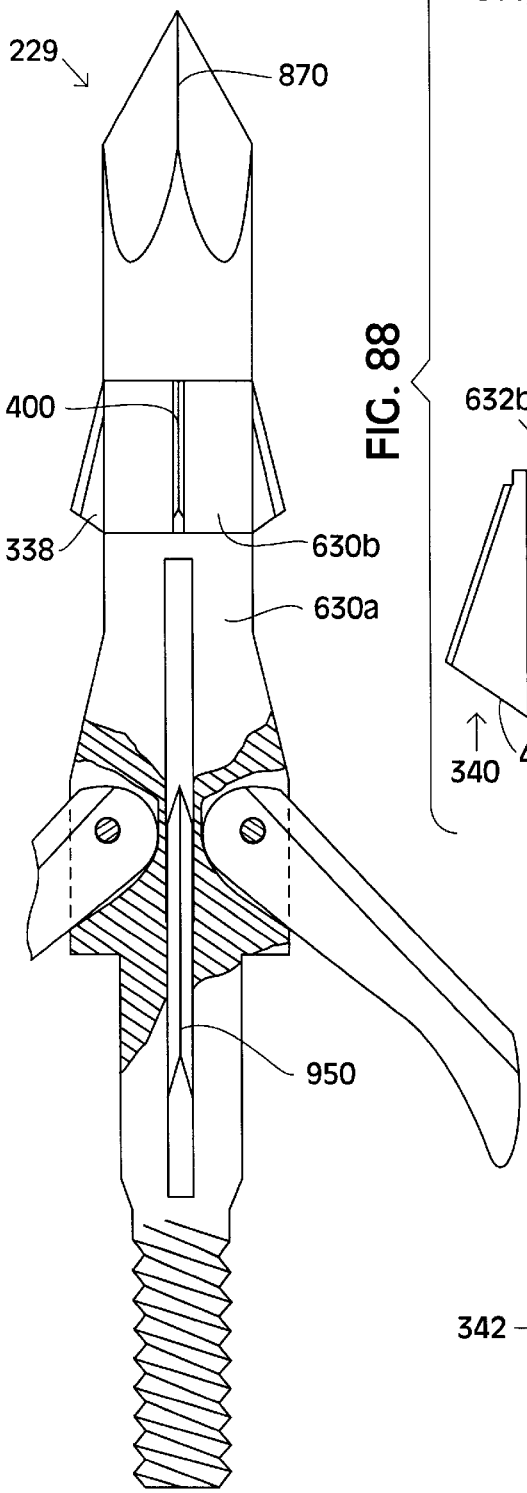
FIG. 86 is a partial sectioned side view of an arrowhead as according to this invention.

FIGS. 86 & 87 illustrate an arrowhead 229 having an upper arrowhead body piece 630*b* and a lower body piece 630*a* that threadably attach to each other in such a manner so as to secure a plurality of blades 338 into a plurality of corresponding blade slots 730 and to provide an arrowhead that achieves the desired results as according to this invention.

Figure 88:
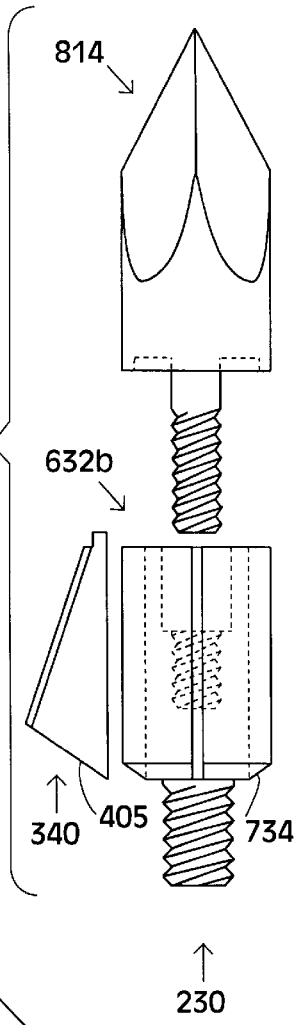
FIG. 88 is an exploded partial length side view of an arrowhead as according to this invention.
Figure 89:
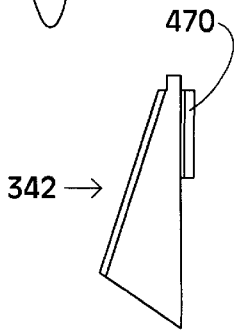
FIG. 89 is a side view of a cutting blade as according to this invention.

FIG. 88 illustrates an arrowhead 230 which is similar to arrowhead 229 except that arrowhead 230 removably receives male tip 814 whereas arrowhead 229 utilizes female tip 810 and arrowhead 230 utilizes a plurality of fixed-blades 340 each having a beveled locking end 405 that is seated in-line with a locking bevel 734 of an upper arrowhead body piece 632*b* thereof when assembled into an arrowhead. FIG. 89 illustrates a fixed-blade 342 which is similar to fixed-blade 340 except that fixed-blade 342 has a bent flange 470 for additional aid in securement of blades 342 to an accompanying arrowhead as has been set forth herein.

Figure 90:
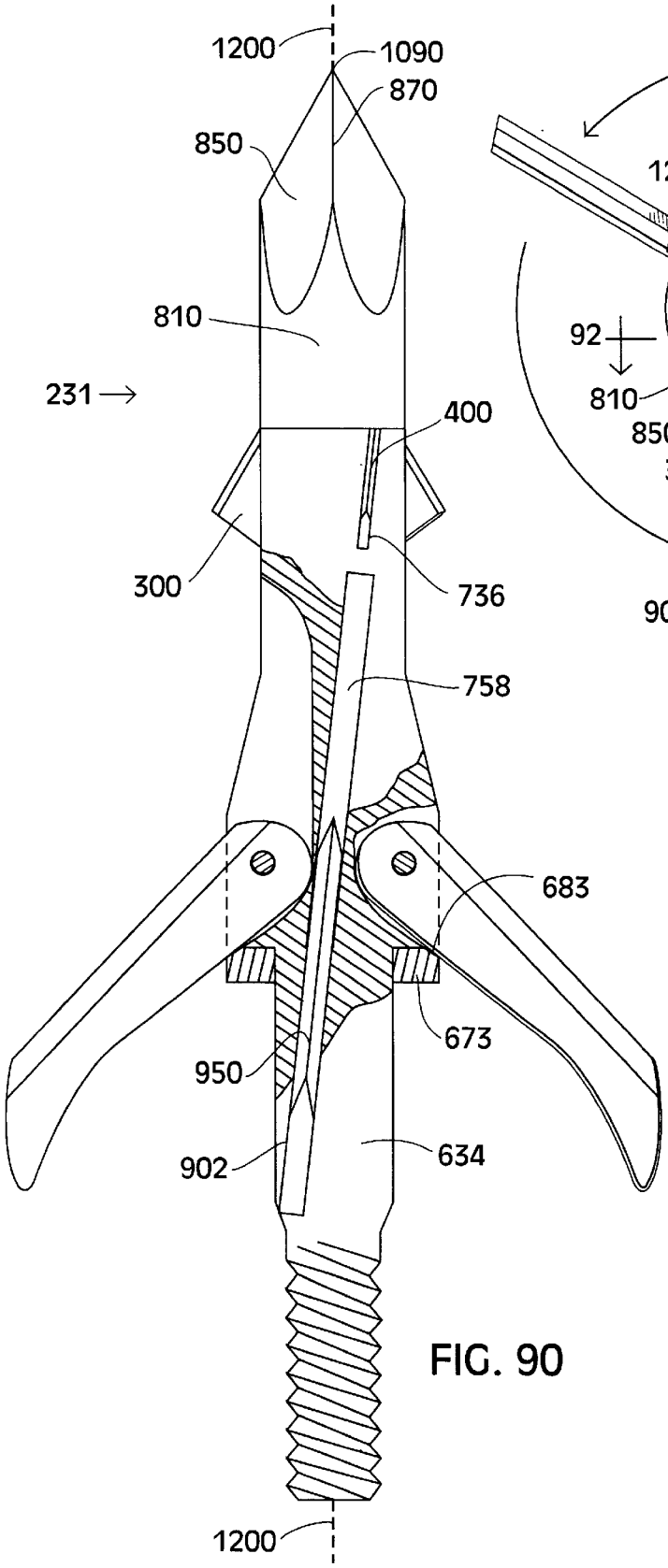
FIG. 90 is a partial sectioned side view of an arrowhead as according to this invention.

FIG. 90 illustrates an arrowhead 231 having a removably attachable blade stop washer 673 and an arrowhead body 634 with a plurality of inclined slots 758 and a plurality of inclined slots 736 to receive a plurality of blades 902 and a plurality of blades 300 respectively. Blades 300 and 902 are inclined relative to central longitudinal axis 1200 of arrowhead 231 in such a manner that a cutting edge 400 and a cutting edge 950 of corresponding paired or adjacent blades 902 and 300 are in substantial coplanar alignment with each other and cause arrowhead 231 to spin when penetrating a target. As illustrated in FIG. 90 blades 902 abut against a slightly beveled abutting surface 683 of a substantially flat blade stop washer 673. It is apparent that arrowheads having spin inducing capacities as according to this invention such as when penetrating a substance or when in-flight, such as arrowhead 231, may have any type of blade stop abutting surface or blade stop washer or equivalent as has been set forth herein, or as in known to those skilled in the art.

Figure 91:
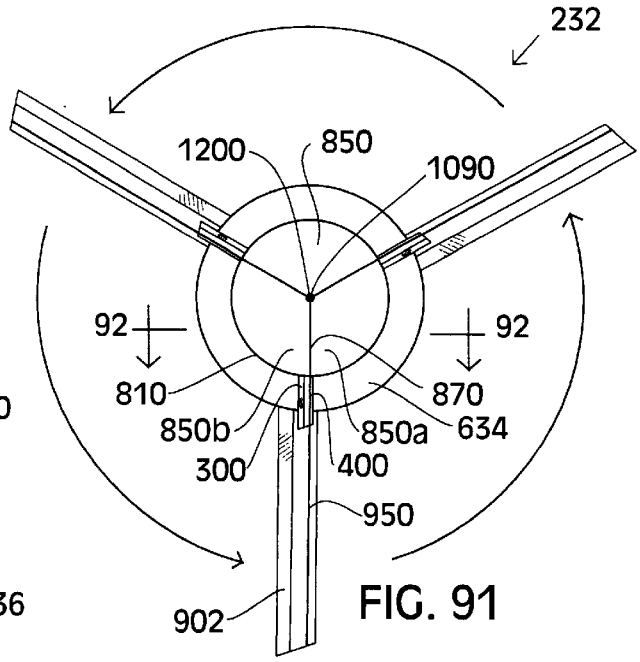
FIG. 91 is a top view of an arrowhead as according to this invention.
Figure 92:
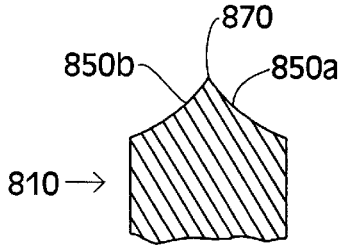
FIG. 92 is a cross-sectional view of the arrowhead tip of the arrowhead as illustrated in FIG. 91.

FIGS. 91 & 92 illustrate an arrowhead 232 which is similar to arrowhead 231 except that arrowhead 232 has facet boundaries 870 substantially in-line with cutting edges 400 and 950. Arrowhead 232 like arrowhead 231 when penetrating a target spins counter clockwise when viewed from above, or right handedly when viewed from the side. FIG. 92 in particular illustrates that a facet exterior surface 850*b* on one side of each facet boundary 870 has substantially the same slope at distances equidistantly displaced from facet boundary 870 as does a facet exterior surface 850*a* on an opposing side of facet boundary 870.

FIGS. 93–105 illustrate arrowheads 233–238 which are similar to arrowhead 232 in that arrowheads 233–238 each have inclined blades to induce spinning upon target penetration but differ in varying manners from arrowhead 232 as will be set forth herebelow.

Arrowhead 233 as illustrated in FIG. 93 has a plurality of non-linear or curved facet boundaries 874 that curve in a clockwise direction when viewed from above. The arrowhead tip of arrowhead 233 has a facet exterior surface 854*b* on one side of each facet boundary 874 that has a substantially different slope than the slope of a facet exterior surface 854*a* on an opposing side of each facet boundary 874 as is illustrated in FIG. 94. Particularly, as illustrated in FIG. 94 facet exterior surface 854*b* has a more dished out or concave slope than does facet exterior surface 854*a*. It is apparent that facet exterior surfaces 854*a* & 854*b* or other similar facet exterior surfaces of this invention as illustrated in FIG. 94 could be reversed so as to be such as is illustrated in FIG. 95. It is apparent that facet exterior surfaces 854*a* & 854*b* or other similar facets of this invention that have differing slopes on opposing sides of corresponding facet boundaries could have convex facets, or at least a section thereof that is substantially convex.

When arrowhead 233 is penetrating a target such as a game animal facet exterior surfaces 854*a* & 854*b* create differing resistive forces due to their differing slopes or shapes which induces a net rotational force in a particular direction upon arrowhead 233 so as to cause it to turn or spin about its central longitudinal axis. Such rotational force can induce an increased spinning effect upon the arrowhead if aligned in the same direction as the spinning force produced from the inclined blades, or it can produce a braking effect if directed in opposition to the spin induced force of the inclined blades. Blades 902 & 300 induce clockwise spinning upon arrowhead 233 when viewed from above or left handed spinning when viewed from the side. It is apparent that the various spin or braking inducing designs of the various embodiments of this invention may be combined with each other and with the various different arrowheads as according to this invention, as well as with other such result producing arrowheads know to those skilled in the art, including in manners that have not been suggested herein, such as with embodiments taught in my U.S. Pat. No. 6,171,206, which is incorporated herein by specific reference.

Arrowhead 234 as illustrated in FIG. 96 has a plurality of non-linear or curved facet boundaries 876 that curve in a counter clockwise direction when viewed from above, and the facet exterior surfaces of a plurality of facets 858 thereof have substantially the same slope on opposing sides of each facet boundary 876. It is also apparent that curved facet boundaries such as facet boundaries 874 & 876 can also induce or enhance spinning or braking in and of themselves by providing a drill-bit effect when penetrating target material.

Arrowhead 235 as illustrated in FIG. 98 has a plurality of linear or non-curved facet boundaries 890 such that a facet exterior surface 860*b* on one side of each facet boundary 890 has a substantially different slope than the slope of a facet exterior surface 860*a* on an opposing side of facet boundary 890 as is illustrated in FIG. 99. The term linear as used herein refers to being straight, such as a straight line.

Arrowhead 236 as illustrated in FIG. 100 has a plurality of three facets 862, and a plurality of non-radially aligned linear facet boundaries 892 that terminate in a forward leading end 1092 thereof. It is apparent that forward end 1092 may have a variety of different shapes including flat, concave, convex, pointed or such so as to be sharpened for cutting, chiseling or wedging. Blades 902 of arrowhead 236 are substantially non-radially aligned with the central longitudinal axis of arrowhead 236 which can enhance either the spinning or braking effects thereof depending on the directions the other spin inducing forces are directed thereon. Arrowhead tips as according to this invention having non-radially aligned facet boundaries, which may also comprise a cutting edge, will cause a spin or rotational force to be exerted upon corresponding arrowheads in such a similar manner as do non-radially aligned opened cutting blades.

Arrowhead 237 as illustrated in FIG. 101 has a plurality of three facets 864, and a plurality of non-radially aligned linear facet boundaries 894 that connect to a forward leading end 1094 of the arrowhead by a plurality of radially aligned ridges 895. It is apparent that ridges 895 may comprise, but not be limited to, facet boundaries as according to this invention. Blades 902 of arrowhead 237 are also substantially non-radially aligned with the central longitudinal axis of the arrowhead.

Arrowhead 238 as illustrated in FIG. 102 has a plurality of three facets 866, and a plurality of non-radially aligned curved facet boundaries 896 that connect to a forward leading end 1096 thereof. Blades 902 of arrowhead 237 are also substantially non-radially aligned with the central longitudinal axis of the arrowhead. It is apparent that facets 862, 864 & 866 of arrowheads 236–238 may have any sloped exterior facet shape, such as is illustrated in FIGS. 103–105 or other variations thereof.

Figures 106, 107, 108, 109, 110, 111, 112, 113, 114, 115:
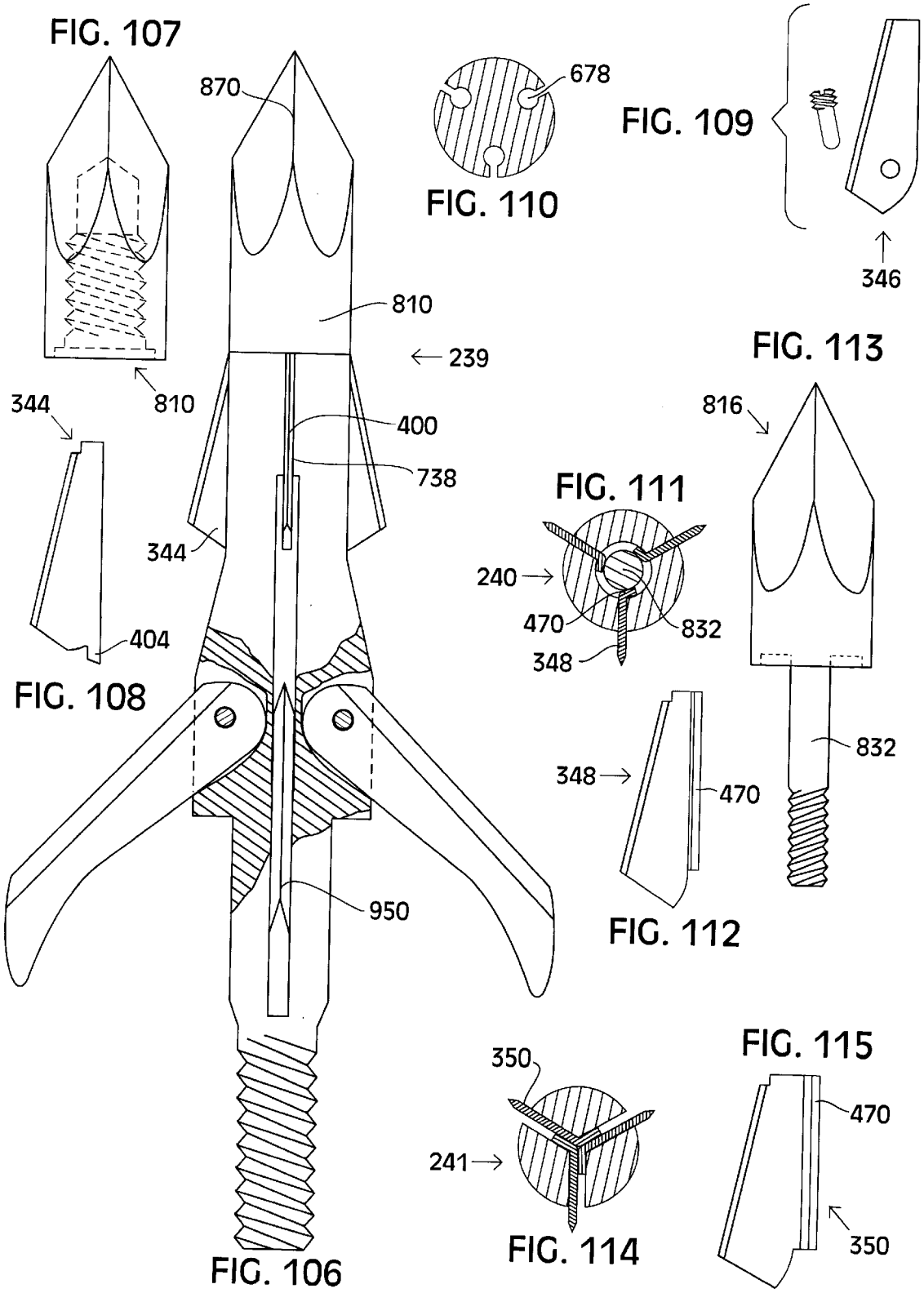
FIG. 106 is a partial sectioned side view of an arrowhead as according to this invention.
FIG. 107 is a side view of an arrowhead tip as according to this invention.
FIG. 108 is a side view of a cutting blade as according to this invention.
FIG. 109 is a side view of an arrowhead cutting blade and a set screw as according to this invention.
FIG. 110 is a cross-sectional view of an arrowhead body as according to this invention.
FIG. 111 is a cross-sectional view of an arrowhead as according to this invention.
FIG. 112 is a side view of a cutting blade as according to this invention.
FIG. 113 is a side view of an arrowhead tip as according to this invention.
FIG. 114 is a cross-sectional view of an arrowhead as according to this invention.
FIG. 115 is a side view of a cutting blade as according to this invention.

FIGS. 106–108 illustrate an arrowhead 239 which has a plurality of fixed-blades 344 removably attached in a plurality of blade slots 738. It is apparent that the penetration enhancing forward leading cutting edges or edge such as cutting edges 400 of blades 344 as according to this invention situated at least in part forward of a main cutting blade when a corresponding arrowhead is in a penetrating configuration may extend for any axial or elongate length upon corresponding arrowhead bodies.

FIGS. 109–115 illustrate other arrowheads as according to this invention which have fixed-blades of similar lengths as blades 344 of arrowhead 239.

FIG. 109 illustrates that it is apparent that a blade 346 with an aperture can be attached to an arrowhead similar to arrowhead 209 as illustrated in FIG. 28.

FIG. 110 illustrates that it is apparent that a blade of similar length as blade 344 can be attached with an arrowhead similar to arrowhead 219 as illustrated in FIGS. 64–68.

FIGS. 111–113 illustrate that a blade 348 having a bent portion 470 can be attached with an arrowhead 240 which is similar to arrowhead 225 as illustrated in FIGS. 76–82. Arrowhead 240 has an arrowhead tip 816 that has a substantially longer shaft 832 than shaft 830 of arrowhead tip 814 which is received in an accompanying substantially elongate longer cylinder or bore having at least an internal section thereof threaded.

It is apparent that the internal cylinders or bores of arrowheads as according to this invention, including ones that are substantially centrally oriented about an accompanying arrowhead central longitudinal arrowhead axis, may extend for any elongate length within their corresponding arrowhead bodies, including to a distance substantially near an accompanying arrowshaft contacting surface.

FIGS. 114 & 115 illustrate that a blade 350 having a bent portion 470 can be attached with an arrowhead 241 which is similar to arrowhead 215 as illustrated in FIGS. 48–52.

Figures 116, 117, 118, 119, 120, 121, 122, 123, 124, 125, 126, 127, 128:
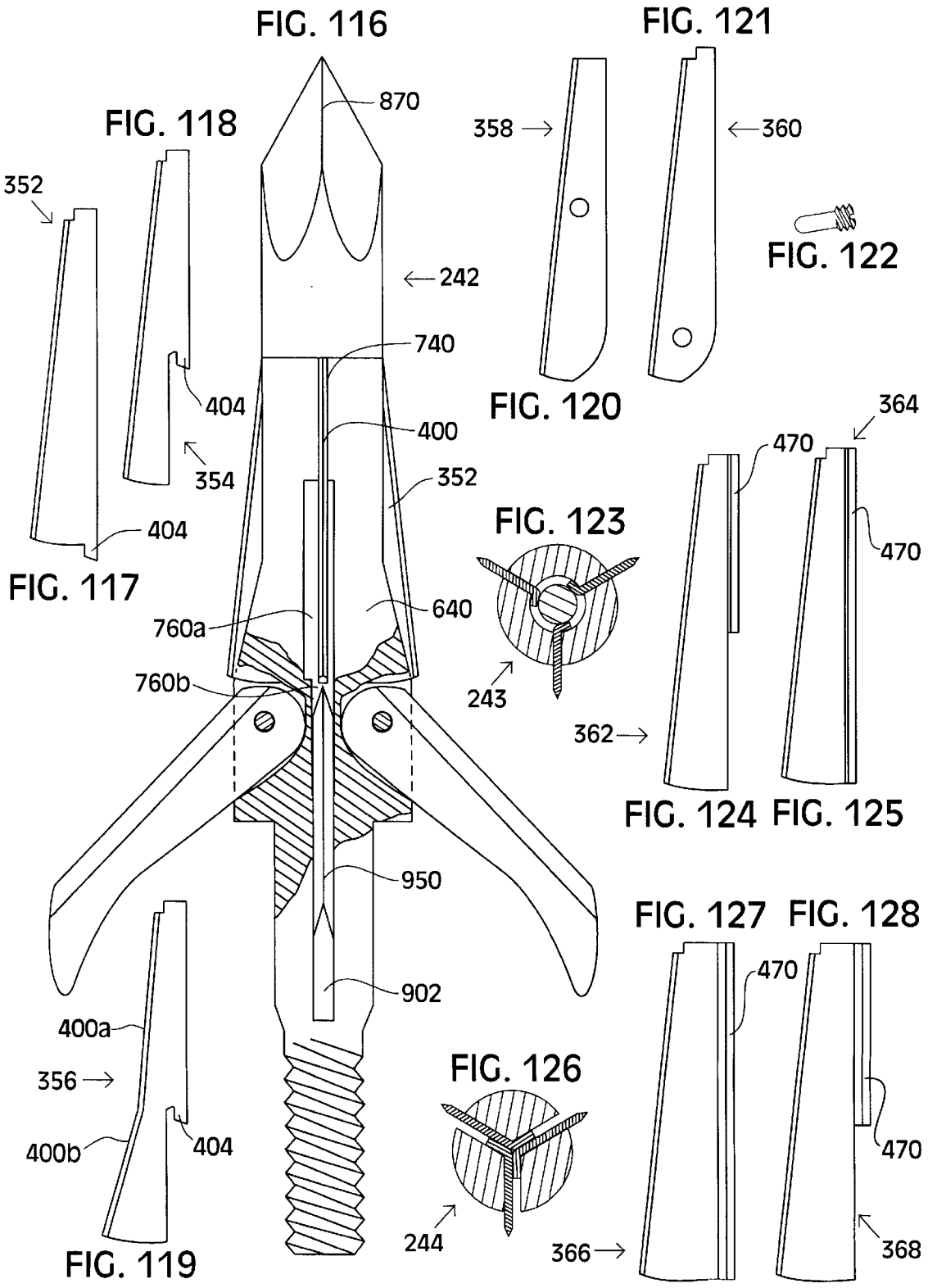
FIG. 116 is a partial sectioned side view of an arrowhead as according to this invention.
FIGS. 117–121 are side views of cutting blades as according to this invention.
FIG. 122 is a side view of a set screw as according to this invention.
FIG. 123 is a cross-sectional view of an arrowhead as according to this invention.
FIGS. 124 & 125 are side views of cutting blades as according to this invention.
FIG. 126 is a cross-sectional view of an arrowhead as according to this invention.
FIGS. 127 & 128 are side views of cutting blades as according to this invention.

FIGS. 116 & 117 illustrate an arrowhead 242 which has an arrowhead body 640 and a plurality of fixed-blades 352 removably attached in a plurality of blade slots 740. Each pivotal blade 902 is pivotally connected within a blade slot 760 which has a forward wider section 760*a* and a rearward narrower section 760*b*. Each rearward slot section 760*b* is preferably substantially not less in width than the thickness of a blade 902 so as to hold each blade 902 relatively snugly therein and to therefore prevent any undesired blade wobble upon target penetration. Each forward slot section 760*a* is preferably substantially of a width wide enough so as to allow each blade 902 to be folded into a retracted or closed in-flight position adjacent arrowhead body 640 such that arrowhead 242 maintains an aerodynamically favorable in-flight profile.

FIGS. 118 & 119 illustrate a blade 354 and a blade 356 that each have a leg 404 disposed thereon at a location substantially forward of their rear end sections. Cutting edge 400 of blade 356 has a forward section 400*a* and a rearward section 400*b*, which do not have at least a linear section thereof collinear with one another. Arrowhead blades 354 & 356 could be attached to the arrowhead body of arrowhead 239 as illustrated in FIG. 106 which would produce arrowheads having friction reducing or penetration enhancing forward leading cutting edges similar to that which arrowhead 242 sports.

FIGS. 120–122 illustrate that it is apparent that substantially elongate blades such as a blade 358 and a blade 360 with set screw receiving apertures can be attached to an arrowhead in a similar manner as blades 308 are attached to arrowhead 209 as illustrated in FIG. 28.

FIGS. 123–128 illustrate other arrowheads as according to this invention which have fixed-blades of a similar length as blades 352 of arrowhead 242.

FIGS. 123–125 illustrate that a blade 362 or a blade 364 each with a bent portion 470 can be attached to an arrowhead 243 or other similar arrowheads which are similar to arrowhead 240 as illustrated in FIGS. 111–113. FIGS. 126–128 illustrate that a blade 366 or a blade 368 each with a bent portion 470 can be attached with an arrowhead 244 or other similar arrowheads which are similar to arrowhead 241 as illustrated in FIGS. 114 & 115.

It is apparent that the friction reducing forward leading cutting edges or edge for enhanced penetration such as a cutting edge 400 as according to this invention situated at least in part forward of a main cutting blade when a corresponding arrowhead is in a penetrating configuration may project outward from the exterior surface of a corresponding arrowhead body a very small distance while serving to provide the penetration enhancement desired results of this invention.

Figure 129:
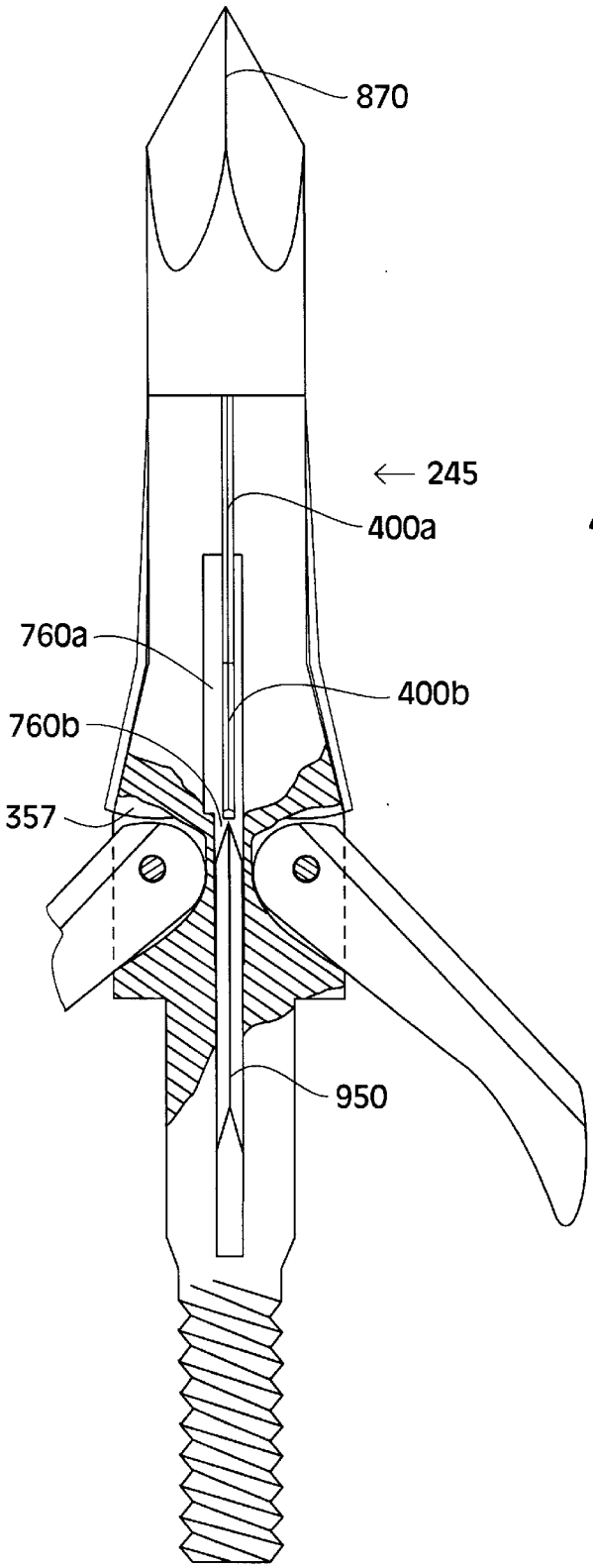
FIG. 129 is a partial sectioned side view of an arrowhead as according to this invention.

FIG. 129 illustrates an arrowhead 245 which is similar to arrowhead 242 as illustrated in FIG. 116 except that arrowhead 245 utilizes a plurality of fixed-blades 357 which are at least in part similar to blade 356 as illustrated in FIG. 119.

Figure 130:
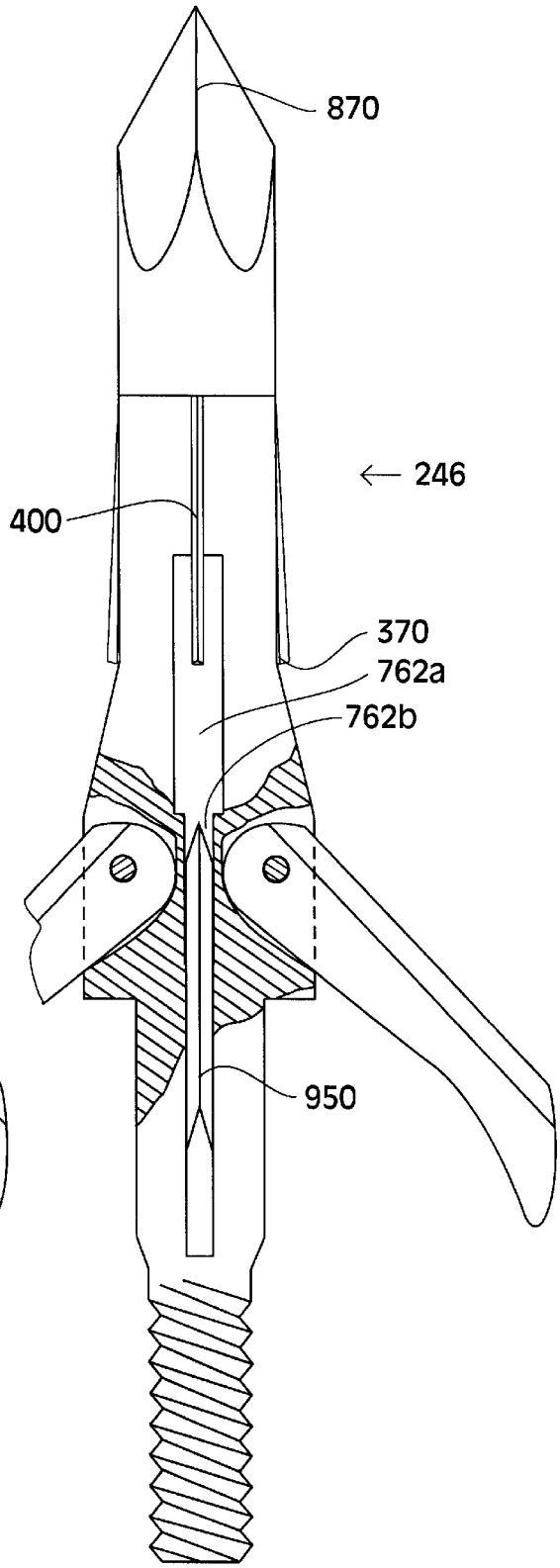
FIG. 130 is a partial sectioned side view of an arrowhead as according to this invention.

FIG. 130 illustrates an arrowhead 246 which is similar to arrowhead 245 except that arrowhead 246 utilizes a plurality of fixed-blades 370 which extend in axial or elongate length upon the arrowhead body thereof substantially less than that which blades 357 do. Arrowhead 246 has a plurality of slots 762 for housing the pivotal blades thereof, such that each slot 762 has a wider forward section 762*a* and a narrower rearward section 762*b*.

Figures 131, 132, 133, 134, 135, 136, 137, 138, 139, 140, 141:
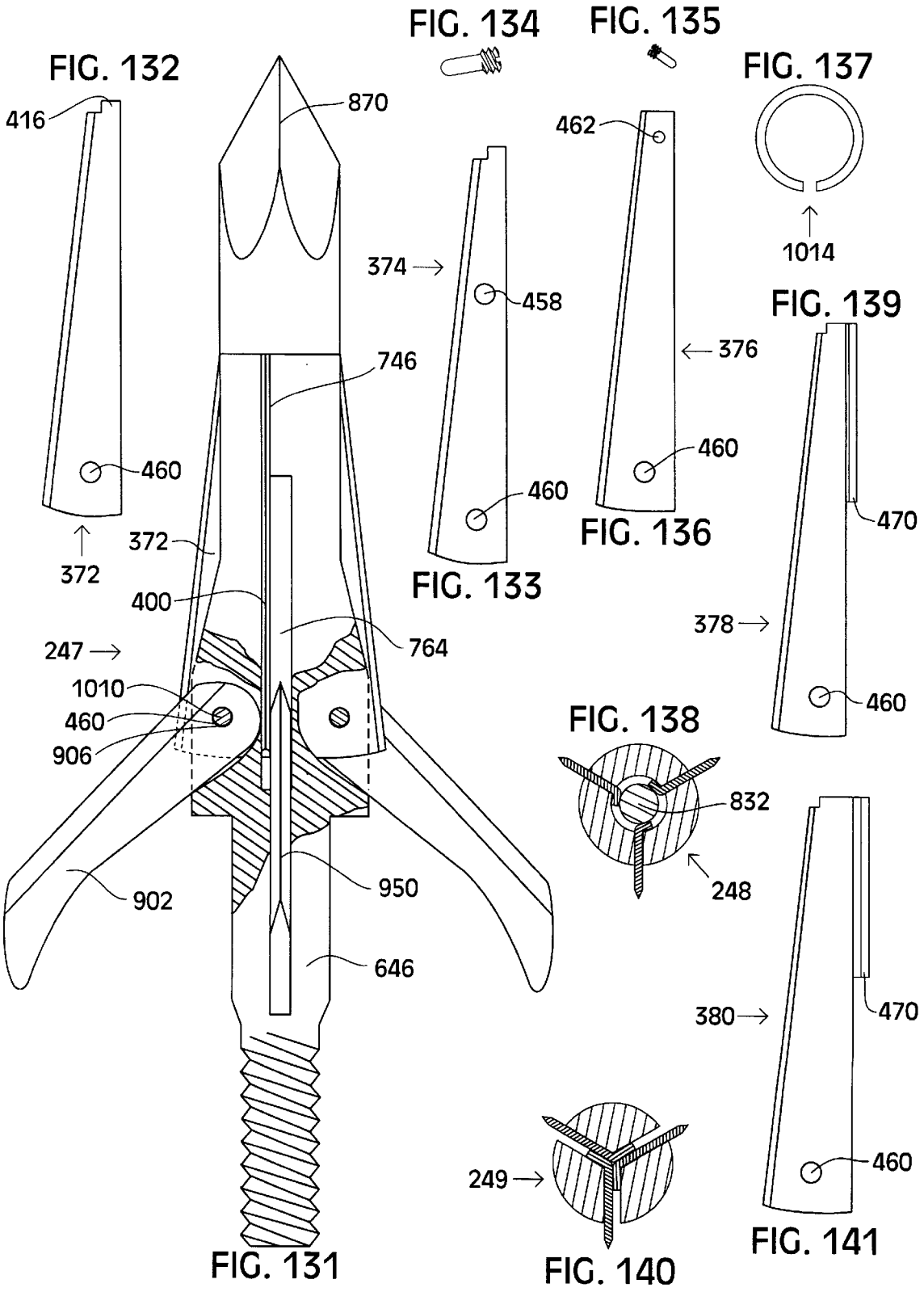
FIG. 131 is a partial sectioned side view of an arrowhead as according to this invention.
FIGS. 132 & 133 are side views of cutting blades as according to this invention.
FIGS. 134 & 135 are side views of set screws as according to this invention.
FIG. 136 is a side view of a cutting blade as according to this invention.
FIG. 137 is a top view of an annular ring as according to this invention.
FIG. 138 is a cross-sectional view of an arrowhead as according to this invention.
FIG. 139 is a side view of a cutting blade as according to this invention.
FIG. 140 is a cross-sectional view of an arrowhead as according to this invention.
FIG. 141 is a side view of a cutting blade as according to this invention.

FIGS. 131 & 132 illustrate an arrowhead 247 which has an arrowhead body 646 and a plurality of fixed-blades 372 each with a hinge pin receiving aperture 460 and a forward locking end 416. Arrowhead body 646 has a plurality of blade slots 746 and a plurality of blade slots 764 for receiving blades 372 and 902 respectively therein. Each cutting edge 400 of blades 372 is not in coplanar alignment with the cutting edge 950 of its corresponding paired adjacent pivotal blade 902. Each blade 902 has a hinge pin receiving aperture 906 for receiving a hinge pin such as partially threaded set screw 1010. Set screws 1010 pass through apertures 906 and 460 when threaded into arrowhead body 646 so as to attach or secure the rear end of each blade 372 to arrowhead body 646 as well as to pivotally connect blades 902 to arrowhead body 646.

It is apparent that the penetration enhancement forward leading cutting edges or edge such as a cutting edge 400 as according to this invention situated at least in part forward of a main cutting blade when a corresponding arrowhead is in a penetrating configuration may extend substantially rearward to approximately near the forward most terminus or section of the cutting edge of a main arrowhead cutting blade, such as near to a cutting edge 950 of a pivotal blade.

FIGS. 133–137 illustrate a fixed-blade 374 and a fixed-blade 376. Fixed-blade 374 has a set screw receiving aperture 458 in addition to aperture 460 for aiding in the attachment of blade 374 to a corresponding arrowhead body. Fixed-blade 376 has an aperture 462 in addition to aperture 460 for aiding in the attachment of blade 376 to a corresponding arrowhead body. FIG. 137 illustrates that an annular ring 1014 could be extended through aperture 462 of blade 376 when blade 376 is attached to an arrowhead.

It is apparent that cutting blades such as fixed-blade 372 or other substantially elongate similar function providing blades may be housed in blades slots that are spaced apart a distance away from the blade slots of a corresponding arrowhead which house the main arrowhead cutting blades.

FIGS. 138–141 illustrate an arrowhead 248 and an arrowhead 249 which are similar to arrowheads heretofore disclosed, except arrowheads 248 & 249 utilize blades having hinge pin apertures 460 such as a blade 378 or a blade 380.

Figure 142:
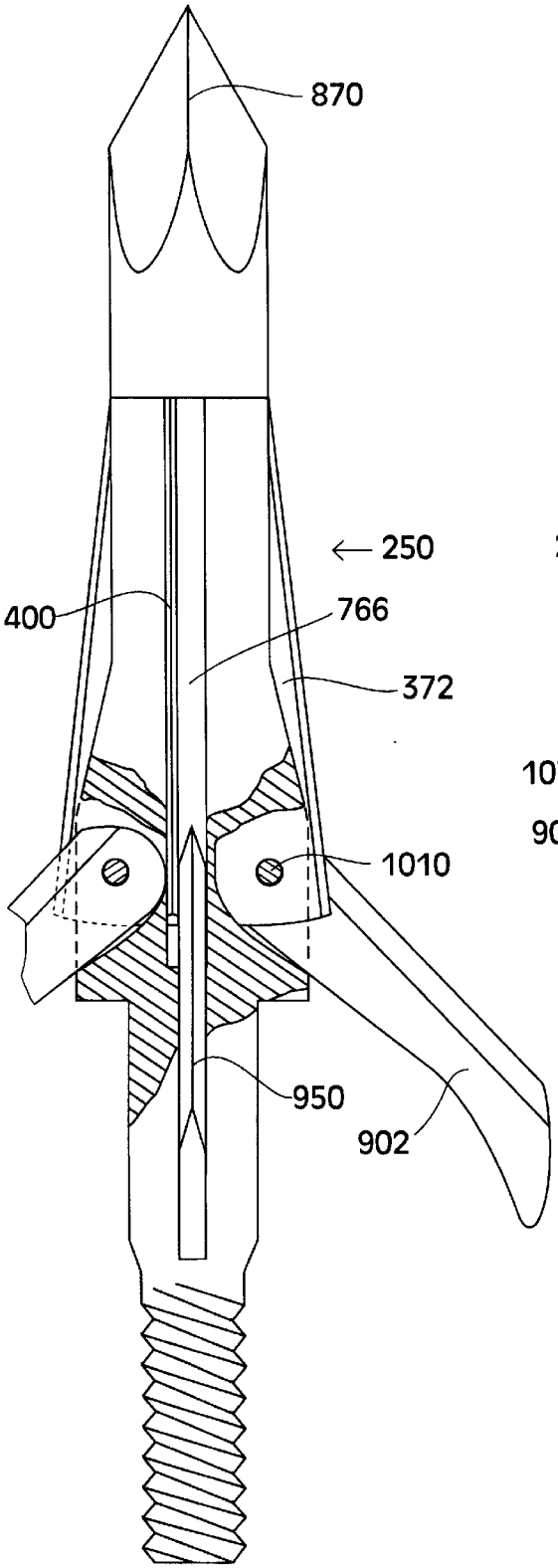

FIG. 142 illustrates an arrowhead 250 which is similar to arrowhead 247 except that arrowhead 250 has a plurality of slots 766 for housing main cutting pivotal blades 902 and forward leading penetration enhancing cutting blades 372 therein. Therefore, arrowhead 250 only utilizes one blade slot 766 for housing each corresponding pair of blades 372 & 902.

Figure 143:
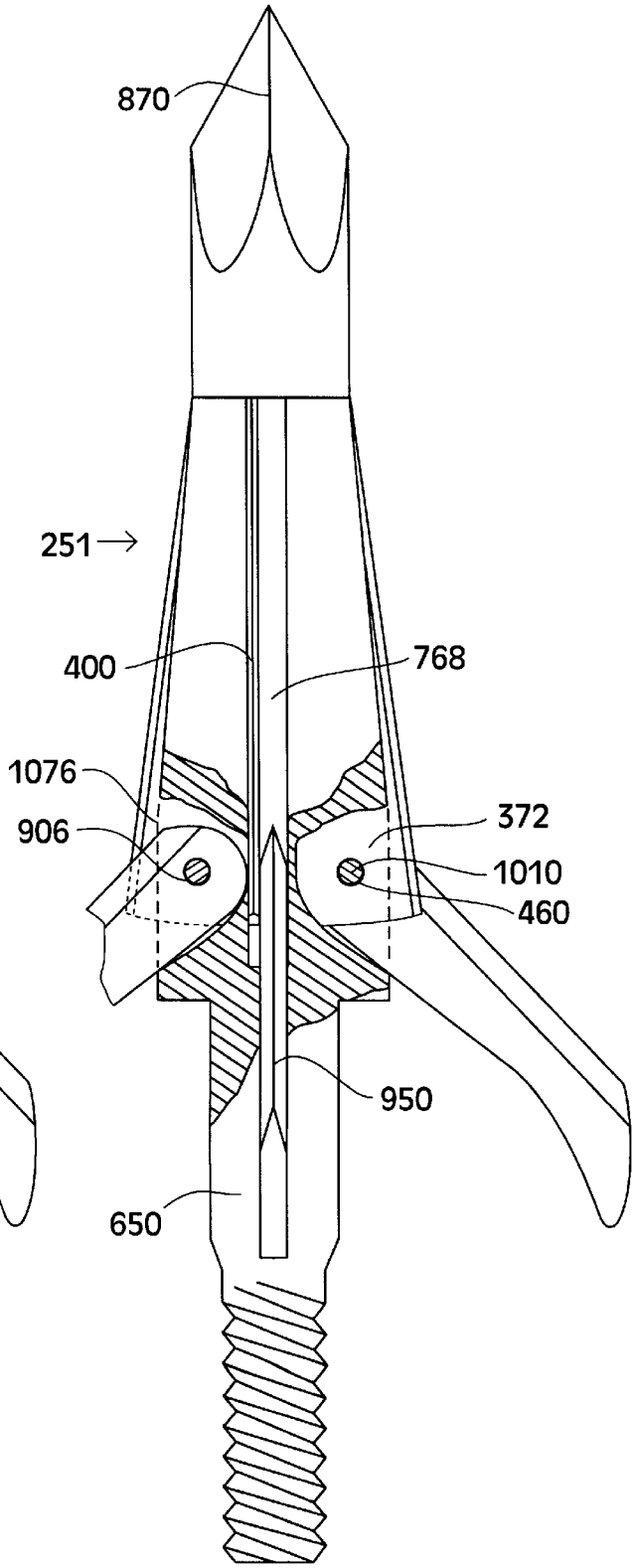

FIG. 143 illustrates an arrowhead 251 which is similar to arrowhead 250 except that arrowhead 251 has an arrowhead body 650 that has a constant sloped taper from the rear end of its arrowhead tip rearward to the widest section 1076 of arrowhead body 650.

Figure 144:
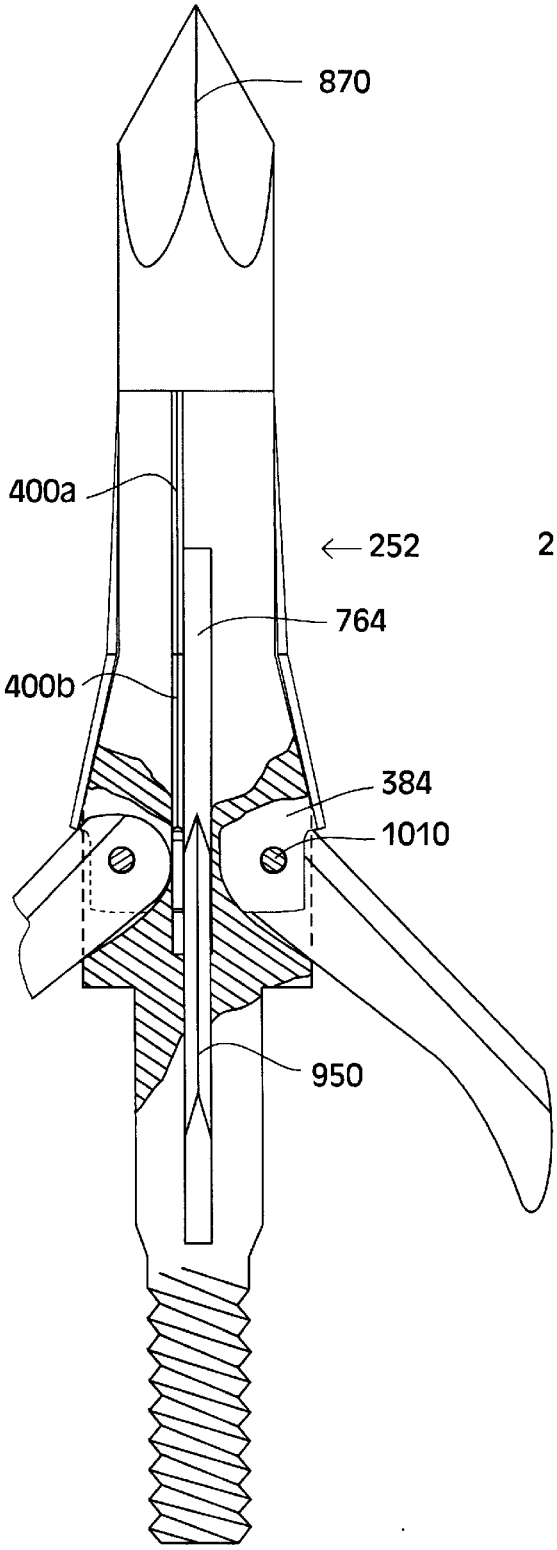

FIG. 144 illustrates an arrowhead 252 which is similar to arrowhead 247 of FIG. 131 except arrowhead 252 has a plurality of fixed-blades 384 that each are similar at least in part to blades 356 and 357 as previously disclosed.

Figure 145:
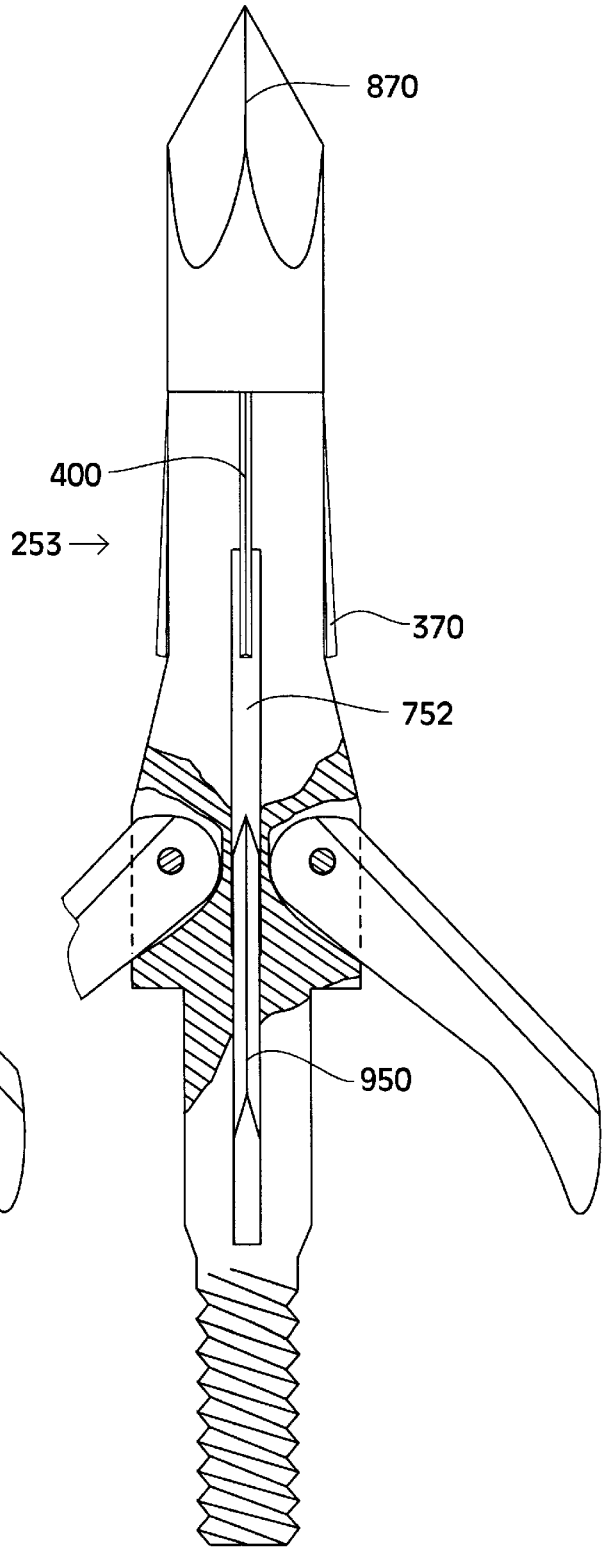

FIG. 145 illustrates an arrowhead 253 which is similar to arrowhead 246 of FIG. 130 except arrowhead 253 has a plurality of blade slots 752 that each have a substantially uniform width for their entire axial or elongate length.

Figure 146:
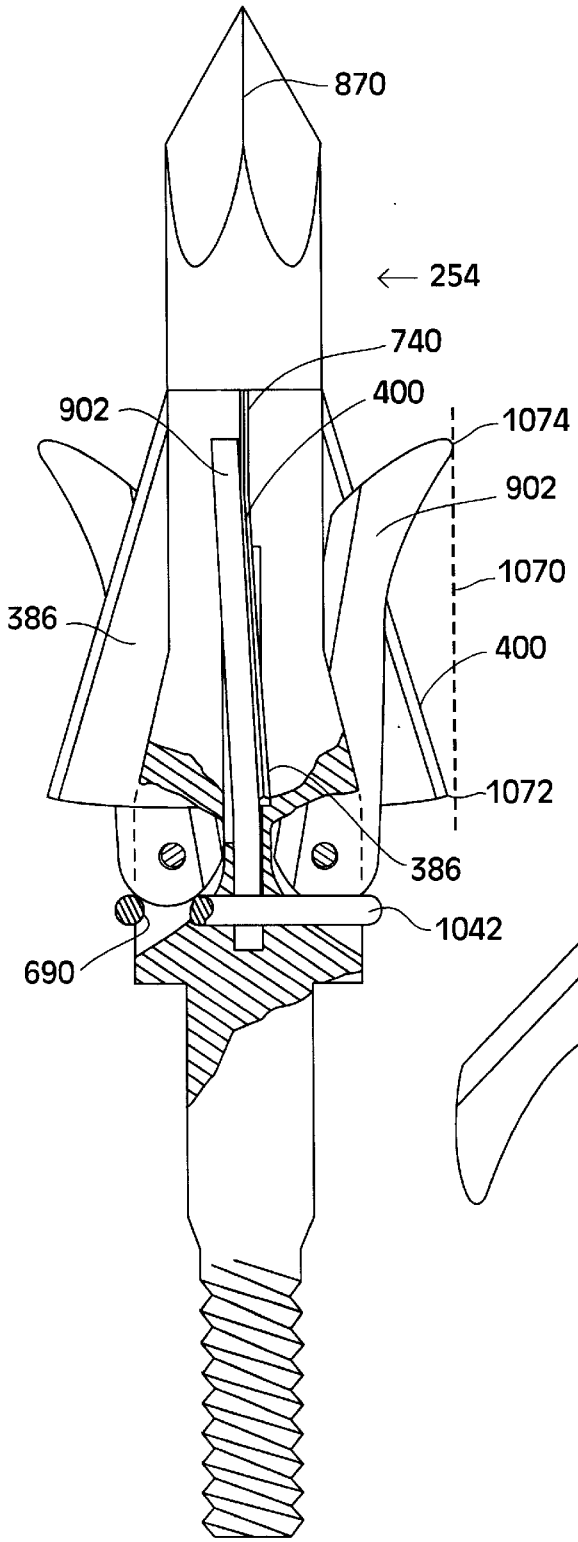
Figure 147:
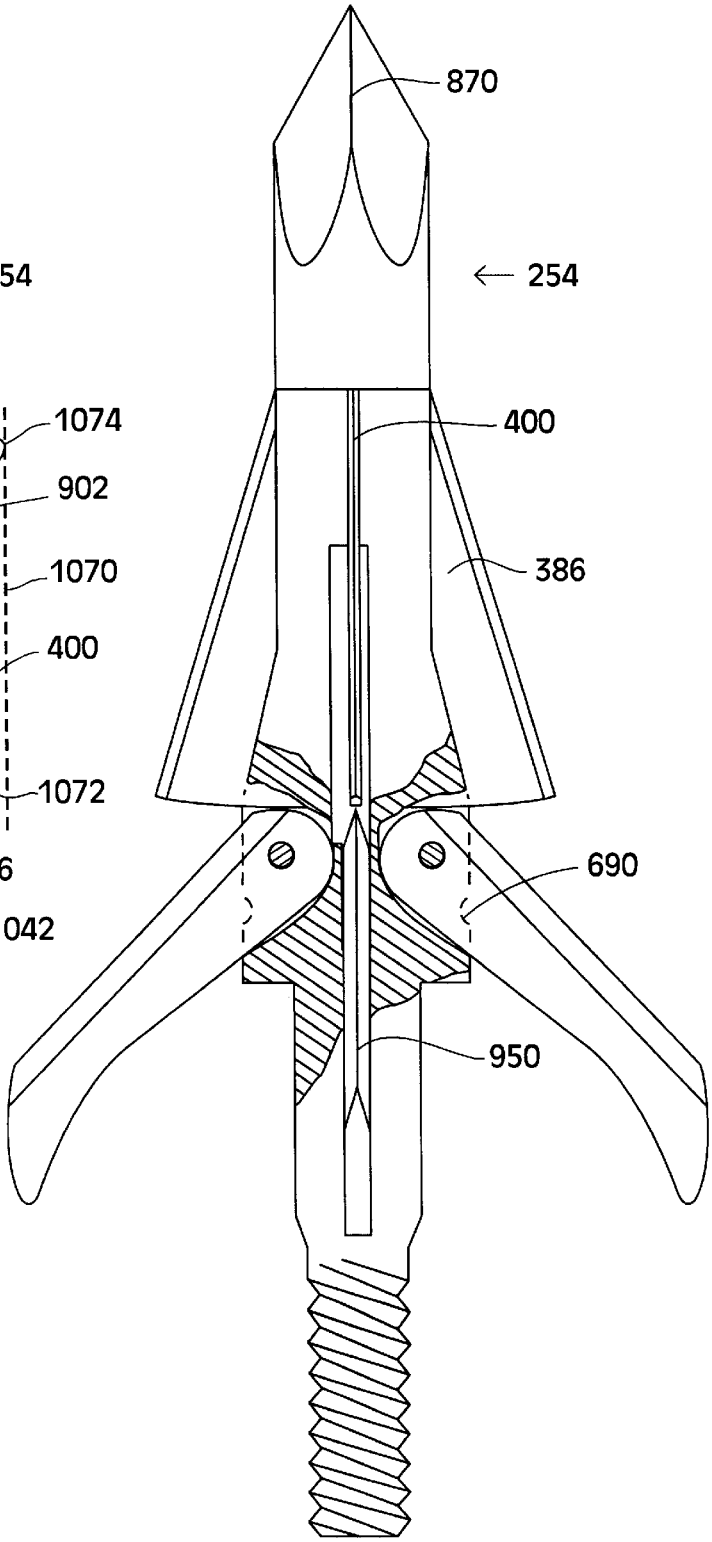

FIGS. 146 & 147 illustrate an arrowhead 254 which has a plurality of fixed-blades 386 housed within a plurality of blade slots 740 and an annular rubber O-ring 1042 for blade retention seated within an externally exposed annular recess 690. As is clearly illustrated in FIG. 146 when arrowhead 254 is in an in-flight configuration the widest section 1072 of each cutting edge 400 is situated closer to the central longitudinal axis of the arrowhead than the widest section 1074 of each pivotal blade 902.

Figure 148:
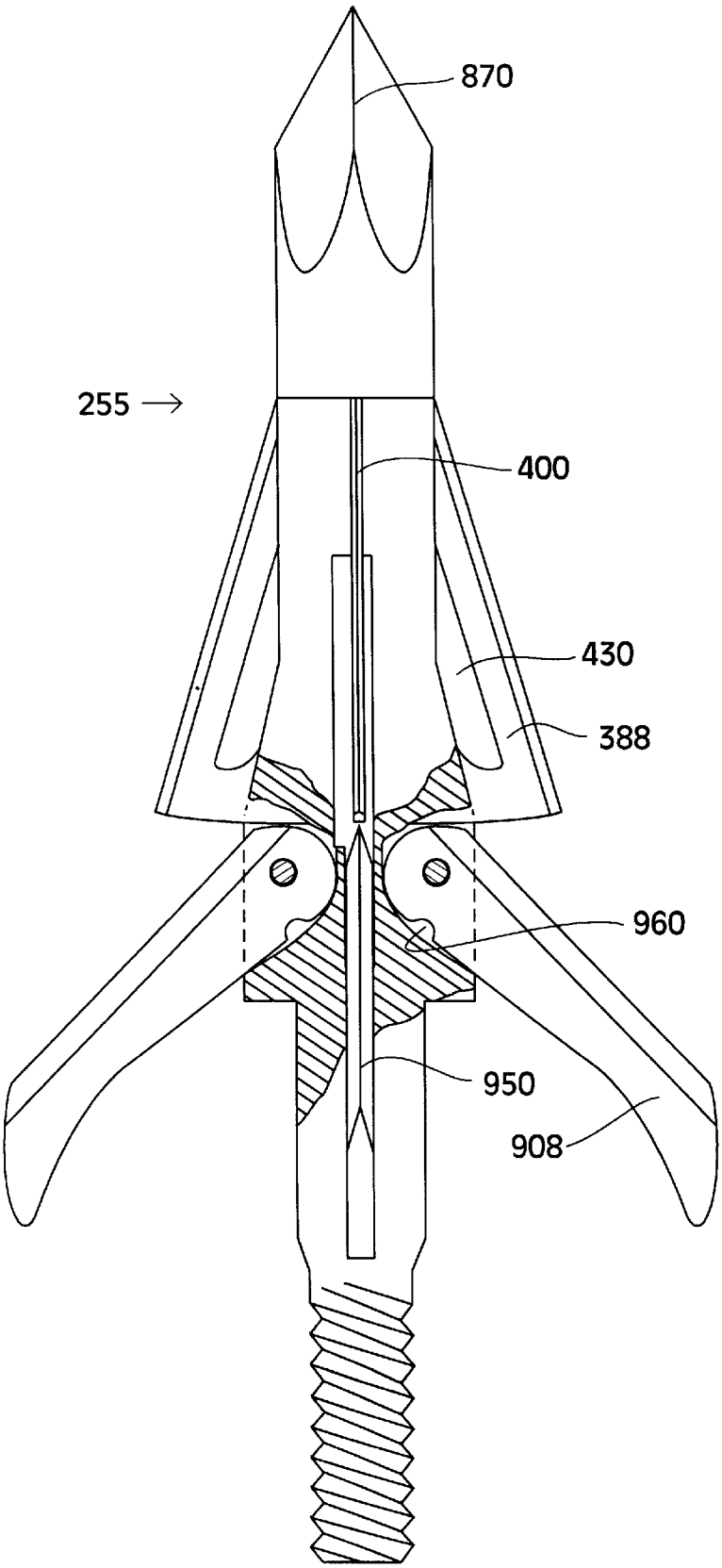

FIG. 148 illustrates an arrowhead 255 which is similar to arrowhead 254 except that arrowhead 255 has a plurality of vented fixed-blades 388 each with a vent or cut-out section 430 and a plurality of pivotal blades 908 each having a notch 960 formed therein for receiving a conventional rubber O-ring which selectively retains or holds blades 908 in an in-flight configuration.

Figures 149, 150, 151, 152, 153, 154, 155, 156, 157, 158, 159, 160, 161, 162:
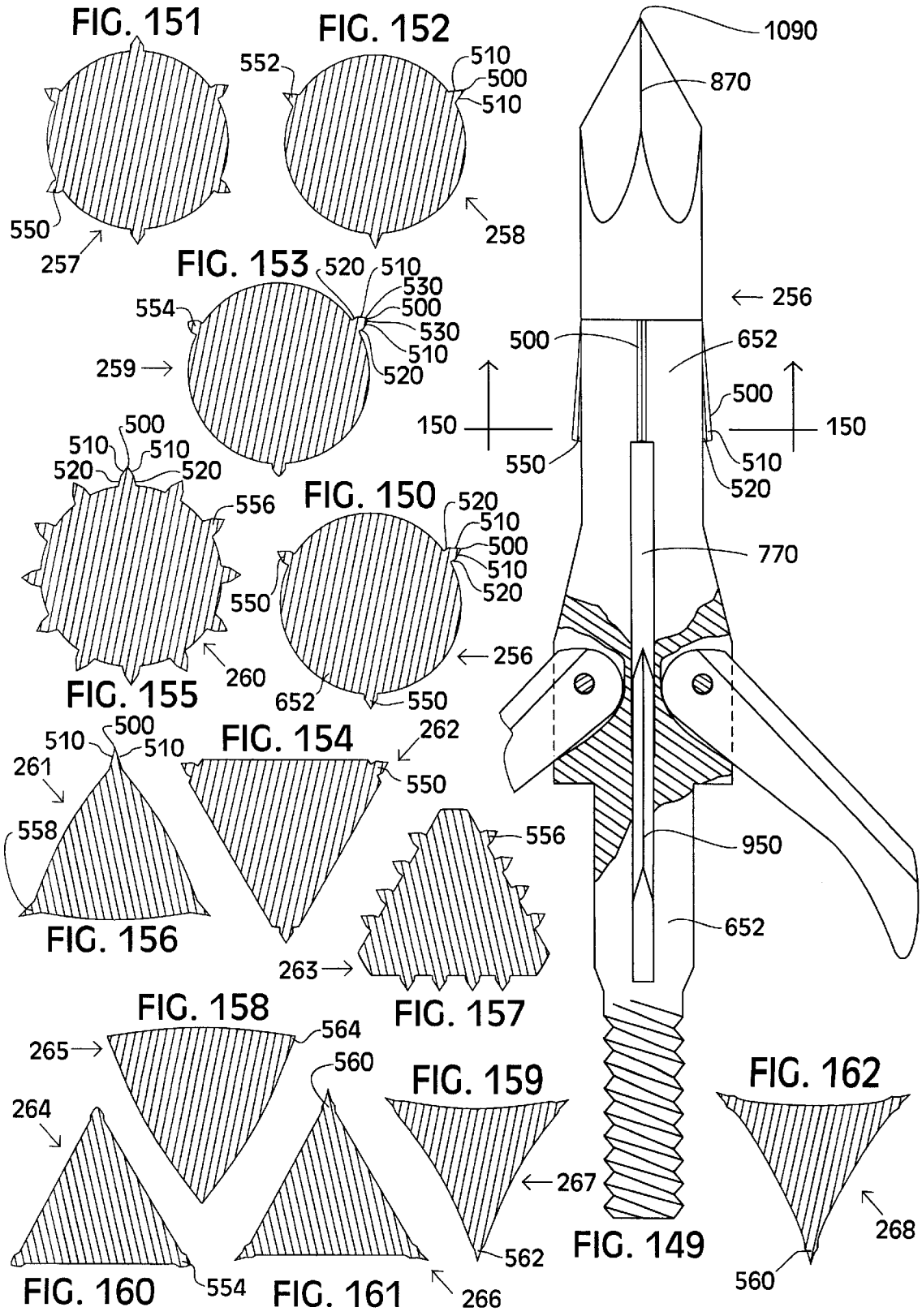

FIGS. 149 & 150 illustrate an arrowhead 256 with an arrowhead body 652 that has a plurality of integral cutting protrusions 550 each with a cutting edge 500 formed thereon. Each integral cutting protrusion 550 is integrally fabricated or formed upon its arrowhead body 652 at least in part during a manufacturing process or processes such as grinding and/or impact swaging and/or milling etc. Each integral cutting protrusion 550 as is clearly illustrated in FIG. 150 has a pair of primary bevels 510 such as could substantially be, but not limited to, grind bevels disposed on either side thereof and a pair of side faces 520. As is illustrated in FIG. 149 each cutting edge 500 is substantially in coplanar alignment with a cutting edge 950 of a corresponding pivotal blade.

As referenced in a plane perpendicular to the central longitudinal axis of arrowhead 256 the location upon each integral cutting protrusion 550 where the exterior surface of arrowhead body 652 (and therefore the external surface of each integral cutting protrusion 550) changes slope either marks the boundary or junction of a primary bevel 510 with a side face 520, or the boundary of a side face 520 with the junction of the arrowhead body 652 that is not comprised of an integral cutting protrusion 550, or the cutting edge boundary 500 with opposing primary bevels 510 on either side thereof. As is clearly illustrated in FIG. 150 at least a section of the exterior surface of arrowhead body 652 that is not comprised of an integral cutting protrusion 550 extends between each integral cutting protrusion 550.

It is apparent that integral cutting protrusions as according to this invention could consist essentially of only one side face 520 and one primary bevel 510 in addition to a cutting edge 500, or that integral cutting protrusions as according to this invention could consist essentially of only two side faces 520 in addition to a cutting edge 500, or that integral cutting protrusions as according to this invention could be comprised of other combinations of the various components of the integral cutting protrusions as according to this invention as disclosed within this specification.

Cutting edges 500 of the integral cutting protrusions as according to this invention serve to provide substantially the same function as cutting edges 400 as has been taught herein, in that cutting edges 500 act as forward leading cutting edges which are situated at least in part forward of a main cutting blade when a corresponding arrowhead is in a penetrating configuration so as to provide aerodynamically favorable arrowheads that enhance penetration by reducing the frictional drag that otherwise would of been generated between an arrowhead and target material by cutting such target material in front of the main cutting blade(s) during penetration.

FIGS. 151–162 illustrate arrowheads 257–268 which disclose a variety of different arrowhead bodies and differing integral cutting protrusion examples as according to this invention. Such arrowheads are only considered examples of integral cutting protrusion as according to this invention and are not intended to be an all inclusive exhaustive collection thereof. Although the cross-sectional views of arrowheads 257–268 are taken substantially in a plane perpendicular to the central longitudinal axises of corresponding arrowheads so as to not intersect corresponding blades slots of the arrowheads, it is apparent that such cross-sectional views could also intersect corresponding blade slots and thus illustrate yet other arrowheads as according to this invention.

It is apparent that the arrowhead bodies of the arrowheads as according to this invention may be comprised of sharpenable materials such as composites or other organic polymers, metals particularly steels such as carbon steels, high carbon steels, various stainless steels and/or chrome-moly steels, carbides or other metals such as the various aluminum, titanium and vanadium alloys. It is apparent that the arrowhead bodies as according to this invention may be hardened in heat treating processes and that the integral cutting protrusions as according to this invention may be heat treated and/or hardened so as to retain an optimally desirable cutting edge as is according to the desired results of this invention. It is yet further apparent that arrowhead bodies as according to this invention being fabricated from composite or other moldable polymeric type materials including those combinable with matrix reinforcing elements may have cutting blades molded with such arrowhead bodies or arrowheads as is according to this invention.

It is within the desired results of this invention to provide a cutting edge located forward of a main cutting blade when an accompanying arrowhead is in a penetrating configuration that is as sharp as a virgin ground, honed and stropped razor edge. However, it is apparent that obtaining such a fine or razor sharp cutting edge as according to this invention is not of necessity a requirement for the arrowheads as according to this invention. For example, an edge or equivalent that cuts regardless of its sharpness located forward of a main cutting blade, when an accompanying arrowhead is in a penetrating configuration, that enhances penetration and/or reduces frictional drag in such a manner so that the arrowhead performs better in such desired objective traits than it would of otherwise performed without the forwardly located cutting edge(s) as according to this invention will meet the desired results of this invention.

Referring again to FIGS. 151–162 and arrowheads 257–268, FIG. 152 illustrates arrowhead 258 having a plurality of integral cutting protrusions 552 that each have a pair of primary bevels 510 and a cutting edge 500.

FIG. 153 illustrates an arrowhead 259 having a plurality of integral cutting protrusions 554 that each have a pair of primary bevels 510, a pair of side faces 520, a pair of secondary bevels 530 which could be identified as but not limited to hone bevels, and a cutting edge 500. Side faces 520 of each integral cutting protrusion 554 are substantially parallel to each other.

For the integral cutting protrusions as according to this invention having a pair of hone bevels 530 or secondary bevels or only one hone bevel 530 in addition to a primary bevel 510 and/or a side face 520 or equivalents it is apparent that a change in slope of the exterior surface of the corresponding arrowhead body will also mark the junction or boundary of a hone bevel 530 with an adjoining different sloped exterior surface component of the integral cutting protrusion or other arrowhead structure.

FIG. 155 illustrates an arrowhead 260 having a plurality of integral cutting protrusions 556 that each have a pair of primary bevels 510, a pair of side faces 520 and a cutting edge 500. Side faces 520 of each integral cutting protrusion 556 are substantially not parallel to each other.

Arrowhead 261 as illustrated in FIG. 156 has a plurality of integral cutting protrusions 558 which are similar to integral cutting protrusions 552. Arrowhead 265 as illustrated in FIG. 158 has a plurality of integral cutting protrusions 564 which are substantially the exposed comers of the conjunction of adjoining convex portions of the arrowhead body. Arrowhead 266 as illustrated in FIG. 161 has a plurality of integral cutting protrusions 560. And arrowhead 267 as illustrated in FIG. 159 has a plurality of integral cutting protrusions 562. It is apparent that an arrowhead tip as according to this invention could have a cross-section depicting a plurality of three convex facets such as is illustrated in FIG. 158.

Figure 164:
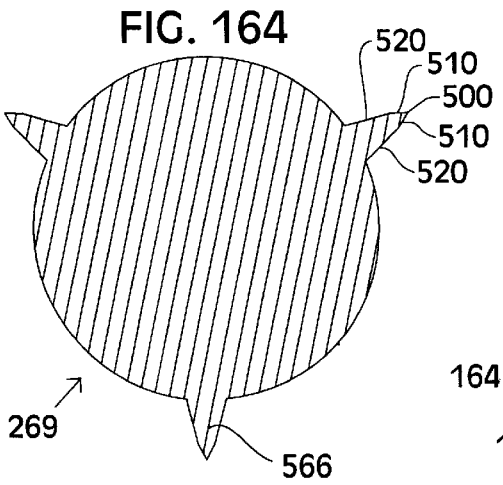
Figure 163:
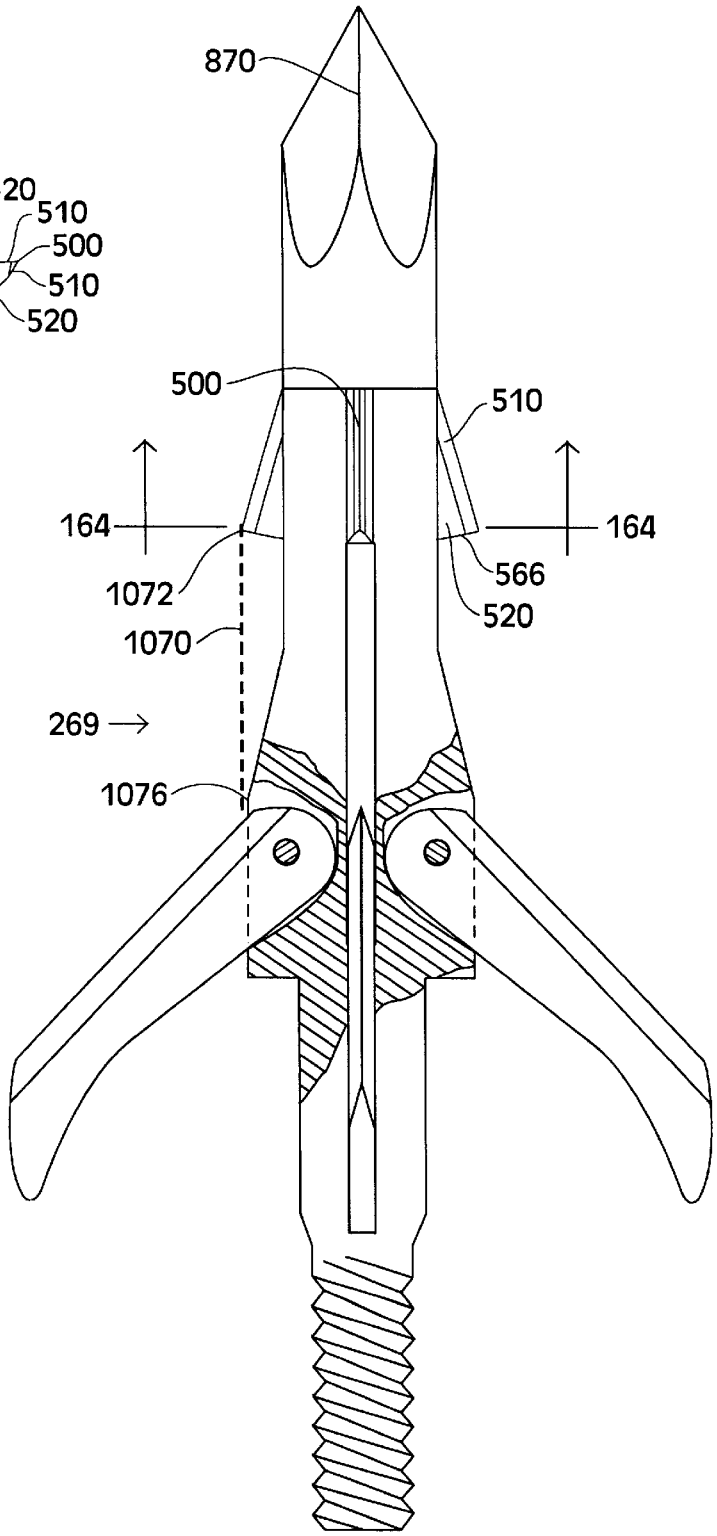

FIGS. 163 & 164 illustrate an arrowhead 269 having a plurality of integral cutting protrusions 566 that each have a pair of primary bevels 510, a pair of side faces 520, and a cutting edge 500 thereon. As is illustrated by line 1070 which is parallel to the central longitudinal axis of arrowhead 269, the widest section 1072 of each integral cutting protrusion cutting edge 500 is further from the central longitudinal axis of the arrowhead than is the widest section 1076 of the arrowhead body that is located rearward of cutting protrusions 566.

Figure 165:
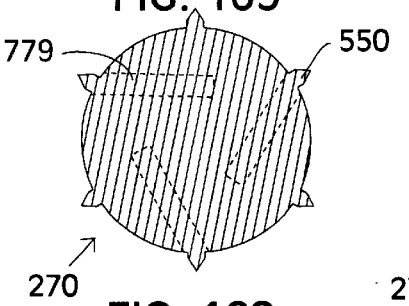
Figure 166:
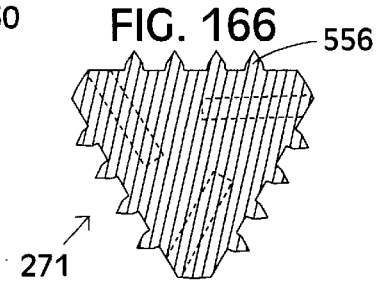
Figure 167:
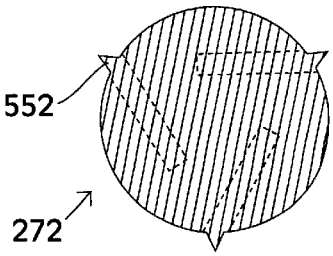
Figure 168:
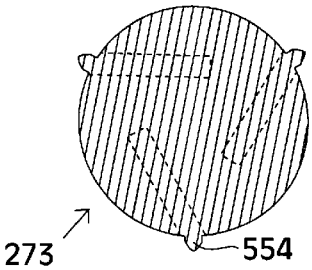

FIGS. 165–180 illustrate cross-sectional views of arrowheads 270–285 and disclose a variety of different arrowhead bodies and different integral cutting protrusion examples as according to this invention. Arrowheads 270–285 all have non-radially aligned main cutting blade slots 779 as is clearly identified in FIG. 165. Although slots 779 are shown in dotted lines which illustrates that the cross-sections are taken perpendicularly substantially so as to not intersects blade slots 779 of arrowheads 270–285 it is apparent that the cross-sectional views as illustrated in FIGS. 165–180 could be illustrative of arrowhead perpendicular sections having slots such as slots 779 disposed explicitly in such cross-sections or other slot configurations as taught herein or as known in the art, and thus FIGS. 165–180 could also illustrate other arrowheads as according to this invention.

Figure 169:
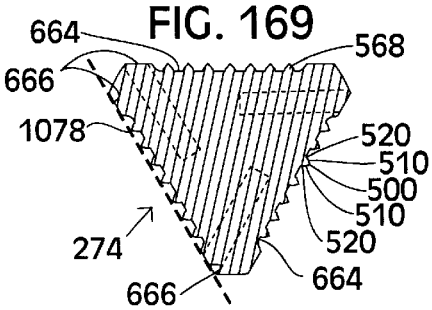
Figure 170:
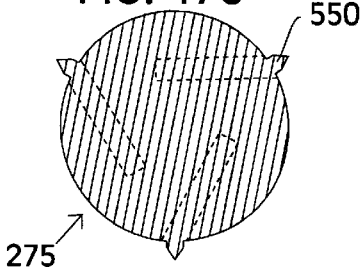
Figure 171:
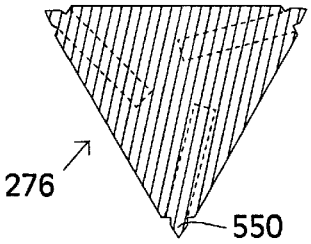

FIG. 169 illustrates an arrowhead 274 which has a plurality of integral cutting protrusions 568 that each have a pair of primary bevels 510, a pair of side faces 520 and a cutting edge 500. Arrowhead 274 has a plurality of non-cutting surface sections 666 and a plurality of three flats 664 each containing a plurality of integral cutting protrusions 568 thereon. A straight line 1078 positioned so as to lay against but not intersect the exterior surfaces of two non-cutting surfaces 666 of arrowhead 274 does not substantially have any portion of an integral cutting protrusion 568 extending or projecting outwardly therebeyond on a side of line 1078 opposite the side thereof that the central longitudinal axis of arrowhead 274 is located on.

Figure 172:
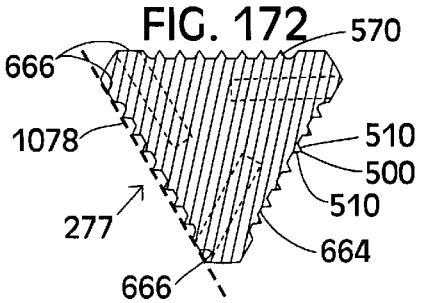
Figure 173:
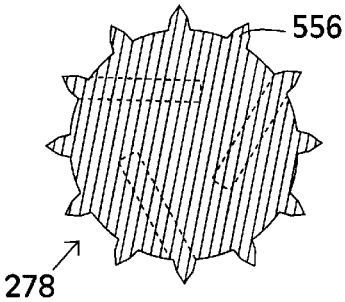
Figure 174:
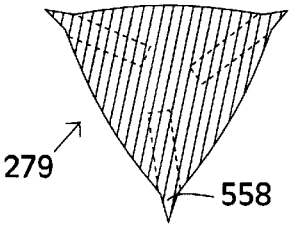
Figure 175:
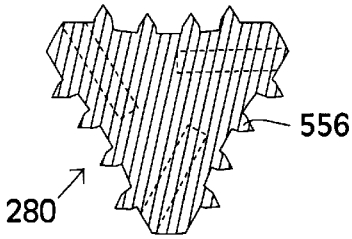
Figure 176:
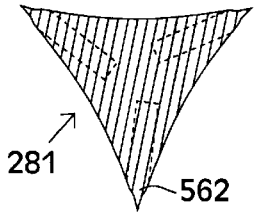
Figure 177:
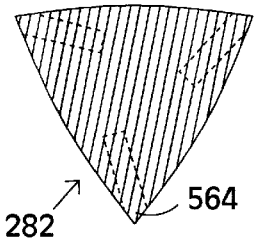
Figure 178:
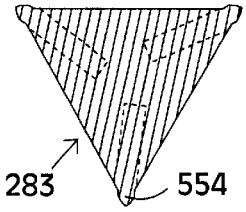
Figure 179:
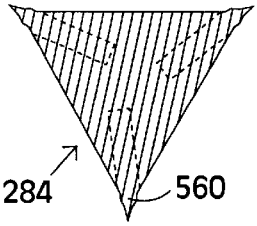
Figure 180:
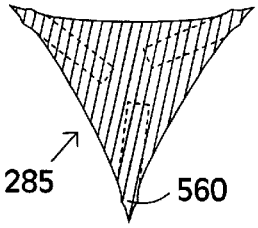

FIG. 172 illustrates an arrowhead 277 which is similar to arrowhead 274 except that arrowhead 277 has a plurality of integral cutting protrusions 570 that each have only a pair of primary bevels 510 and a cutting edge 500. At least a section of the exterior surface of the arrowhead body of arrowhead 277 that is not comprised of an integral cutting protrusion 570 extends between each integral cutting protrusion 570.

It is apparent that arrowheads as according to this invention which are similar to arrowhead 274 or arrowhead 277 could exist wherein in place of flats 664 an arrowhead could have a convexity or a concavity or another shaped exterior surface equivalent such that a non-linear or non-straight line that performs the function of line 1078, which has the exact slope or slopes or shape as the non-flat other shaped exterior surface could be used to describe or teach such other arrowheads as line 1078 does for arrowheads disclosed herein.

Figure 181:
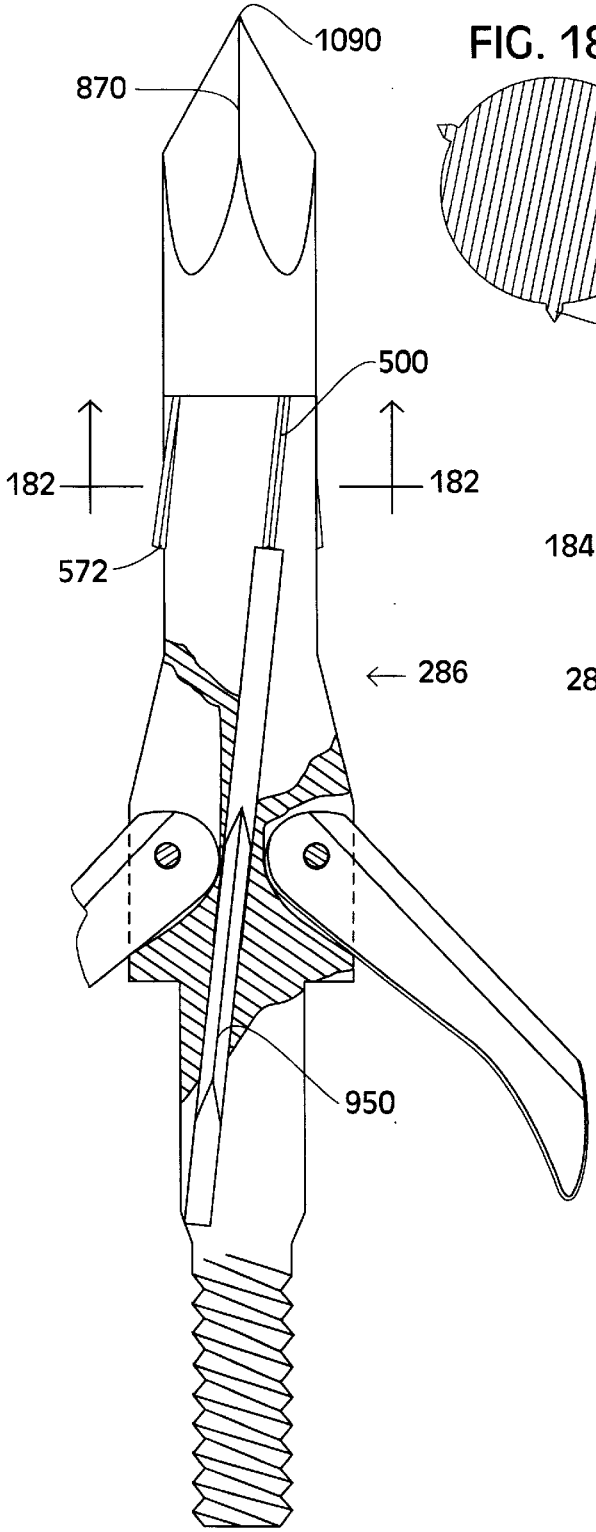
Figure 182:
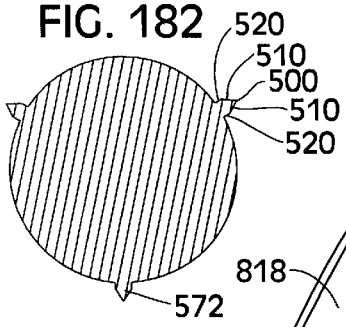

FIGS. 181 & 182 illustrate an arrowhead 286 having a plurality of integral cutting protrusions 572 that are inclined at an angle relative to the central longitudinal axis of arrowhead 286 so as to induce spinning on the arrowhead when penetrating a target.

Figure 184:
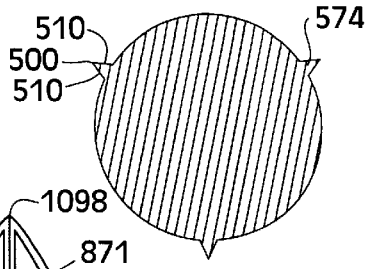
Figure 183:
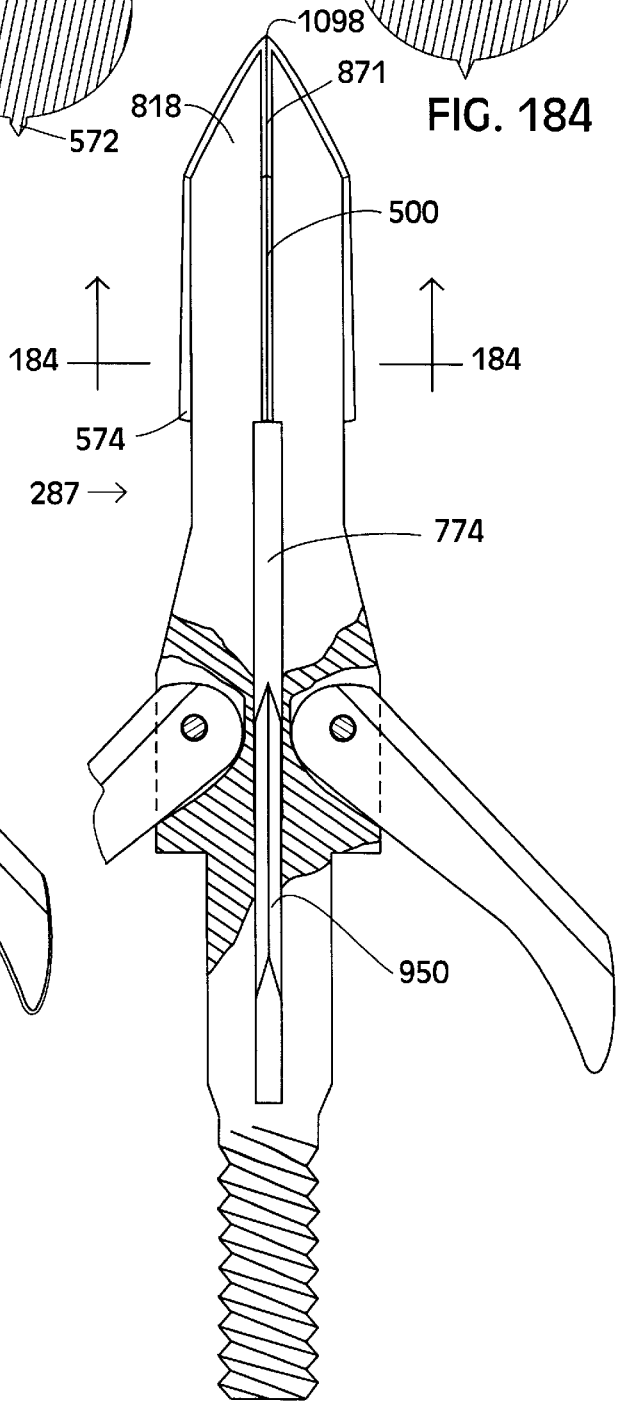

FIGS. 183 & 184 illustrate an arrowhead 287 having a plurality of integral cutting protrusions 574, a forward leading end 1098 and an integral arrowhead tip 818 having a plurality of facet boundaries 871 each with a cutting edge formed thereon. It is apparent that arrowhead tip 818 may have convex facets or flat facets or concave facets.

Figures 185, 186, 187, 188, 189, 190, 191, 192, 193:
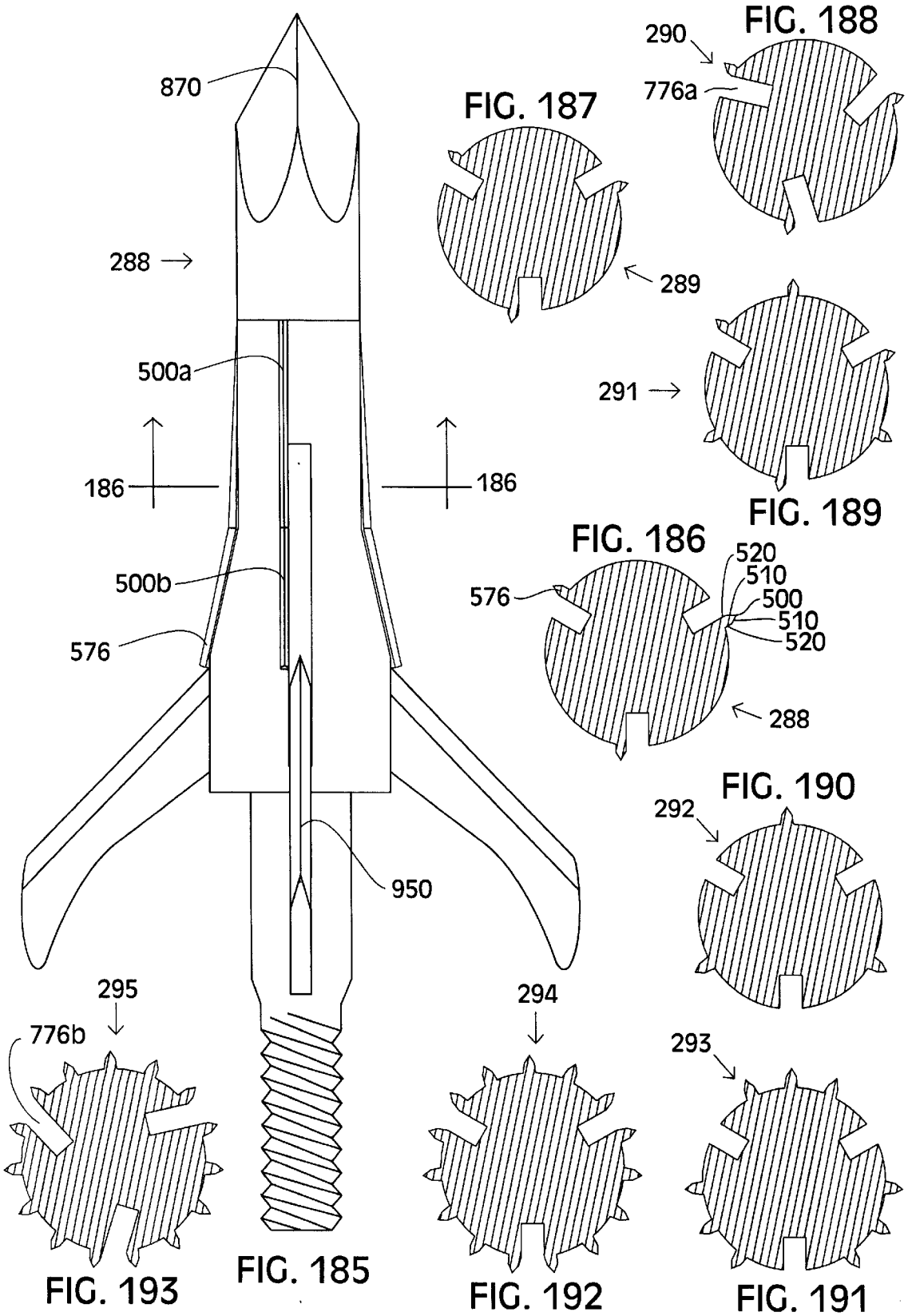

FIGS. 185 & 186 illustrate an arrowhead 288 having a plurality of integral cutting protrusions 576 that extend elongately rearward near to the forward most section or terminus of cutting edges 950 when arrowhead 288 is in a penetrating configuration. Each integral cutting protrusion 576 has a forward cutting edge section 500*a* and a rearward cutting edge section 500*b*. As is illustrated in FIG. 186 integral cutting protrusions 576 are non-radially aligned with the central longitudinal axis of the arrowhead.

FIGS. 187–193 illustrate cross-sectional views of arrowheads 289–295 and disclose a variety of different arrowhead bodies and different integral cutting protrusion examples as according to this invention. Arrowheads 289–295 each have a plurality of integral cutting protrusions that are radially aligned with the central longitudinal axises of their corresponding arrowhead bodies. Arrowhead 290 as illustrated in FIG. 188 has non-radially aligned main cutting blade slots 776*a* which cause corresponding main cutting blades when in a penetrating configuration to produce a right handed spinning force on arrowhead 290. Arrowhead 295 as illustrated in FIG. 193 has non-radially aligned main cutting blade slots 776*b* which cause corresponding main cutting blades when in a penetrating configuration to produce a left handed spinning force on arrowhead 295.

FIGS. 194 & 195 illustrate an arrowhead 296 that has an arrowhead body 662 and a plurality of integral cutting protrusions 582 that extend elongately rearward near to the forward most section or terminus of cutting edges 950. Arrowhead body 662 has a constant sloped taper from the rear end of its arrowhead tip rearward to the widest section 1076 thereof. This is in contrast to arrowhead 288 as illustrated in FIG. 185 which does not have such constant slope tapered integral cutting protrusions 576.

The arrowheads as according to this invention overcome deficiencies inherent in prior art arrowheads by providing arrowheads that enhance penetration and reduce the frictional drag that otherwise would of been generated between an arrowhead and target material by cutting such target material in front of the main cutting blades during target penetration.

Although the main cutting blades of the arrowheads of this invention have been depicted as pivotal blades only throughout this specification, it is apparent that fixed blades could be used as main cutting blades as according to this invention.

Although the preferred embodiments of this invention have been depicted as having a plurality of three pivotal blades or main cutting blades each, with only one blade disposed in each corresponding blade slot, it is apparent that the arrowheads according to this invention may have any number of main cutting blades and any number of forward leading penetration enhancing cutting blades or cutting edges as according to this invention, with more than one being preferred. It is also apparent that more than one blade may be housed or contained in a single blade slot—particularly where a straight hinge pin has a plurality of at least two blades attached thereon.

It is apparent that the different and various elements of this invention may be made of light weight and strong materials, such as composites, organic polymers, resilient materials, aluminum alloys, titanium alloys, stainless steels and other metals and materials. It is also apparent that the arrowhead bodies of the arrowheads of this invention may be fastened to the forward end of an arrow shaft by any method, such as threading into an insert, or glueing thereon.

It is apparent that the different parts and elements and their equivalents of the arrowheads of this invention, as discussed above and according to other preferred embodiments of this invention, can be changed, or interchanged, or eliminated, or duplicated, or made of different materials, and connected to or associated with adjacent elements in different manners, other than suggested herein, without deterring from the desired results of the arrowheads of this invention. For example, arrowheads having at least in part features as disclosed in this specification may be combined with features of the embodiments and spirit of the arrowheads and cutting tips incorporated herein by specific reference.

It is to be understood that the present invention is not limited to the sole embodiments described above, as will be apparent to those skilled in the art, but encompasses the essence of all embodiments, and their legal equivalents, within the scope of the following claims.

I claim:

1. An arrowhead comprising:

(a) a forward leading end;

(b) an arrowhead body having a central longitudinal axis;

(c) a cutting blade having a first cutting edge; and (d) a second cutting edge configured upon said arrowhead such that at least a section thereof extends forward of said first cutting edge when said arrowhead is in a penetrating configuration, wherein when said arrowhead is in an in-flight configuration the perpendicular distance from said longitudinal axis to the furthest section of said cutting blade from said longitudinal axis is longer than the perpendicular distance the furthest section of said second cutting edge is displaced from said longitudinal axis.

2. An arrowhead as recited in claim 1 wherein when said arrowhead is in said penetrating configuration the forward terminus of said second cutting edge is located rearward of said forward leading end of said arrowhead.

3. An arrowhead as recited in claim 2 wherein the rearward terminus of said second cutting edge is located forward of a forward terminus of said first cutting edge.

4. An arrowhead as recited in claim 2 wherein the rearward terminus of said second cutting edge is located closer to said forward leading end of said arrowhead than to a forward end of an arrowshaft when said arrowhead is attached to said arrowshaft.

5. An arrowhead as recited in claim 2 wherein said second cutting edge has a linear length that is less than the linear length of said first cutting edge.

6. An arrowhead as recited in claim 2 wherein at least a section of said cutting blade projects outward from said arrowhead body when said arrowhead is in said in-flight configuration.

7. An arrowhead as recited in claim 2 further comprising an arrowhead tip located at said forward leading end of said arrowhead, said arrowhead tip comprising a facet and a facet boundary such that said second cutting edge is located rearward of said facet boundary when said arrowhead is in said penetrating configuration.

8. An arrowhead as recited in claim 7 wherein said facet boundary is substantially in coplanar alignment with at least a linear section of said second cutting edge.

9. An arrowhead as recited in claim 2 wherein when said arrowhead is in said penetrating configuration a line parallel to said central longitudinal axis that is displaced a distance outward from an exterior surface of said arrowhead body intersects said second cutting edge while intersecting at least a section of said cutting blade.

10. An arrowhead as recited in claim 9 wherein said parallel line intersects said first cutting edge when intersecting said second cutting edge.

11. An arrowhead as recited in claim 9 wherein said cutting blade is pivotally hinged to said arrowhead body.

12. An arrowhead as recited in claim 11 wherein said arrowhead is a blade-opening arrowhead and said cutting blade rotates in a rearward direction when rotating from said in-flight configuration to said penetrating configuration.

13. An arrowhead as recited in claim 12 wherein when said arrowhead is in said penetrating configuration a first plane parallel to a side face of said cutting blade that intersects at least a linear section of said first cutting edge is not in perpendicular alignment with a second plane that is parallel to said central longitudinal axis and intersecting at least a linear section of said second cutting edge.

14. An arrowhead as recited in claim 1 wherein said second cutting edge is disposed on a second cutting blade attached to said arrowhead.

15. An arrowhead as recited in claim 14 wherein said second cutting blade is a fixed blade.

16. An arrowhead as recited in claim 15 wherein said arrowhead is a blade-opening arrowhead.

17. An arrowhead as recited in claim 15 further comprising a shaft configured upon said arrowhead so as to aid in fixedly attaching said second cutting blade to said arrowhead body.

18. An arrowhead as recited in claim 17 wherein at least a section of said shaft is threaded, said arrowhead body comprising a through hole having at least a section thereof threaded so as to receive said threaded section of said shaft therein when said fixed blade is attached to said arrowhead body.

19. An arrowhead as recited in claim 17 wherein said fixed blade has an aperture, said shaft extending through said aperture when said fixed blade is attached to said arrowhead body.

20. An arrowhead as recited in claim 19 wherein said arrowhead is a blade-opending arrowhead.

21. An arrowhead as recited in claim 17 wherein said arrowhead body is a single integral structural entity.

22. An arrowhead as recited in claim 14 wherein said cutting edge of said pivotal blade is substantially in coplanar alignment with said cutting edge of said fixed-blade when said arrowhead is in said penetrating configuration.

23. An arrowhead comprising:

(a) an arrowhead body having:
  (i) a central longitudinal axis;
  (ii) an exterior surface; and
  (iii) a first blade slot and a second blade slot configured thereupon such that at least a section of said second blade slot is located substantially forward of said first blade slot;

(b) a first blade attached to said arrowhead body at least in part within said first blade slot; and (c) a second blade attached to said arrowhead body at least in part within said second blade slot, wherein a line parallel to said central longitudinal axis intersects both said blade slots.

24. An arrowhead as recited in claim 23 wherein each said slot is externally exposed to only one opposing elongate side of said arrowhead body.

25. An arrowhead as recited in claim 23 wherein each said blade slot comprises a pair of opposing bounding sidewalls that each extend to an exposed exterior corner at their conjunction with said arrowhead body exterior surface so that when said parallel line is displaced a perpendicular distance away from said central longitudinal axis equal to a perpendicular distance that at least one of said second slot exterior corners is displaced from said central longitudinal axis, such that said parallel line is not located outside of said second slot sidewalls, said parallel line intersects at least a section of said first slot.

26. An arrowhead as recited in claim 25 wherein said first slot is substantially parallely aligned with said central longitudinal axis.

27. An arrowhead as recited in claim 23 wherein said second blade is located rearward of the forward leading end of said arrowhead body.

28. An arrowhead as recited in claim 23 wherein a forward terminus of said second slot does not communicate with said longitudinal axis.

29. An arrowhead as recited in claim 23 wherein when said arrowhead is in an in-flight configuration the perpendicular distance between said longitudinal axis and the furthest section of said first blade from said longitudinal axis is longer than the perpendicular distance between said longitudinal axis and the furthest section of said second blade from said longitudinal axis.

30. An arrowhead as recited in claim 23 wherein each said blade comprises a cutting edge.

31. An arrowhead as recited in claim 30 wherein at least a linear section of each said cutting edge is substantially in coplanar alignment with each other when the arrowhead is in a penetrating configuration.

32. An arrowhead as recited in claim 31 wherein a rearward terminus cutting edge of said second blade is situated substantially forward of said first blade when the arrowhead is in an in-flight configuration.

33. An arrowhead as recited in claim 30 wherein when said arrowhead is in an in-flight configuration a plane perpendicular to said longitudinal axis of said arrowhead body intersects both said first blade and said second blade.

34. An arrowhead as recited in claim 30 wherein said arrowhead is a blade-opening arrowhead such that when in an in-flight configuration a non-sharpened leading section of said first blade outwardly projects from said arrowhead body.

35. An arrowhead comprising:

(a) an arrowhead body having a central longitudinal axis;

(b) a pivotal blade connected to said arrowhead body so as to be enabled to rotate relative to said arrowhead body; and (c) a fixed-blade attached to said arrowhead body comprising:
  (i) an edge extending peripherally thereabout; and
  (ii) an exterior side face, wherein a plane coplanar with at least a section of said exterior side face is not parallel to at least another section of said exterior side face.

36. An arrowhead as recited in claim 35 wherein said fixed-blade has a bent portion such that blade material of said fixed-blade is capable of being simultaneously housed within a pair of spaced apart blade slots that communicate with each other.

37. An arrowhead as recited in claim 36 wherein said blade slots communicate with each other at least substantially near said central longitudinal axis.

38. An arrowhead as recited in claim 36 wherein said spaced apart blade slots are off set from each other by substantially 120 degrees.

39. An arrowhead as recited in claim 36 further comprising an arrowhead tip attachable to said arrowhead body so that when attached thereto a plane perpendicular to said central longitudinal axis intersects at least a section of both said fixed-blade and said arrowhead tip.

40. An arrowhead as recited in claim 35 wherein said arrowhead body further comprises a hollow internally bound cylinder having a blade slot communicating therewith, said fixed-blade having a bent portion such that when said fixed-blade is attached to said arrowhead body within said blade slot at least a section of said bent portion is housed within said internal cylinder.

41. An arrowhead as recited in claim 40 further comprising a shaft insertable within said cylinder when said fixed-blade is attached to said arrowhead body, said shaft being disposed within said cylinder so that at least a section of said bent blade portion of said fixed-blade is located between said shaft and an internal wall surface of said cylinder.

42. An arrowhead as recited in claim 41 wherein said shaft is integral with a removably attachable arrowhead tip.

43. An arrowhead as recited in claim 31 further comprising a plurality of said blades.

44. An arrowhead as recited in claim 43 wherein said hollow cylinder comprises an elongate central axis, said central axis of said cylinder being collinear with said central longitudinal axis of said arrowhead body.

45. An arrowhead as recited in claim 43 wherein the furthest section of said pivotal blade from said central longitudinal axis is further from said central longitudinal axis than is the furthest section of said fixed blade.

46. An arrowhead as recited in claim 45 wherein at least a section of said shaft is threaded, said arrowhead body comprising a through hole having at least a section thereof threaded so as to receive said threaded section of said shaft therein when said fixed blade is attached to said arrowhead body.

47. An arrowhead as recited in claim 46 wherein said fixed blade has an aperture, said shaft extending through said aperture when said fixed blade is attached to said arrowhead body.

48. An arrowhead as recited in claim 47 wherein said arrowhead is a blade-opening arrowhead.

49. An arrowhead as recited in claim 46 wherein said arrowhead body is a single integral structural entity.

50. An arrowhead as recited in claim 49 wherein the exterior surface of said integral cutting protrusion on at least one side of said integral cutting edge as determined in a plane perpendicular to said central longitudinal axis has at least a section thereof with a differing mathematical slope than at least another section of said exterior surface of said integral cutting protrusion on said side of said integral cutting edge.

51. An arrowhead as recited in claim 47 further comprising a plurality of at least two integral cutting protrusions each having at least one said integrally formed cutting edge thereon, such that at least a section of said exterior surface of said arrowhead body that is not comprised of an integral cutting protrusion extends between at least a first integral cutting protrusion and a second integral cutting protrusion.

52. An arrowhead as recited in claim 47 wherein a line parallel to said central longitudinal axis intersects said blade slot and said integral cutting edge.

53. An arrowhead as recited in claim 52 wherein at least a linear section of said blade cutting edge and at least a linear section of said integral cutting edge are in coplanar alignment with each other.

54. An arrowhead as recited in claim 47 wherein a plane perpendicular to said central longitudinal axis intersects said blade slot and said integral cutting edge.

55. An arrowhead as recited in claim 47 wherein at least a section of said integral cutting protrusion extends forward of said blade slot.

56. An arrowhead as recited in claim 47 further comprising an integral arrowhead tip.

57. An arrowhead as recited in claim 56 wherein said arrowhead tip has an integrally formed cutting edge.

58. An arrowhead as recited in claim 57 wherein at least a linear section of said integrally formed cutting edge of said arrowhead tip is substantially in coplanar alignment with at least a linear section of said integrally formed cutting edge of said arrowhead body.

59. An arrowhead as recited in claim 47 wherein said blade slot is substantially non-radially aligned with said central longitudinal axis of said arrowhead body.

60. An arrowhead as recited in claim 59 wherein said cutting blade is a pivotal blade hingedly connected within said blade slot.

61. An arrowhead comprising:

(a) a forward leading end;

(b) an arrowhead body having a central longitudinal axis;

(c) a pivotal blade connected to said arrowhead body so as to be enabled to rotate relative to said arrowhead body, said pivotal blade having a cutting edge which extends to a forward terminus when said arrowhead is in a penetrating configuration; and (d) a fixed blade having a cutting edge, said fixed blade cutting edge comprising:

(i) a forward terminus; and (ii) a rearward terminus, wherein when said arrowhead is in said penetrating configuration said forward terminus of said fixed-blade cutting edge is located rearward of said forward leading end of said arrowhead and said rearward terminus of said fixed-blade cutting edge is located forward of said forward terminus of said pivotal blade cutting edge, said pivotal blade and said fixed-blade each being housed within a blade slot such that the blade slot that houses said fixed-blade and the blade slot that houses said pivotal blade communicate with each other.

62. An arrowhead comprising:

(a) a forward leading end;

(b) an arrowhead body having a central longitudinal axis;

(c) a pivotal blade connected to said arrowhead body so as to be enabled to rotate relative to said arrowhead body, said pivotal blade having a cutting edge which extends to a forward terminus when said arrowhead is in a penetrating configuration; and (d) a fixed blade having a cutting edge, said fixed blade cutting edge comprising:

(i) a forward terminus; and (ii) a rearward terminus, wherein when said arrowhead is in said penetrating configuration said forward terminus of said fixed-blade cutting edge is located rearward of said forward leading end of said arrowhead and said rearward terminus of said fixed-blade cutting edge is located forward of said forward terminus of said pivotal blade cutting edge, said pivotal blade and said fixed-blade each being housed within a blade slot such that the blade slot that houses said fixed-blade and the blade slot that houses said pivotal blade communicate with each other so as to be substantially the same blade slot.

63. An arrowhead comprising:

(a) a forward leading end;

(b) an arrowhead body having a central longitudinal axis;

(c) a pivotal blade connected to said arrowhead body so as to be enabled to rotate relative to said arrowhead body, said pivotal blade having a cutting edge which extends to a forward terminus when said arrowhead is in a penetrating configuration; and (d) a fixed blade having a cutting edge, said fixed blade cutting edge comprising:

(i) a forward terminus; and (ii) a rearward terminus, wherein when said arrowhead is in said penetrating configuration said forward terminus of said fixed-blade cutting edge is located rearward of said forward leading end of said arrowhead and said rearward terminus of said fixed-blade cutting edge is located forward of said forward terminus of said pivotal blade cutting edge, said pivotal blade and said fixed-blade each being housed within a blade slot such that the blade slot that houses said fixed-blade and the blade slot that houses said pivotal blade are substantially different blade slots wherein a line parallel to said central longitudinal axis intersects both said slots.

64. An arrowhead comprising:

(a) a forward leading end;

(b) an arrowhead body having a central longitudinal axis;

(c) a pivotal blade connected to said arrowhead body so as to be enabled to rotate relative to said arrowhead body, said pivotal blade having a cutting edge which extends to a forward terminus when said arrowhead is in a penetrating configuration; and (d) a fixed blade having a cutting edge, said fixed blade cutting edge comprising:

(i) a forward terminus; and (ii) a rearward terminus, wherein when said arrowhead is in said penetrating configuration said forward terminus of said fixed-blade cutting edge is located rearward of said forward leading end of said arrowhead and said rearward terminus of said fixed-blade cutting edge is located forward of said forward terminus of said pivotal blade cutting edge, said pivotal blade and said fixed-blade each being housed within a blade slot such that the blade slot that houses said fixed-blade and the blade slot that houses said pivotal blade are substantially different blade slots wherein each said slot comprises a bounding sidewall, said sidewall of each said slot being substantially non parallel to each other.

65. An arrowhead comprising:

(a) a forward leading end;

(b) an arrowhead body having a central longitudinal axis;

(c) a pivotal blade connected to said arrowhead body so as to be enabled to rotate relative to said arrowhead body, said pivotal blade having a cutting edge which extends to a forward terminus when said arrowhead is in a penetrating configuration; and (d) a fixed blade having a cutting edge, said fixed blade cutting edge comprising:

(i) a forward terminus; and (ii) a rearward terminus, wherein when said arrowhead is in said penetrating configuration said forward terminus of said fixed-blade cutting edge is located rearward of said forward leading end of said arrowhead and said rearward terminus of said fixed-blade cutting edge is located forward of said forward terminus of said pivotal blade cutting edge, said pivotal blade and said fixed-blade each being housed within a blade slot such that the blade slot that houses said fixed-blade and the blade slot that houses said pivotal blade are substantially different blade slots wherein each said slot comprises a bounding sidewall, said sidewall of each said slot being substantially non parallel to each other and at least one sidewall of the slot housing said fixed-blade is not perpendicular to at least one sidewall of the slot housing said pivotal blade.

66. An arrowhead comprising:

(a) a forward leading end;

(b) an arrowhead body having a central longitudinal axis;

(c) a pivotal blade connected to said arrowhead body so as to be enabled to rotate relative to said arrowhead body, said pivotal blade having a cutting edge which extends to a forward terminus when said arrowhead is in a penetrating configuration; and (d) a fixed blade having a cutting edge, said fixed blade cutting edge comprising:

(i) a forward terminus; and (ii) a rearward terminus, wherein when said arrowhead is in said penetrating configuration said forward terminus of said fixed-blade cutting edge is located rearward of said forward leading end of said arrowhead and said rearward terminus of said fixed-blade cutting edge is located forward of said forward terminus of said pivotal blade cutting edge, said pivotal blade and said fixed-blade each being housed within a blade slot such that the blade slot that houses said fixed-blade and the blade slot that houses said pivotal blade are substantially different blade slots wherein said cutting edge of said pivotal blade is substantially in coplanar alignment with said cutting edge of said fixed-blade when said arrowhead is in said penetrating configuration.

* * * * *

UNITED STATES PATENT AND TRADEMARK OFFICE

CERTIFICATE OF CORRECTION

PATENT NO. : 6,258,000 B1
DATED : July 10, 2001
INVENTOR(S) : Victor Jay Liechty II It is certified that error appears in the above-identified patent and that said Letters Patent is hereby corrected as shown below:

Column 32,
Line 52, insert claims 67-74:

67. An arrowhead comprising:
(a) a forward leading end;
(b) an arrowhead body having a central longitudinal axis, and an internal hollow cylinder that extends elongately for less than a majority of the length of the section of said arrowhead body that projects forwardly from an accompanying arrowshaft when said arrowhead is attached thereto;
(c) a pivotal blade connected to said arrowhead body so as to be enabled to rotate relative said arrowhead body, said pivotal blade having a cutting edge which extends to a forward terminus when said arrowhead is in a penetrating configuration; and
(d) a fixed blade having a cutting edge, said fixed blade cutting edge comprising:
(i) a forward terminus; and
(ii) a rearward terminus, wherein when said arrowhead is in said penetrating configuration said forward terminus of said fixed-blade cutting edge is located rearward of said forward leading end of said arrowhead and said rearward terminus of said fixed-blade cutting edge is located forward of said forward terminus of said pivotal blade cutting edge.

68. An arrowhead as recited in claim 67 wherein said pivotal blade and said fixed-blade are each housed within a blade slot.

69. An arrowhead as recited in claim 68 wherein the blade slot that has houses said fi\xed-blade and the blade slot that houses said pivotal blade communicate with each other.

70. An arrowhead as recited in claim 69 wherein the blade slot that houses said fixed-blade and the blade slot that houses said pivotal blade are substantially the same blade slot.

71. An arrowhead as recited in claim 68 wherein the blade slot that houses said fixed-blade and the blade slot that houses said pivotal blade are substantially different blade slots.

72. An arrowhead as recited in claim 71 wherein a line parallel to said central longitudinal axis intersects both said slots.

73. An arrowhead as recited in claim 68 wherein each said slot comprises a bounding sidewall, said sidewall of each said slot being substantially non parallel to each other.

UNITED STATES PATENT AND TRADEMARK OFFICE

CERTIFICATE OF CORRECTION

PATENT NO. : 6,258,000 B1
DATED : July 10, 2001
INVENTOR(S) : Victor Jay Liechty II It is certified that error appears in the above-identified patent and that said Letters Patent is hereby corrected as shown below:

74. An arrowhead as recited in claim 73 wherein at least one sidewall of the slot housing said fixed-blade is not perpendicular to at least one sidewall to the slot housing said pivotal blade.

- In claim 22 replace "14" with -- 67 --.

- In claim 43 replace "43" with -- 40 --.

- In claim 44 replace "43" with -- 40 --

- In claim 45 replace "43" with -- 35 --.

AFTER CLAIM 74 ADD CLAIM 75:

75. An arrowhead as recited in claim 44 wherein said arrowhead is blade-opening arrowhead.

AFTER CLAIM 75 ADD CLAIMS 76-78:

76. An arrowhead as recited in claim 23 wherein said second blade is a fixed blade having a cutting edge disposed thereon.

77. An arrowhead as recited in claim 76 wherein said arrowhead is a blade-opening arrowhead.

78. An arrowhead as recited in claim 76 further comprising a shaft configured upon said arrowhead body so as to aid in fixedly attaching said second blade to said arrowhead body.

- In claim 46 replace "45" with -- 78 --.

AFTER CLAIM 78, ADD CLAIMS 79-81:

79. An arrowhead comprising:
(a) a forward leading end;
(b) an arrowhead body comprising:
  (i) a central longitudinal axis;
  (ii) a blade slot;
  (iii) an exterior surface; and
  (iv) a cutting edge integrally formed on said exterior surface, said cutting edge having a forward terminus that is displaced rearward of said forward leading end of said arrowhead; and
(c) a cutting blade having a cutting edge, said cutting blade being attached to said arrowhead body within said blade slot.

UNITED STATES PATENT AND TRADEMARK OFFICE

CERTIFICATE OF CORRECTION

PATENT NO. : 6,258,000 B1
DATED : July 10, 2001
INVENTOR(S) : Victor Jay Liechty II It is certified that error appears in the above-identified patent and that said Letters Patent is hereby corrected as shown below:

80. An arrowhead as recited in claim 79 wherein at least one hone bevel is configured adjacent said integrally formed cutting edge for at least a section of the length of said integrally formed cutting edge.
81. An arrowhead as recited in claim 79 having an integral cutting protrusion with said integral cutting edge formed thereon.

-In claim 50 replace "49" with -- 81 --.

-In claim 51 replace "47" with -- 79 --.

-In claim 52 replace "47" with -- 79 --.

-In claim 54 replace "47" with -- 79 --.

-In claim 55 replace "47" with -- 79 --.

-In claim 56 replace "47" with -- 79 --.

-In claim 59 replace "47" with -- 79 --.

Signed and Sealed this

Ninth Day of July, 2002

*Attest:*

*Attesting Officer*

JAMES E. ROGAN
*Director of the United States Patent and Trademark Office*